US010166574B2

(12) United States Patent
Mitchell et al.

(10) Patent No.: US 10,166,574 B2
(45) Date of Patent: Jan. 1, 2019

(54) SYSTEM AND METHOD FOR FABRICATING SCREEN PANEL ASSEMBLIES FOR VIBRATORY SEPARATORS

(71) Applicant: National Oilwell Varco, L.P., Houston, TX (US)

(72) Inventors: Monty Dean Mitchell, Garland, TX (US); Marek Kozikowski, Conroe, TX (US)

(73) Assignee: National Oilwell Varco, L.P., Houston, TX (US)

( * ) Notice: Subject to any disclaimer, the term of this patent is extended or adjusted under 35 U.S.C. 154(b) by 421 days.

(21) Appl. No.: 15/035,808

(22) PCT Filed: Nov. 12, 2013

(86) PCT No.: PCT/US2013/069619

§ 371 (c)(1),
(2) Date: May 11, 2016

(87) PCT Pub. No.: WO2015/072969

PCT Pub. Date: May 21, 2015

(65) Prior Publication Data

US 2016/0303612 A1 Oct. 20, 2016

(51) Int. Cl.

| | |
|---|---|
| ***B32B 37/00*** | (2006.01) |
| ***B07B 1/46*** | (2006.01) |
| ***B07B 1/48*** | (2006.01) |

(52) U.S. Cl.

CPC ..... *B07B 1/4618* (2013.01); *B07B 1/46* (2013.01); *B07B 1/4663* (2013.01); *B07B 1/48* (2013.01)

(58) Field of Classification Search

CPC ..... B07B 1/4618; B07B 1/46; B07B 1/4663; B07B 1/48; B29C 65/18

USPC ..... 156/228, 583.1

See application file for complete search history.

(56) References Cited

U.S. PATENT DOCUMENTS

| | | | |
|---|---|---|---|
| 4,728,422 A | 3/1988 | Bailey | |
| 6,237,780 B1 | 5/2001 | Schulte | |
| 8,002,011 B2 * | 8/2011 | Veix | B29C 66/8246 156/580 |

(Continued)

FOREIGN PATENT DOCUMENTS

DE 102009009092 A1 8/2010

OTHER PUBLICATIONS

The International Search Report and Written Opinion for PCT/US2013/069619, filed on Nov. 12, 2013 dated May 23, 2014.

*Primary Examiner* — James D Sells
(74) *Attorney, Agent, or Firm* — Amerson Law Firm, PLLC

(57) ABSTRACT

A method is disclosed that includes fabricating a screen panel support frame having a curved non-planar shape, wherein the curved non-planar shape has a first amount of post-fabrication curvature. The method further includes performing a screen panel unitization process to unitize the screen panel support frame having the first post-fabrication amount of curvature with at least a plurality of layers of screening material, the screen panel unitization process reducing the curvature of the screen panel support frame from the first post-fabrication amount of curvature to a second post-unitization amount of curvature that is less than the first post-fabrication amount.

20 Claims, 47 Drawing Sheets

(56) References Cited

U.S. PATENT DOCUMENTS

| | | | |
|---|---|---|---|
| 2005/0236305 | A1 | 10/2005 | Schulte, Jr. |
| 2008/0135463 | A1 | 6/2008 | Scott |
| 2009/0057205 | A1 | 3/2009 | Schulte, Jr. |

* cited by examiner

SYSTEM AND METHOD FOR FABRICATING SCREEN PANEL ASSEMBLIES FOR VIBRATORY SEPARATORS

BACKGROUND

1. Field of the Disclosure

The present subject matter is generally directed to screen panels that are used in vibratory separator equipment, and in particular, to systems and methods that may be used to fabricate screen panel assemblies for shale shakers and other vibratory separators.

2. Description of the Related Art

Vibratory separator equipment is commonly used in a wide variety of industrial applications to separate materials such as suspended solids from liquid, and to separate mixtures that may contain different types and/or sizes of solid particles. In the oil and gas drilling industry, vibratory separators, such as shale shakers and the like, are often used to treat drilling fluid, sometimes referred to as drilling mud, by separating undesirable solids, such as drill cuttings and the like, from the drilling fluid prior to reconditioning and/or recirculating the drilling fluid for further drilling operations.

In many applications, a screening apparatus, which may include one or more screen panel assemblies, is used to separate and remove the undesirable solids from the drilling fluid while leaving desirable solids—such as lost circulation materials and the like—in the drilling fluid. The screening apparatus if often mounted in and secured to basket or container, and during a typical vibratory separation operation, a vibratory apparatus may vibrate the basket, which thus imparts a vibrating motion to the screening material. In other cases, the vibratory apparatus may vibrate the screening apparatus directly. Normally, it is desirable to maximize the vibration of the screening apparatus while isolating any adjacent objects, equipment, and/or structures from the intense vibrations caused by the vibratory apparatus. Accordingly, the screen apparatus and/or screen panel assemblies must be robust enough to withstand the vibratory action of the separator, e.g., a shale shaker, during substantially continuous operations without experiencing mechanical breakdowns, permitting undesirable materials to bypass the screening apparatus, or permitting the desirable drilling fluid constituents to be lost and/or discarded during the material separation process.

FIG. 1 depicts a representative prior art shale shaker 100 that includes a basket 101, a screening apparatus 102 mounted in and secured to the basket 101, and a shaker support frame 103 for supporting the basket 101. The basket 101 has a plurality of mounting members 104 disposed on opposite sides thereof (two of which are shown in FIG. 1). The mounting members 104 are used to transfer the vibrational motion and loading on the basket 101 to corresponding mounting members 105 on the shaker support frame 103 by way of support springs 106, which serve to at least partially isolate the vibration of the shale shaker 100 from surrounding structures and equipment. As shown in FIG. 1, a vibratory apparatus 107 is mounted on the basket 101, and is adapted to impart a desired vibrational motion to the basket 101 and thus to the screen apparatus 102. The vibratory apparatus is driven by a motor 108. Additionally, the shale shaker 100 includes an elevator apparatus 109 mounted on a frame 110 for raising and lowering the end of the basket 101 so as to adjust the depth and size of the pool of drilling fluid (not shown in FIG. 1) present above the screening apparatus 102.

As noted above, the screening apparatus 102 may be made up of one or more screen panel assemblies, each of which may include a variety of components. FIG. 2 is an exploded view of one such representative prior art screen panel assembly 111, which includes three layers of screening material 112, 113, 114, e.g., wirecloth, that are positioned above a perforated plate 115, all of which are supported by a support frame 116. In typical screening applications, the various layers of screening material 112, 113, 114 are graded from the coarsest screening material (greatest wire spacing) on the bottom layer (i.e., layer 114) to the finest screening material (smallest wire spacing) on the top layer (i.e., layer 112). Furthermore, while three layers of screening material 112, 113, 114 are shown in FIG. 2, the total number of layers can be varied, depending on the specific application.

As shown in FIG. 2, a support frame 116 is positioned below and supports each of the layers of screening material 112, 113, 114. The support frame 116 includes an end support member **116*e* at each end of the frame 116, side support members 116*s* running between and connecting the two end support members 116*e*, and a plurality of cross members 116*c* running between the two side support members 116*s*. Additionally, the perforated plate 115 is positioned between the screening material 112, 113, 114 and the support frame 116. The perforated plate 115 includes a plurality of openings or perforations 115*p* that are distributed in a substantially uniform pattern across the entire surface of the perforated plate 115. In the particular panel 115 illustrated in FIG. 2, the perforations 115*p* have an elongated rectangular shape, although other shapes are sometimes used. The perforated plate 115 provides a substantially uniform and continuous support for the screening material layer 112, 113, 114, which may be particularly beneficial in those applications wherein the cross members 116*c*** may be spaced at too great a distance for the screening material to span without undue deflection and/or deformation.

During a screening operation, the screening apparatus 102, e.g., one or more screen panel assemblies 111, can be subjected to very high cyclic mechanical loads due to the vibrating nature of the separator. Many different assembly and fabrication techniques are employed in order to obtain screen panel assemblies 111 that are sufficiently robust so as to withstand the anticipated vibrational loadings. FIGS. 3A-3C schematically and simplistically illustrate one such prior art assembly method that has been used for fabricating screen panel assemblies.

FIG. 3A schematically depicts a side view of an early step in a prior art screen panel assembly/unitization process that is used to fabricate the screen panel assembly 111 from the various assembly components shown in FIG. 2. As shown in FIG. 3A, the support frame 116, the perforated plate 115, and the layers of screening material 112, 113, 114 are initially positioned between press plates 117 of a pressing apparatus 118. The support frame 116 has a nominal depth or thickness **116*d* (for example, approximately 0.9" to 1.0" inches for some screen assemblies) that is established as necessary so as to provide the requisite stiffness and structural strength of the screen panel assembly 111** for the anticipated operating loads of the vibratory separator in which it will be installed.

In order to securely attach each of the components together so as to form a unitized screen panel assembly 111, at least the top and bottom surfaces **115*t*, 115*b* of the perforated plate 115 and the top surface 116*t* of the support frame 116 are coated with an epoxy material 119. In some cases, the entirety of the perforated plate 115 and the entirety of the support frame 116 may be coated with epoxy 119, as indicated in FIG. 3A by dashed lines 119***a*. Furthermore, a sheet material 120, such as polytetrafluoroethylene (PTFE) and the like, may be positioned on the contact surface 117*s* of each of the press plates 117 so as to prevent the upper layer of screening material 112 and the bottom surface 116*b* of the support frame 116 from adhering to the press plates 117 during the screen panel unitization process.

Next, as is schematically illustrated in FIG. 3B, a heating apparatus 121 is operatively coupled to one or both of the press plates 117 so as to raise the temperature of the pressing apparatus 118. Generally, the pressing apparatus is preheated to an appropriate temperature level, such as approximately 400° F., so as to thermally cure the epoxy material 119 and bind together the stack of screen panel assembly components 112-116 during the unitization process. Once the pressing apparatus has been properly preheated to the requisite epoxy curing temperature, a pressing load 122, e.g., in the range of approximately 1000-2000 pounds, is imposed on the press plates 117 so as to keep the stack of screen panel assembly components 112-116 pressed firmly together and flat for the duration of the panel unitization process. The pressing load 122 is then maintained for a sufficient length of time, e.g., 10-20 minutes, so as to ensure proper curing of the epoxy material 119.

FIG. 3C schematically depicts the pressing apparatus 118 after completion of the above-described pressing and curing operations, i.e., after the epoxy 119 has been fully cured. As shown in FIG. 3C, the pressing load 122 and heat from the heating apparatus 121 have been discontinued, the press plates 117 have moved back, and the screen panel assembly 111 has been unitized. Typically, while only the bottom layer of screening material 114 is in direct contact with the epoxy material 119 on the top surface 115*t* of the perforated plate 115 during the initial phase of the pressing and curing operation, the epoxy 119 will tend to "migrate" or "flow" through the openings between the wires of each layer of screening material 114, 113, 112 throughout the curing operation. In this way, each layer of screening material 114, 113, 112 is bonded/attached to an adjacent component by the "migrating" epoxy material 119, thus unitizing the stack of screen panel assembly components 112-116 into the screen panel assembly 111.

As noted above, the nominal depth or thickness 116*d* of the support frame 116 is generally established based upon the required stiffness and strength of the finished screen panel assembly 111. However, in certain applications, the support frame thickness 116*d* may be established based upon other design considerations, such as the configuration of a specific shale shaker machine, the available space and clearance within the machine, and the like. Accordingly, it is sometimes necessary to reduce the nominal depth or thickness 116*d* of the support frame 116 so as to meet the design considerations dictated by the machine. Furthermore, in such cases a reduced nominal depth or thickness 116*d* can often lead to a commensurate overall reduction in the stiffness of the support frame 116 and the finished screen panel assembly 111. FIGS. 4A-4C schematically depict a prior art method that is substantially the same as the method illustrated in FIGS. 3A-3C above, wherein however the method is used for assembling a screen panel assembly 111*x* that utilizes a "low-profile" support frame 116*x* which has a reduced nominal depth or thickness 116*y* (for example, approximately 0.7" to 0.8" inches for some low-profile screen assemblies) that is less than the thickness 116*d* of the more typical support frame 116 that is used for the screen panel assembly 111 described above.

As shown in FIG. 4A, the various components 112, 113, 114, 115, 116*x* of the screen panel assembly 111*x* are arranged between the press plates 117 of the pressing assembly 118 in substantially similar fashion as previously described with respect to FIG. 3A above. Furthermore, the perforated plate 115 and the low-profile support frame 116*x* may be coated with the epoxy material 119, also as described above. Thereafter, the pressing apparatus 118 is heated by the heating apparatus 121 and a pressing load 122 is imposed on the press plates 117 so as to keep the stack of screen panel assembly components 112-116*x* firmly pressed together and flat, while the epoxy material 119 is cured, as shown in FIG. 4B.

FIG. 4C schematically depicts the pressing apparatus 118 after completion of the above-described pressing and curing operations, i.e., after the epoxy 119 has been fully cured and the screen panel assembly 111*x* has been unitized. However, unlike the unitized screen panel assembly 111 depicted in FIG. 3C above, FIG. 4C shows that the unitized screen panel assembly 111*x* has a bowed, i.e., curved or deformed, shape 123. The bowed shape 123 of the screen panel assembly 111*x* is caused by shrinkage of the epoxy material 119 that occurs during a normal epoxy heat curing operation, such as is depicted in FIG. 4*b*, and occurs at least in part due to the reduced nominal depth or thickness 116*y* and commensurate reduced stiffness of the low-profile support frame 116*x*, which thus has less resistance to the out-of-plane forces caused by the shrinking epoxy 119. In general, such epoxy shrinkage may cause the ends 111*e* of the screen panel assembly 111*x* to bow or curve upward relative to the side of the low-profile support frame 116*x* on which the layers of screening material 112-114 and the perforated plate 115 have been bonded by the epoxy material 119, i.e., toward the top surface 116*t*.

As shown in FIG. 4C, the ends 111*e* of the screen panel assembly 111*x* are bowed or curved upward relative to the center 111*c* of the panel 111*x* by a distance 124. Furthermore, and depending on the overall size of the screen panel assembly 111*x* and the actual stiffness of the low-profile support frame 116*x*, the magnitude of bowing 124 may be in the range of ⅛" to ¼", which may present both installation and operational difficulties for the bowed panel 111*x*. For example, if the screen panel assembly 111*x* is bowed or curved as shown in FIG. 4*c*, such bowing may prevent the proper installation of a panel 111*x* by creating alignment issues between adjacent panels 111*x*, or it may even completely prevent the panel 111*x* from being installed into a shale shaker, depending on the amount of clear space that is available for panel 111*x*. Additionally, even if a bowed or curved screen panel assembly 111*x* can be installed, the degree of panel curvature may prevent the proper seating and functioning of any sealing mechanisms that surround such screen panel assemblies, thus possible permitting drilling fluid and/or undesirable solids materials to bypass the panel 111*x* during shale shaker operation. Accordingly, such bowed or curved screen panel assemblies 111*x* are generally mechanically straightened to within such flatness tolerances as would facilitate the proper installation and operation of the panel 111*x* in a given shale shaker.

FIGS. 4D-4F schematically and simplistically depict a typical prior art method that is used in an attempt to mechanically straighten a screen panel assembly 111*x* having a bowed or curved shape 123. As shown in FIG. 4D, the bowed screen panel assembly 111*x* is supported 126 at points near the opposing ends 111*e* of the panel 111*x*, and a deforming load 125 is imposed at or near the center 111*c* of the panel 111*x* from the opposite side from the supports 126. As shown in FIG. 4E, the deforming load 125 is used to deflect the screen panel assembly 111*x* from the bowed shape 123 (shown in hidden lines in FIG. 4E) to a deflected shape 123*d*, thus bowing or curving the panel 111*x* in the opposite direction. Furthermore, the magnitude of the deforming load 125 must be large enough to deflect the screen panel assembly 111*x* by a distance 124*d* that is great enough to induce a sufficient amount of plastic deformation in the low-profile support frame 116*x* so that, when the deforming load 125 is eventually released, the panel 111*x* comes back to a substantially flat and straight configuration, as is depicted in FIG. 4F.

Depending on the actual stiffness of the bowed screen panel assembly 111*x* shown in FIGS. 4C and 4D, the distance 124*d* by which the panel 111*x* must be deflected in order to induce the requisite amount of plastic deformation necessary to flatten/straighten the panel 111*x* to the configuration shown in FIG. 4F may be 2-3 times greater, or even more, than the amount of curvature 124 that was induced in the panel 111*x* during the pressing and epoxy curing operation shown in FIG. 4B. In other words, while the amount 124 by which the screen panel assembly 111*x* is bowed may be on the order of ⅛" to ¼", the amount of deflection 124*d* that is induced in the panel 111*x* by the deforming load 125 so as to sufficiently deform the panel 111*x* may be in the range of ½" to ¾" or more.

In view of the magnitudes of the loads and deformations that can be required to straighten the bowed screen panel assembly 111*x*, damage other than the plastic deformation of the low-profile support frame 116*x* may occur to the panel 111*x* during a mechanical straightening operation. For example, depending the how the screen panel assembly 111*x* is supported during the straightening operation, the screening material layers 112, 113, 114 may be mechanically damaged in the area of support points 126 as the deforming load 125 is being imposed on the low-profile support frame 116*x*. Furthermore, considering the amount of deflection 124*d* between the bowed shape 123 and the defected shape 123*d* that is required to straighten the screen panel assembly 111*x*, the cured epoxy material 119 will often crack, thus causing the various components of the screen panel assembly stack 112-116*x* to disbond and/or separate during the straightening operation, due to the relatively low resilience of the epoxy material 119. In such cases, the entire screen panel assembly may be scrapped, or the disbonding and/or component separation problems may not manifest until the panel 111*x* is put into service, thus potentially limiting the overall operating life of the panel 111*x*, or reducing the efficiency of the shale shaker in which the panel 111*x* is installed.

The following disclosure is directed to systems and methods that may be used during fabrication of a screen panel assembly so as to address, or at least mitigate, at least some of the problems outlined above.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

Generally, the subject matter disclosed herein relates to systems and methods that may be used to eliminate, or at least substantially reduce, the amount of mechanical straightening that is needed for screen panel assemblies having low-profile support frames. To that end, a jig assembly is disclosed herein that may be used to hold the various components of a low-profile screen panel support frame during most phases of frame fabrication. Furthermore, a controlled welding operation is disclosed that induces an initial pre-curvature in the low-profile support frame that counterbalances, or at least offsets to some degree, any subsequent curvature that is induced in the frame during the screen panel assembly unitization operation, i.e., during a pressing and epoxy curing operation.

One illustrative embodiment disclosed herein is a method that includes, among other things, fabricating a screen panel support frame having a curved non-planar shape, wherein the curved non-planar shape has a first amount of post-fabrication curvature. The disclosed method further includes performing a screen panel unitization process to unitize the screen panel support frame having the first post-fabrication amount of curvature with at least a plurality of layers of screening material, the screen panel unitization process reducing the curvature of the screen panel support frame from the first post-fabrication amount of curvature to a second post-unitization amount of curvature that is less than the first post-fabrication amount.

In another exemplary embodiment, a method of fabricating a screen panel assembly is disclosed that includes positioning a plurality of support members in a jig assembly, the positioning including aligning each of the plurality of support members between a plurality of respective pairs of alignment pins, each of the alignment pins being mounted to a base plate of the jig assembly. The method further includes, among other things, clamping the plurality of support members to the base plate, and performing a welding operation to weld together the support members while the support members are clamped to the base plate, the welded together support members comprising a support frame and the welding operation inducing a first post-fabrication amount of curvature in the support frame, wherein each weld performed during the welding operation is performed from the same side of the support frame.

In yet a further disclosed embodiment, a system includes a plurality of support members for a support frame of a screen panel assembly and a jig assembly that includes a base plate, a plurality of support member alignment pins mounted on the base plate, and a plurality of clamp assemblies attached to the base plate. Furthermore, the plurality of support member alignment pins are positioned on the base plate so as to align each of the plurality of support members, and the plurality of clamp assemblies are adapted to clamp each of the aligned support members to the base plate during a welding operation that is adapted to induce a first post-fabrication amount of curvature in the support frame during the welding thereof. Additionally, the disclosed system includes a pressing apparatus comprising first and second press plates and a heat source operatively coupled to at least one of the first and second press plates, wherein the pressing apparatus is adapted to press together and heat at least a plurality of screening material layers, a perforated plate, and the support frame having the first post-fabrication amount of curvature during a screen panel unitization process, the screen panel unitization process being adapted to reduce the curvature of the support frame from the first post-fabrication amount of curvature to a second post-unitization amount of curvature that is less than the first post-fabrication amount.

BRIEF DESCRIPTION OF THE DRAWINGS

The disclosure may be understood by reference to the following description taken in conjunction with the accompanying drawings, in which like reference numerals identify like elements, and in which.

Figure 1:
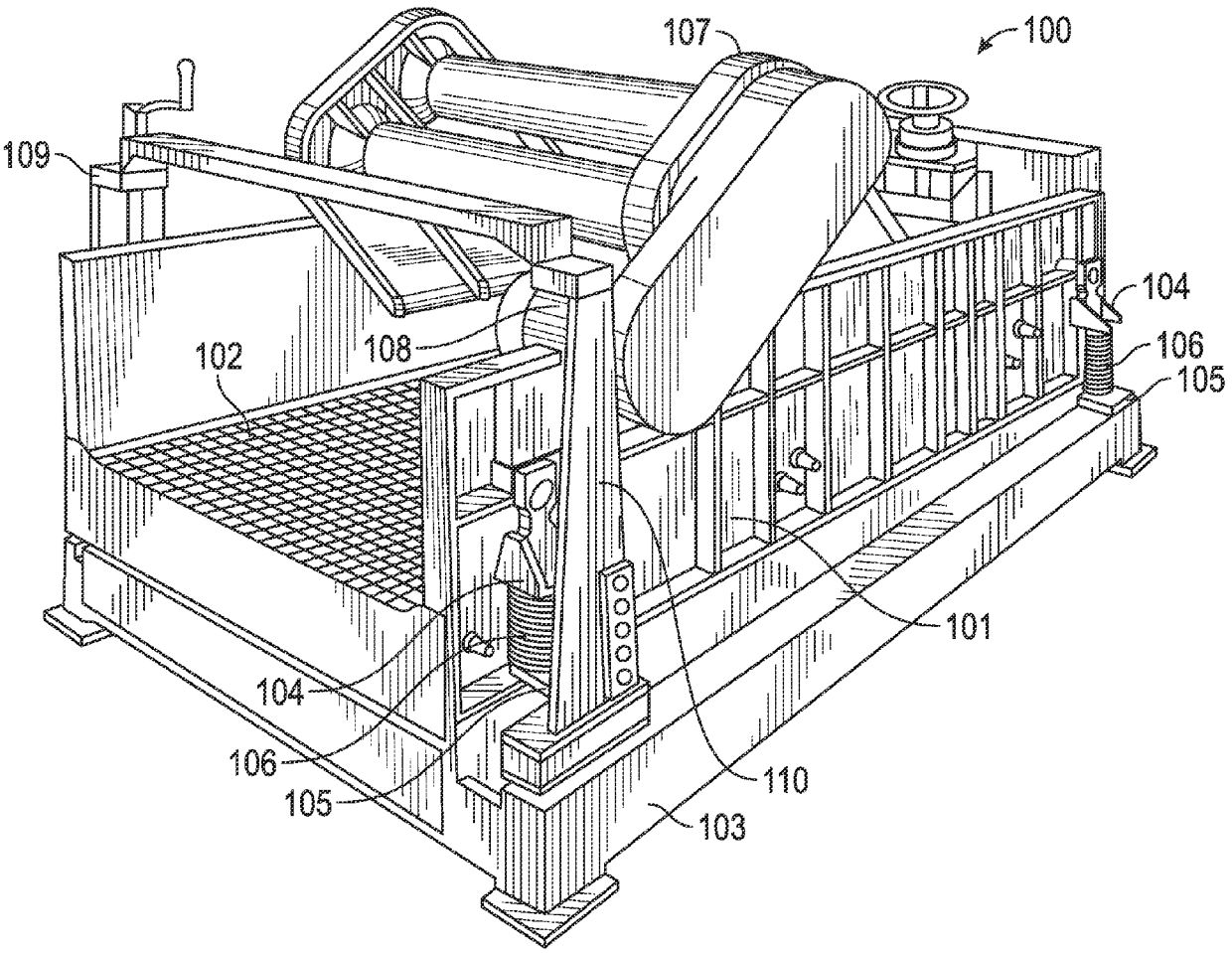
FIG. 1 (Prior Art)
FIG. 1 is a perspective view of an illustrative prior art shale shaker.
Figure 2:
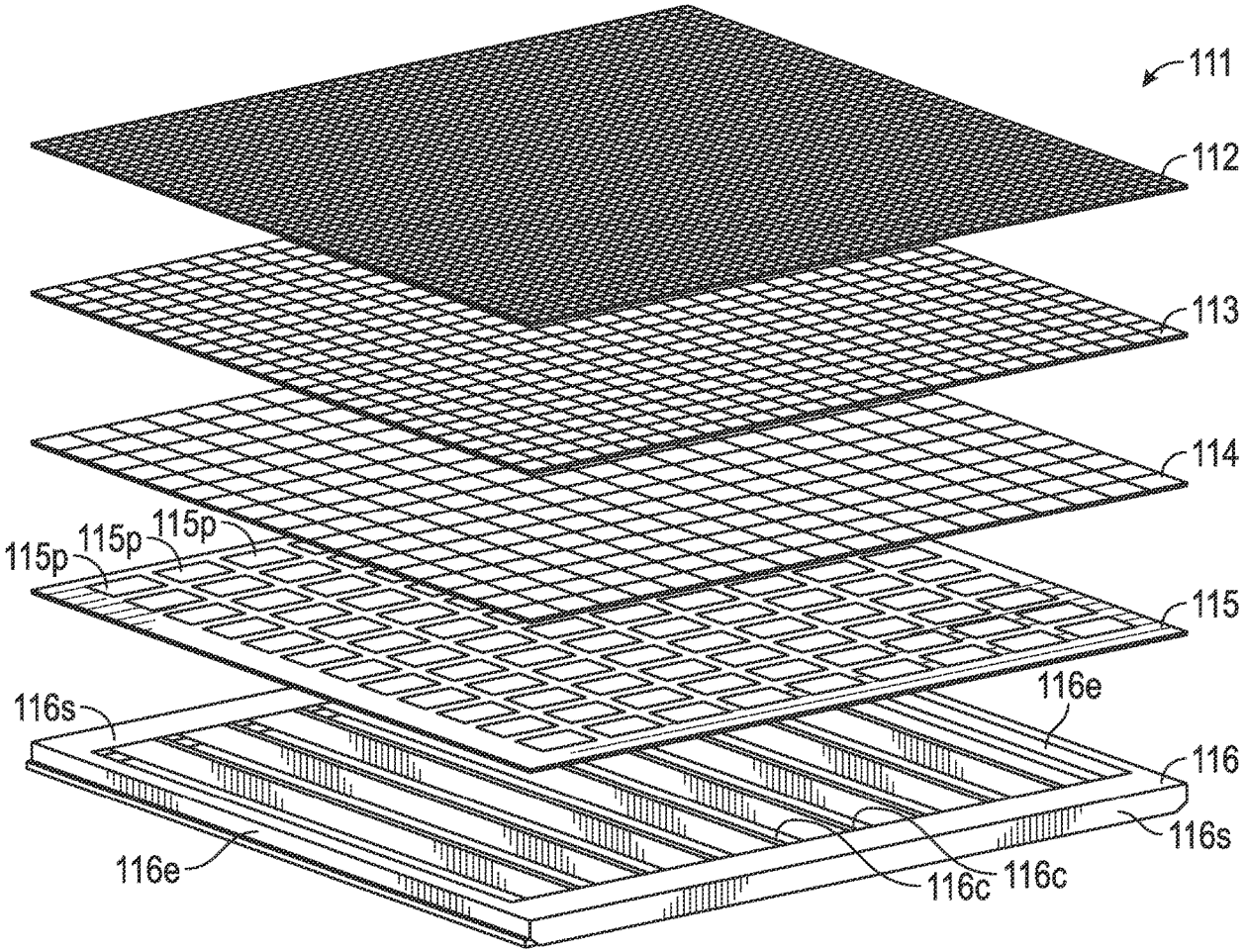
FIG. 2 (Prior Art)
FIG. 2 is an exploded perspective view of an exemplary prior art screen panel assembly.
Figure 3A:
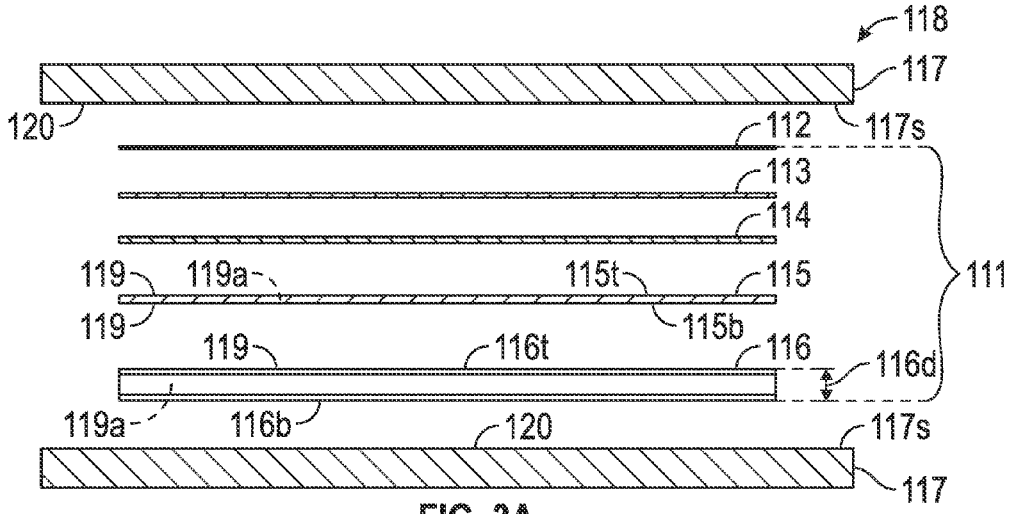
FIG. 3A (Prior Art)
FIGS. 3A-3C schematically depict various steps in a prior art screen panel unitization process that is used to assemble the various components of the prior art screen panel assembly shown in FIG. 2.
Figure 3B:
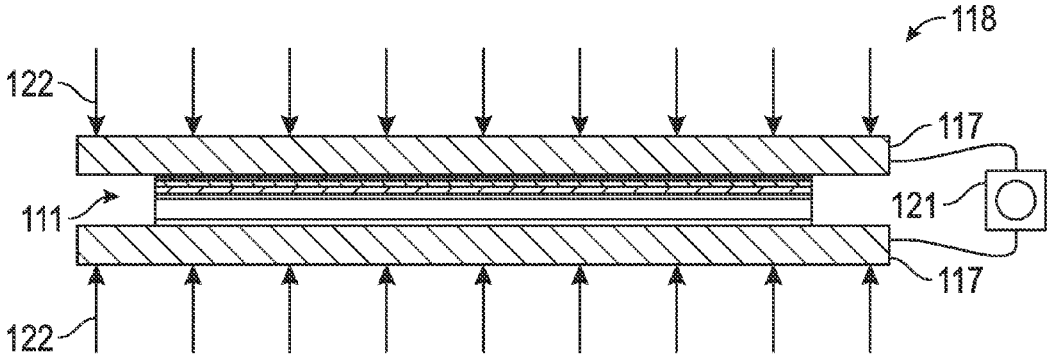
FIG. 3B (Prior Art)
Figure 3C:
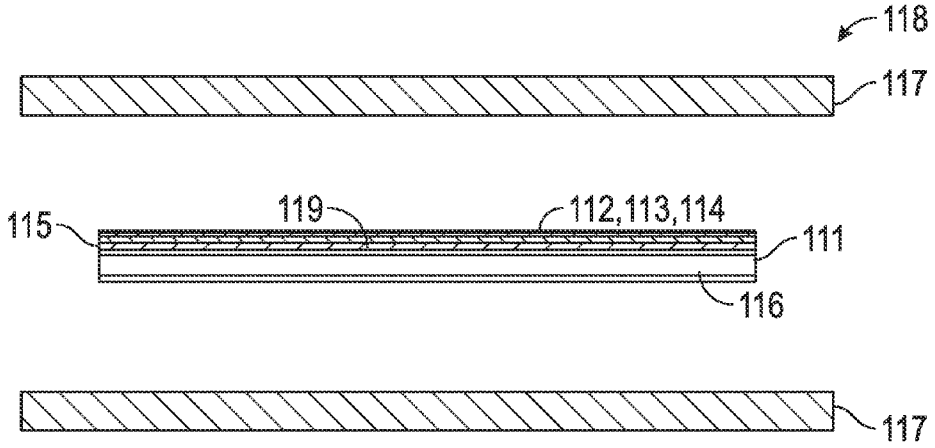
FIG. 3C (Prior Art)
Figure 4A:
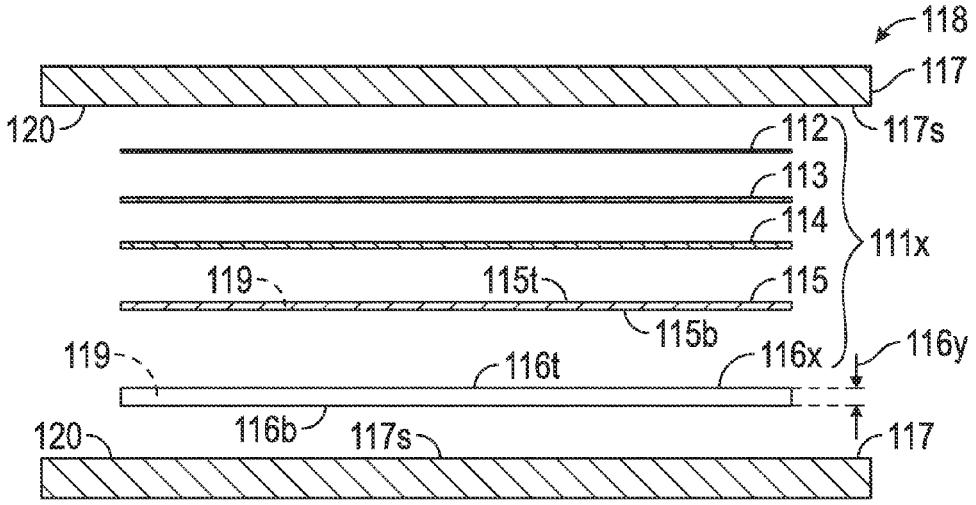
FIG. 4A (Prior Art)
FIGS. 4A-4C schematically depict various steps in a prior art screen panel unitization process that is used to assemble the various components of an illustrative prior art low-profile screen panel assembly that is configured similar to the screen panel assembly of FIG. 2.
Figure 4B:
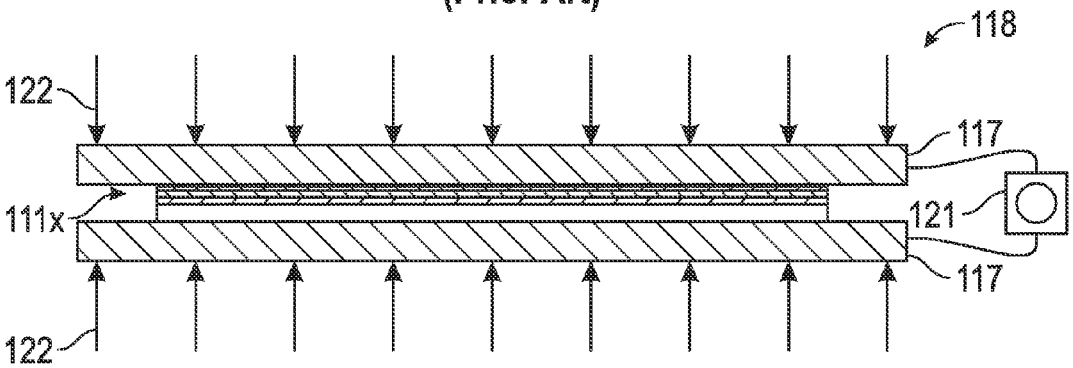
FIG. 4B (Prior Art)
Figure 4C:
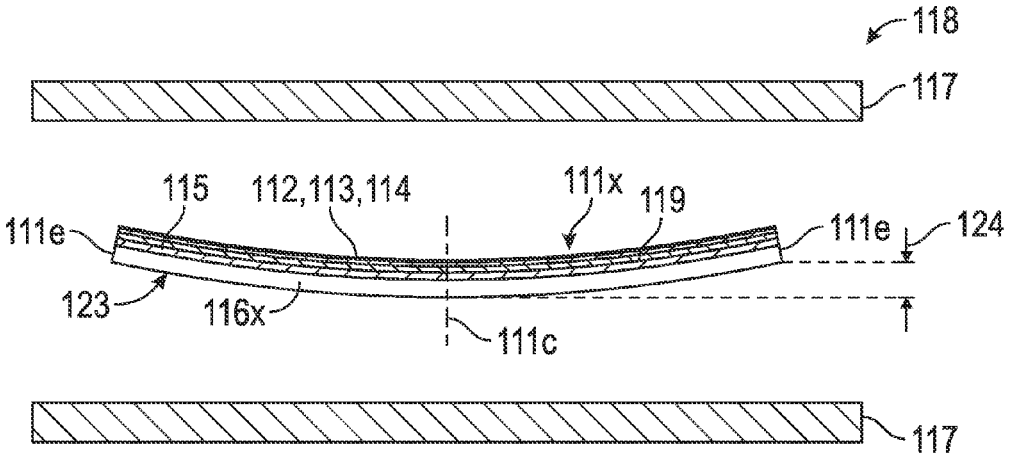
FIG. 4C (Prior Art)
Figure 4D:
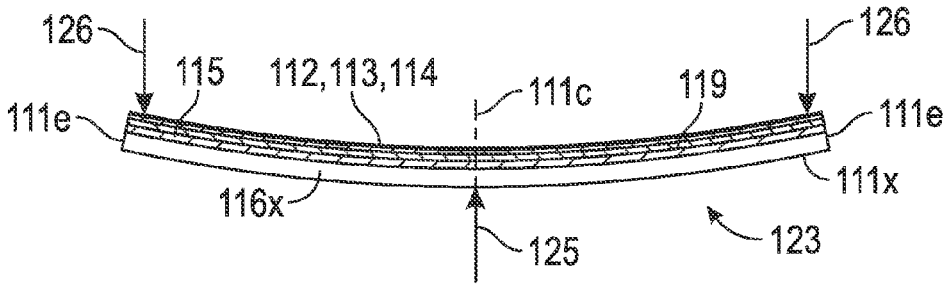
FIG. 4D (Prior Art)
FIGS. 4D-4F schematically depict various steps in a prior art method that is used to mechanically straighten the assembled prior art low-profile screen panel assembly of FIGS. 4A-4C.
Figure 4E:
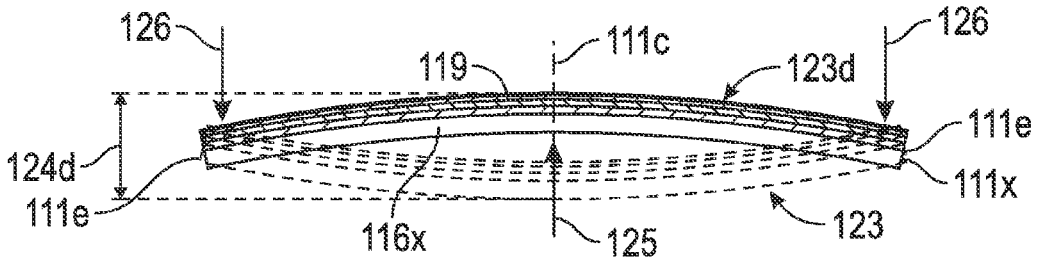
FIG. 4E (Prior Art)
Figure 4F:
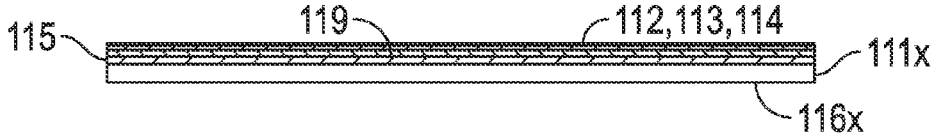
FIG. 4F (Prior Art)

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Generally, the subject matter disclosed herein relates to systems and methods that may be used to fabricate screen panel assemblies for vibratory separators, such as shale shakers and the like. In particular, the systems and methods disclosed herein may be used to fabricate screen panel assemblies without having to perform a mechanical straightening operation on the panel assemblies after a panel unitization process has been performed, or to at least minimize the amount of mechanical straightening that may be necessary to produce panel assemblies within specified straightness and flatness tolerances. To that end, the inventors have developed and disclosed herein a unique jig assembly that may be used to clamp and hold the various structural components of a screen panel assembly support frame in place during frame fabrication.

In general, the disclosed jig assembly is adapted to hold the various components of the support frame firmly in place during assembly and fabrication. The jig assembly includes, among other things, a plurality of alignment pins that are positioned on a jig plate, or base plate, in such a way as to facilitate the alignment and assembly of the various support frame components in a concise and repeatable fashion. The jig assembly also includes a plurality of clamp assemblies that hold the structural components in place once they have been assembled and arranged for fabrication.

The alignment pins and clamp assemblies may provide several benefits during support frame fabrication. First, the alignment pins may substantially prevent the support frame from expanding under the heat input that the frame experiences during the controlled welding operations that are performed to welding together each of the various components of the frame. Furthermore, once the controlled welding operations have been completed, the alignment pins may also substantially prevent the support frame form contracting as the frame cools down. Throughout the entire support frame fabrication process, that is, throughout both the heat-up (welding) and cool-down (post welding) phases of the fabrication process, the clamp assemblies may substantially hold all of the components firmly against the base plate of the jig assembly. In this way, support frame shape and dimension stability may be closely controlled.

Additionally, in certain illustrative embodiments, the support frame is fabricated while it is positioned in the jig assembly by performing substantially all of the welding operations from a single side of the support frame, and more specifically, from the bottom side of the frame. Accordingly, the various components of the support frame are therefore assembled in the jig assembly upside down, or face down, so that the bottom side of the support frame is facing upward in the jig assembly and exposed for welding operations. In this way, an initial amount of "pre-curvature" may be induced in the support frame as it is being fabricated, such that the frame bows or curves downward at the outside edges, i.e., opposite of the direction that a support frame, such as the prior art low-profile support frame 111*x*, may curve during screen panel unitization. This opposite, or reverse, support frame pre-curvature may then act to substantially counterbalance, or at least offset to some degree, the type of curvature that may be induced during a subsequently performed screen panel assembly unitization operation, as is illustrated with respect to the exemplary prior art low-profile support frame 111*x* shown in FIGS. 4A-4F and described above.

In certain illustrative embodiments of the present disclosure, the amount of reverse support frame pre-curvature may be adjusted by manipulating one or more of the welding parameters that are used to fabricate the support frame, including the number of welds, the specific sequence in which the weld are performed, and the type of welding processes and/or the amount of heat input during each weld. Furthermore, it should be appreciated by those of ordinary skill in the art after a full reading of the present disclosure that the systems and methods disclosed herein may be used to fabricate substantially any type of screen panel assembly support frames, including the more flexible low-profile support frames such as the prior art frame 111*x* illustrated and described herein, as well as stiffer support frames having a greater frame depth or thickness that do not always experience the same degree of panel bowing or curving during the screen panel assembly unitization process.

Figure 5A:
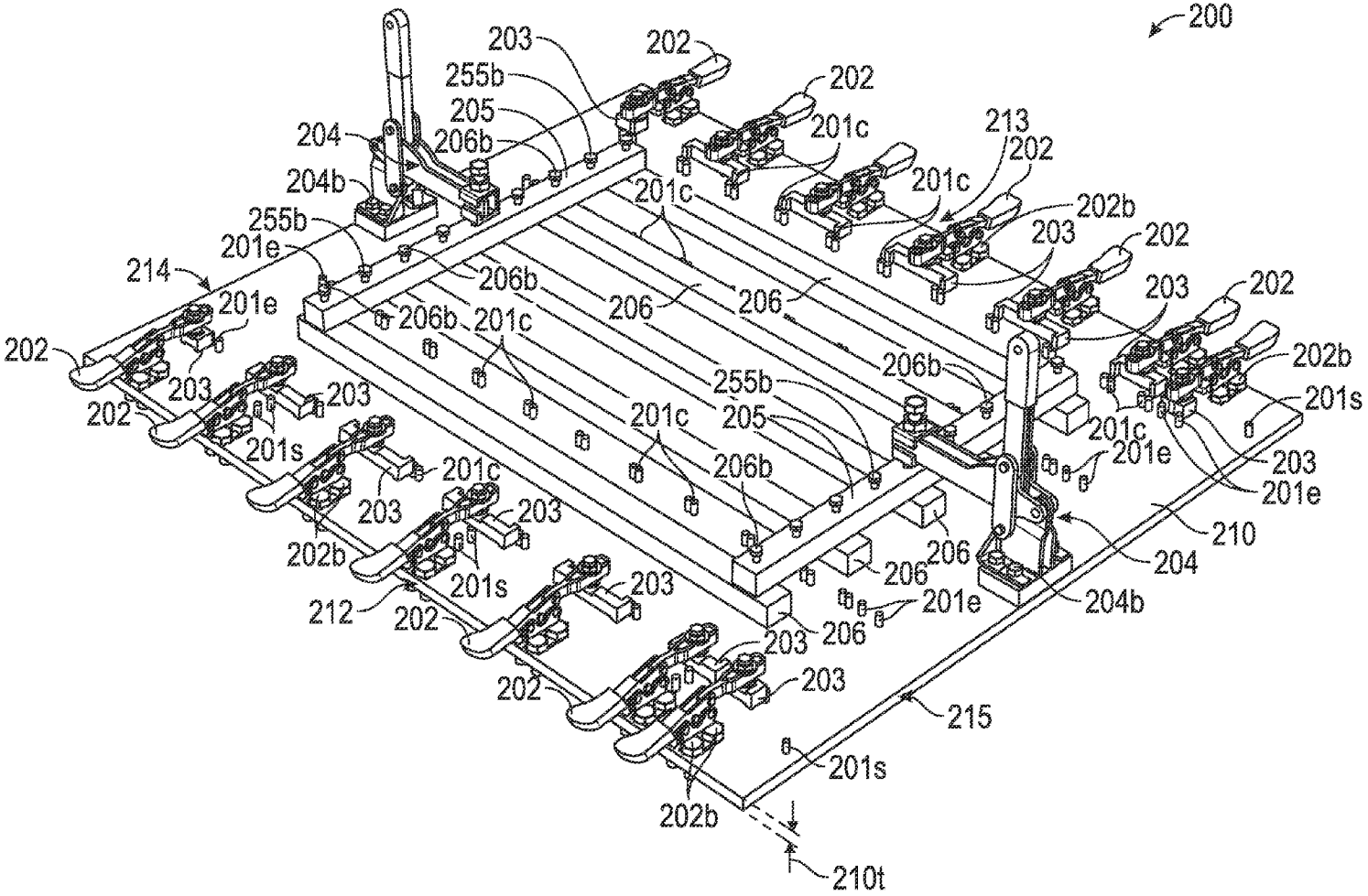
FIGS. 5A and 5B are perspective and plan views, respectively, of an illustrative jig assembly of the present disclosure.
Figure 5B:
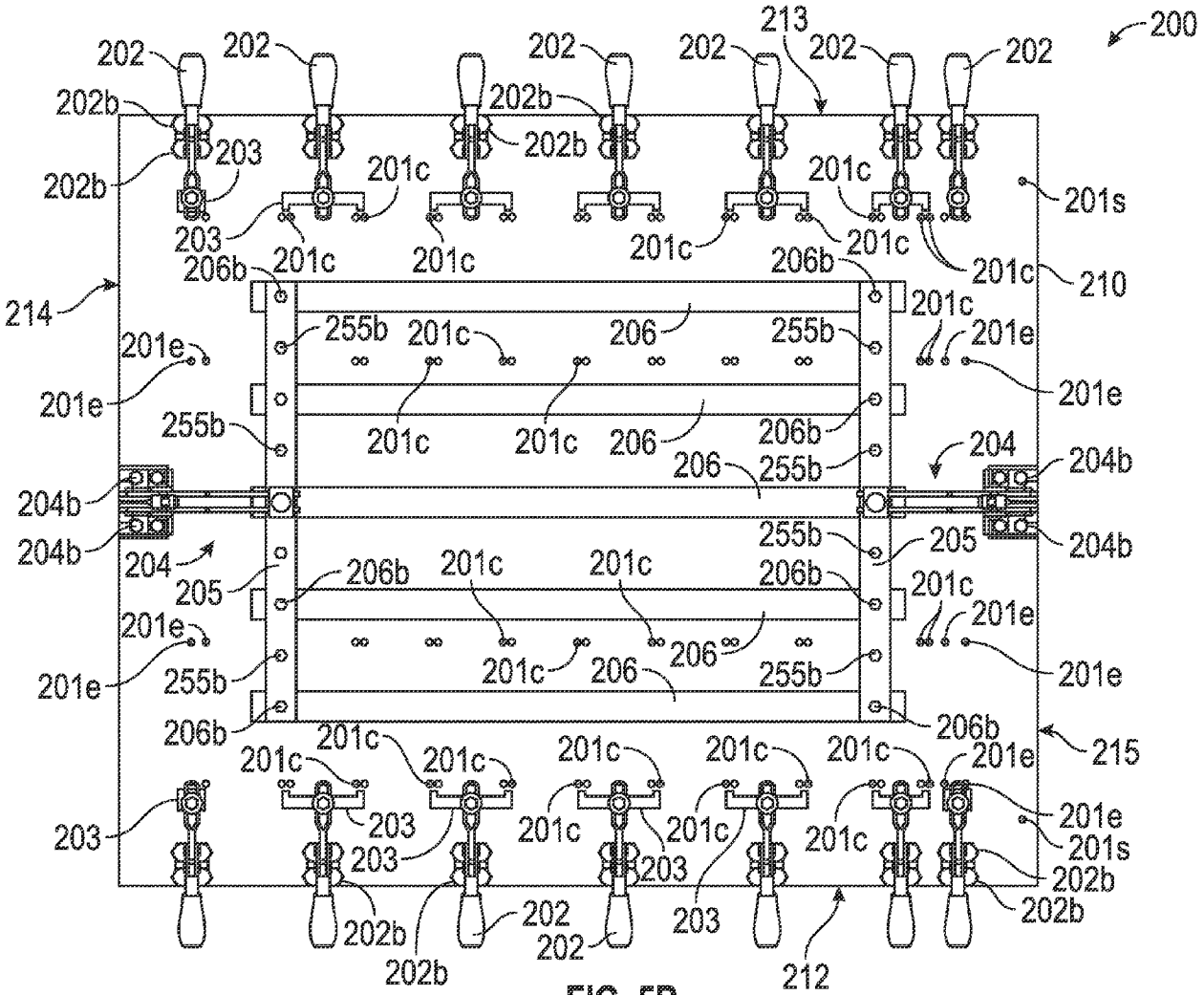

FIGS. 5A and 5B are perspective and plan views, respectively, of one illustrative jig assembly 200 that may be used to fabricate support frames for screen panel assemblies, including low-profile screen panel assembly support frames and the like, in conjunction with the systems and methods of the present disclosure. The jig assembly 200 includes a base plate 210 that may be fabricated from any appropriate material, such steel, stainless steel, aluminum, and the like. The base plate 210 may have a thickness 210*t* in the range of about ½" to 1", depending on the required overall jig assembly stiffness. Additionally, a plurality of support member alignment pins may be mounted to the base plate 210, including side support member alignment pins 201*s*, end support member alignment pins 201*e*, and cross member alignment pins 201*c*, which may in some instances may be referred to herein collectively as alignment pins 201. The alignment pins 201 may be mounted and secured to the base plate 210 in any suitable fashion so that the pins 201 remain in their relative positions during the various steps of assembling and fabricating a screen panel assembly support frame, such as the support frame 250 shown in FIGS. 5C and 5D. For example, in certain embodiments, each of the alignment pins 201 may be cylindrically shaped dowel pins fabricated from round bar stock, e.g., ¼" diameter round bar stock and the like, that is cut to a required length and fitted, e.g., press fit, into blind holes that are drilling into the upper surface of the base plate 210. In other embodiments, the alignment pins 201 may be fabricated from partially or fully threaded rods, e.g., with ¼" diameter 20-pitch UN threads and the like, that may be screwed into tapped/threaded holes in the base plate 210. Other suitable means for mounting and securing the alignment pins 201 to the base plate 210 may also be used.

As shown in FIGS. 5A and 5B, the jig assembly 200 may include a plurality of side clamp assemblies 202 positioned along each opposing side 212, 213 of the base plate 210. Each of the side clamp assemblies 202 may include a respective clamping bar 203, which may be used to fixedly hold at least some components of a screen panel support frame, e.g., the support frame 250, in place during frame fabrication as will be described in further detail below. Additionally, the side clamp assemblies 202 may be removably attached to the base plate 210 with a plurality of fasteners 202*b*, e.g., threaded fasteners such as headed bolts and nuts, and the like. The jig assembly 200 may also include end clamp assemblies 204 positioned at opposing ends 214, 215 of the base plate 210. Furthermore, while one end clamp assembly 204 is shown at each end 214, 215, it should be appreciated that two or more end clamp assemblies may be used at each end 214, 215, depending on various factors such as the size of the support frame being fabricated, the frame hold-down requirements, etc.

As with the side clamp assemblies 202, each end clamp assembly 204 may be removably attached to the base plate 210 by a plurality of fasteners 204*b*, e.g., threaded bolts and the like. In certain embodiments, each end clamp assembly 204 may include a respectively clamping bar 205. As shown in FIGS. 5A and 5B, the jig assembly 200 may also include a plurality of hold-down bars 206 that may be held in place at each end thereof by a respective clamping bar 205. The hold-down bars 206 and/or the clamping bars 205 may in turn be used to securely clamp in place at least some components of a screen panel support frame during fabrication, as will be described further below.

Figure 5C:
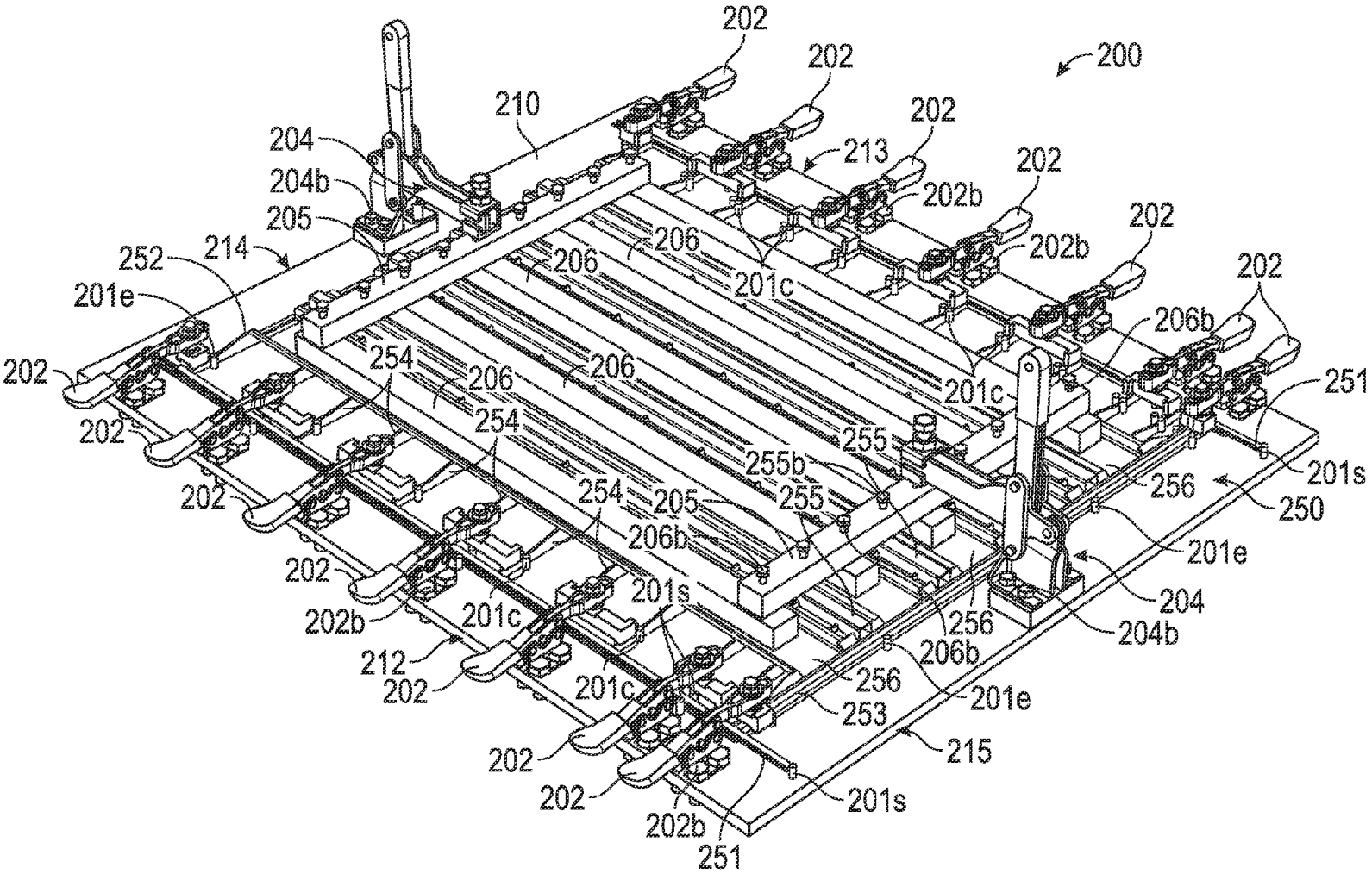
FIGS. 5C and 5D are perspective and plan views, respectively, of the illustrative jig assembly of FIGS. 5A and 5B with various components of an exemplary screen panel assembly support frame mounted therein.
Figure 5D:
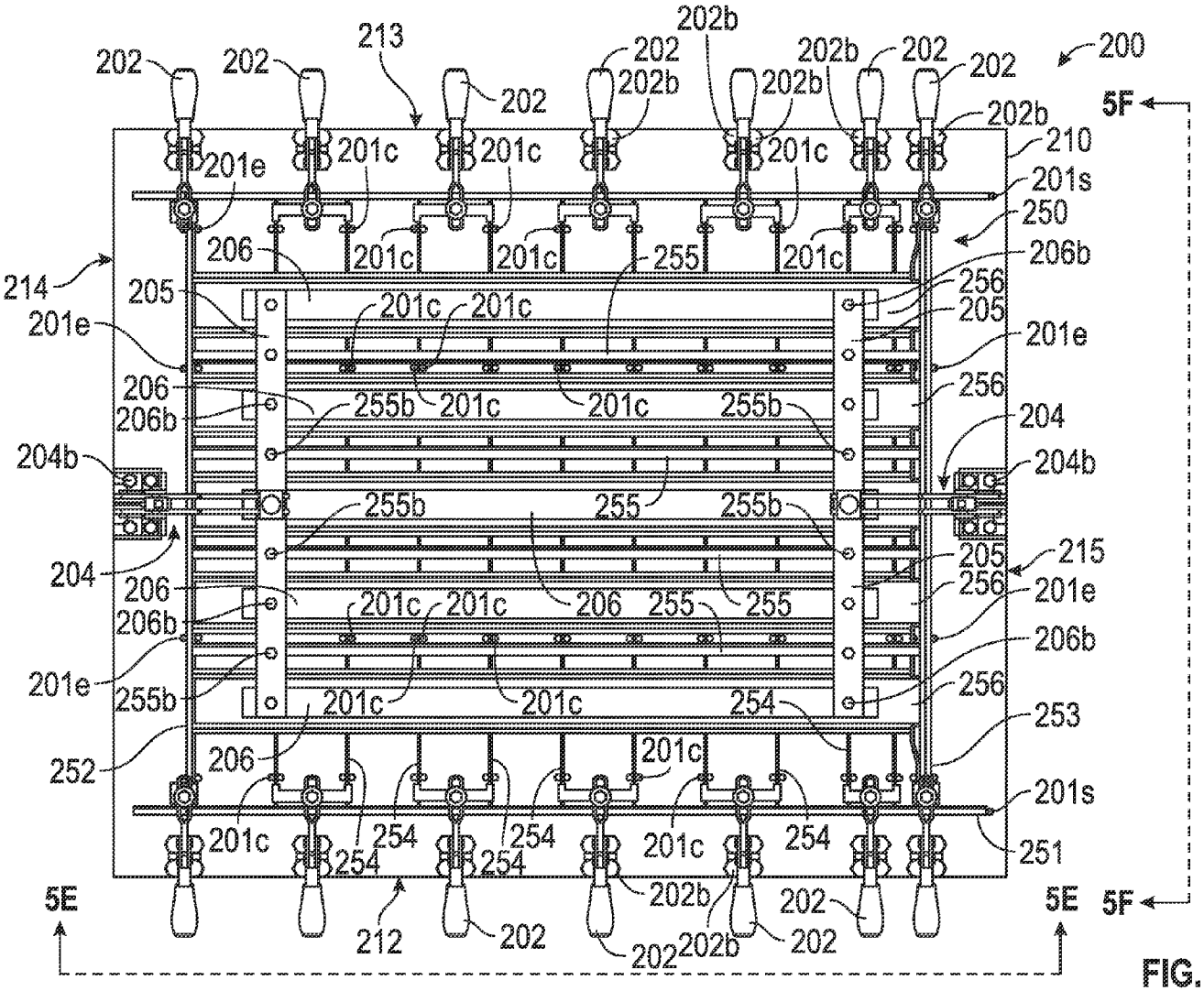
Figure 5E:
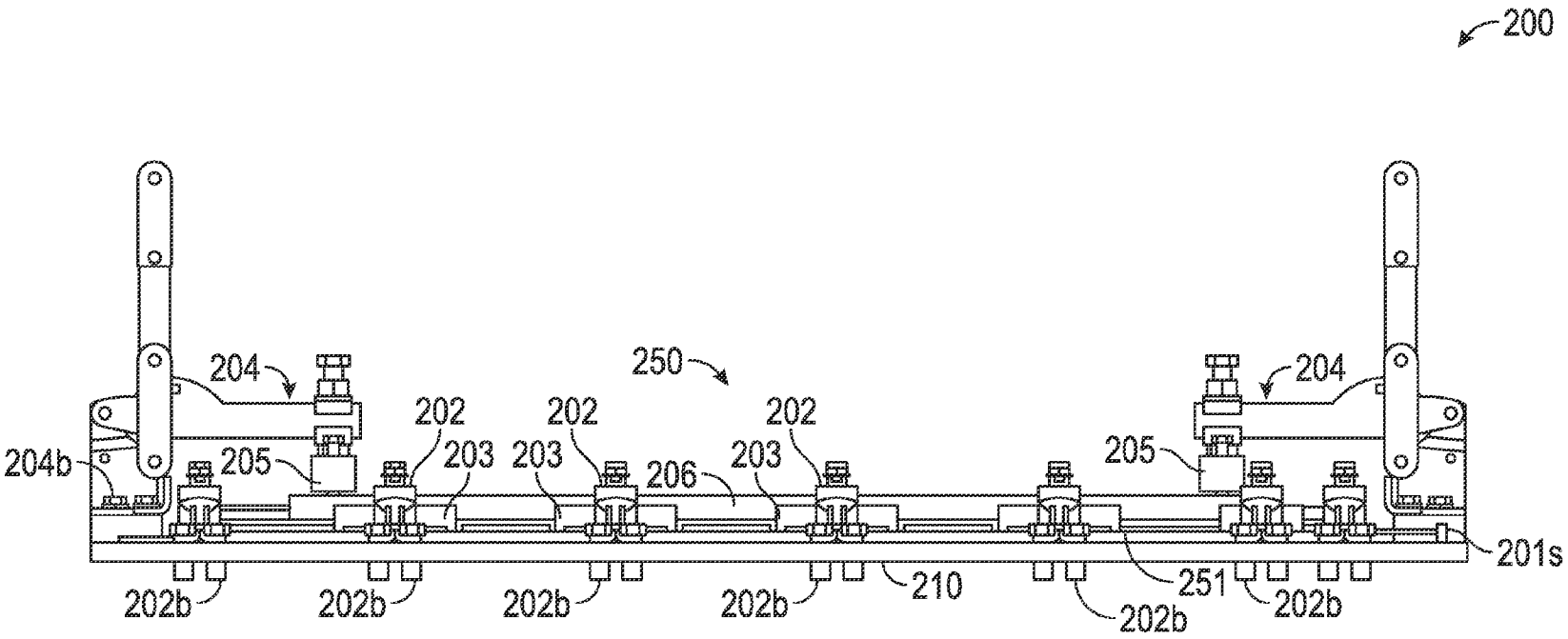
FIGS. 5E and 5F are side and end views, respectively, along the view lines "5E-5E" and "5F-5F" of FIG. 5D, respectively.
Figure 5F:
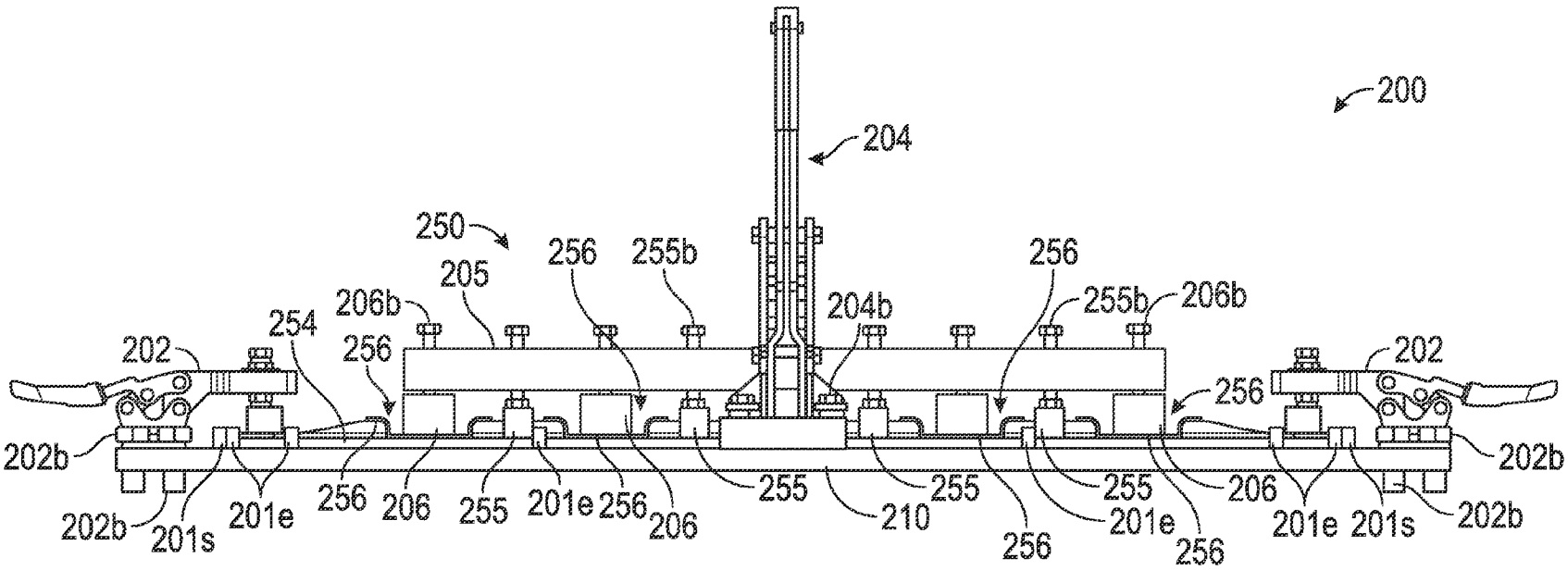

FIGS. 5C and 5D are perspective and plan views, respectively, of the illustrative jig assembly 200 of FIGS. 5A and 5B after various components of an exemplary support frame 250 have been mounted therein during a screen panel assembly and fabrication process, and FIGS. 5E and 5F are side and end views, respectively, along the view lines "5E-5E" and "5F-5F" of FIG. 5D, respectively. As shown in FIGS. 5C and 5D, the illustrative support frame 250 includes side support members 251, end support members 252 and 253, and cross members 254, each of which may be clamped in place by one or more of the side clamping assemblies 202. Additionally, as will be described in further detail below, the side support members 251 are aligned with and positioned between pairs of the alignment pins 201*s*, the end support members 252, 253 are aligned with and positioned between pairs of the alignment pins 201*e*, and the cross members 254 are aligned with and positioned between pairs of the alignment pins 201*c*.

The support frame 250 also includes guide plates 256, which may be used to guide a finished screen panel assembly, such as the screen panel assembly 270 shown in FIGS. 10A-10D, along respective support members (not shown) as the screen panel assembly 270 is being installed into a vibratory separator, such as a shale shaker and the like. In come embodiments, the hold-down bars 206 of the jig assembly 200 may be used to clamp/hold a respective guide plate 256 in place during assembly and fabrication of the support frame 250. See, end view FIG. 5F. For example, each of the clamping bars 205 may include a plurality of hold-down bar adjustment bolts 206*b* threaded into respective tapped/threaded holes in the clamping bars 205. The hold-down bar adjustment bolts 206*b* may be used to individually adjust the clamping/hold-down force on the ends of each hold-down bar 206, and consequently on each guide plate 256. In some embodiments, the support frame 250 may also include a plurality of longitudinal support member 255 positioned between respective guide plates 256 and running along substantially the full length of the support frame 250. Furthermore, as with the hold-down bar adjustment bolts 206*b*, longitudinal support hold-down adjustment bolts 255*b* may also be threaded through each of the clamping bars 250 so as to provide a degree of adjustability to the clamping/hold-down force on the ends of each of the longitudinal support members 255.

Figure 5G:
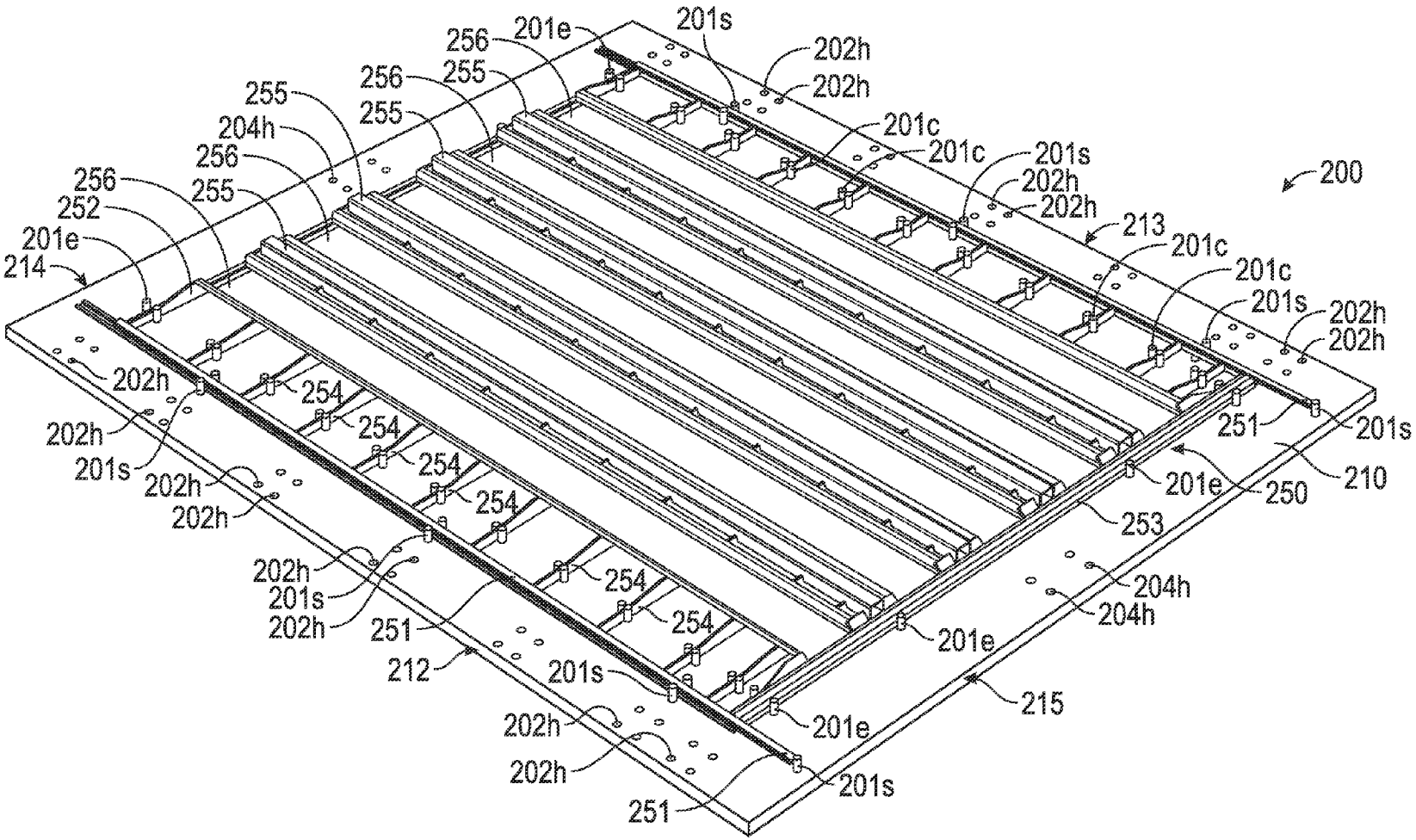
FIGS. 5G and 5H are perspective and plan views, respectively, of the illustrative jig assembly and support frame components shown in FIGS. 5C and 5D, wherein the various jig assembly clamping devices have been removed for clarity.
Figure 5H:
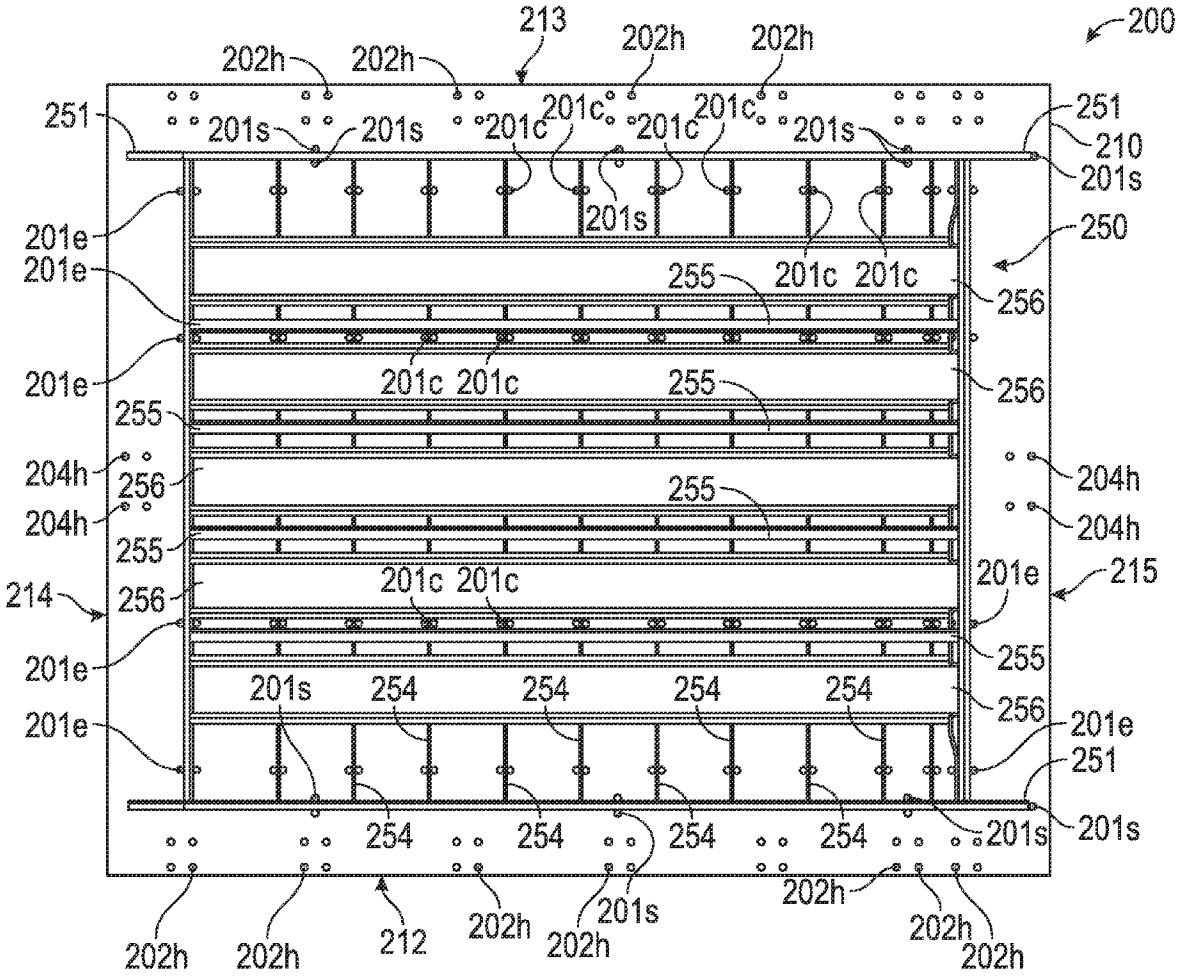

FIGS. 5G and 5H are perspective and plan views, respectively, of the jig assembly 200 and the various components of the support frame 250 shown in FIGS. 5C and 5D, wherein the various jig assembly clamping devices shown in FIGS. 5A and 5B have been removed for clarity. As shown in FIGS. 5G and 5H, the base plate 210 of the jig assembly 200 has a plurality of holes 202*h* that may be used to removably attach each of the side clamp assemblies 202 to the base plate 210 using the fasteners 202*b* and a plurality of holes 204*h* for attaching the end clamp assemblies 204 to the base plate 210 with the fasteners 204*b*. See, FIGS. 5A-5F. In certain embodiments, the holes 202*h* and/or 204*h* may be through-holes (in which case nuts would be required when attaching the clamp assemblies 202 and/or 204 to the base plate 210) or one or both of the holes 202*h*/204*h* may be tapped/threaded, in which case the fasteners 202*b*/204*b* may be screwed directly into the base plate 210.

Figure 6A:
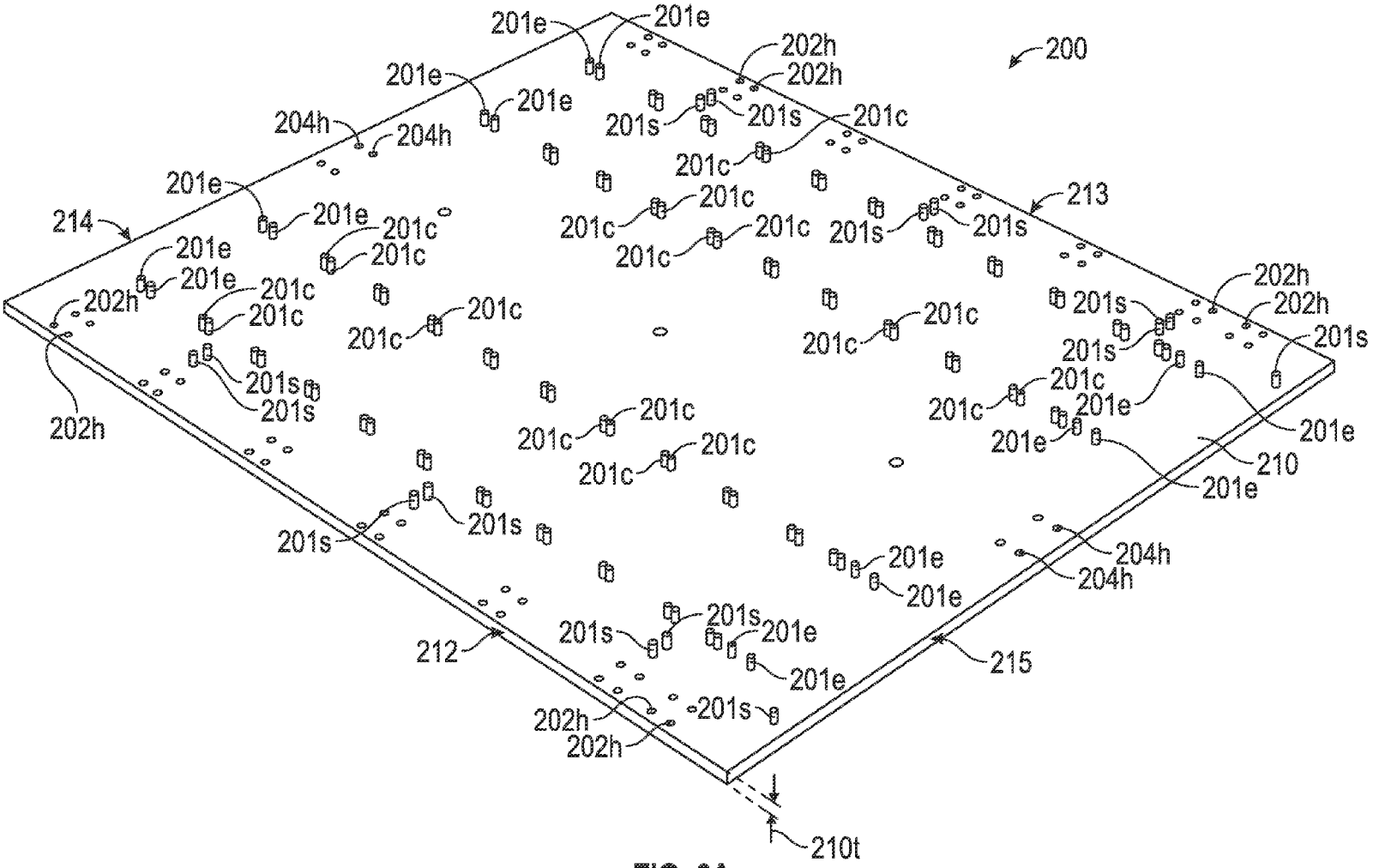
FIGS. 6A and 6B are perspective and plan views, respectively, of the jig assembly base plate of FIGS. 5A and 5B with alignment pins mounted thereon.
Figure 6B:
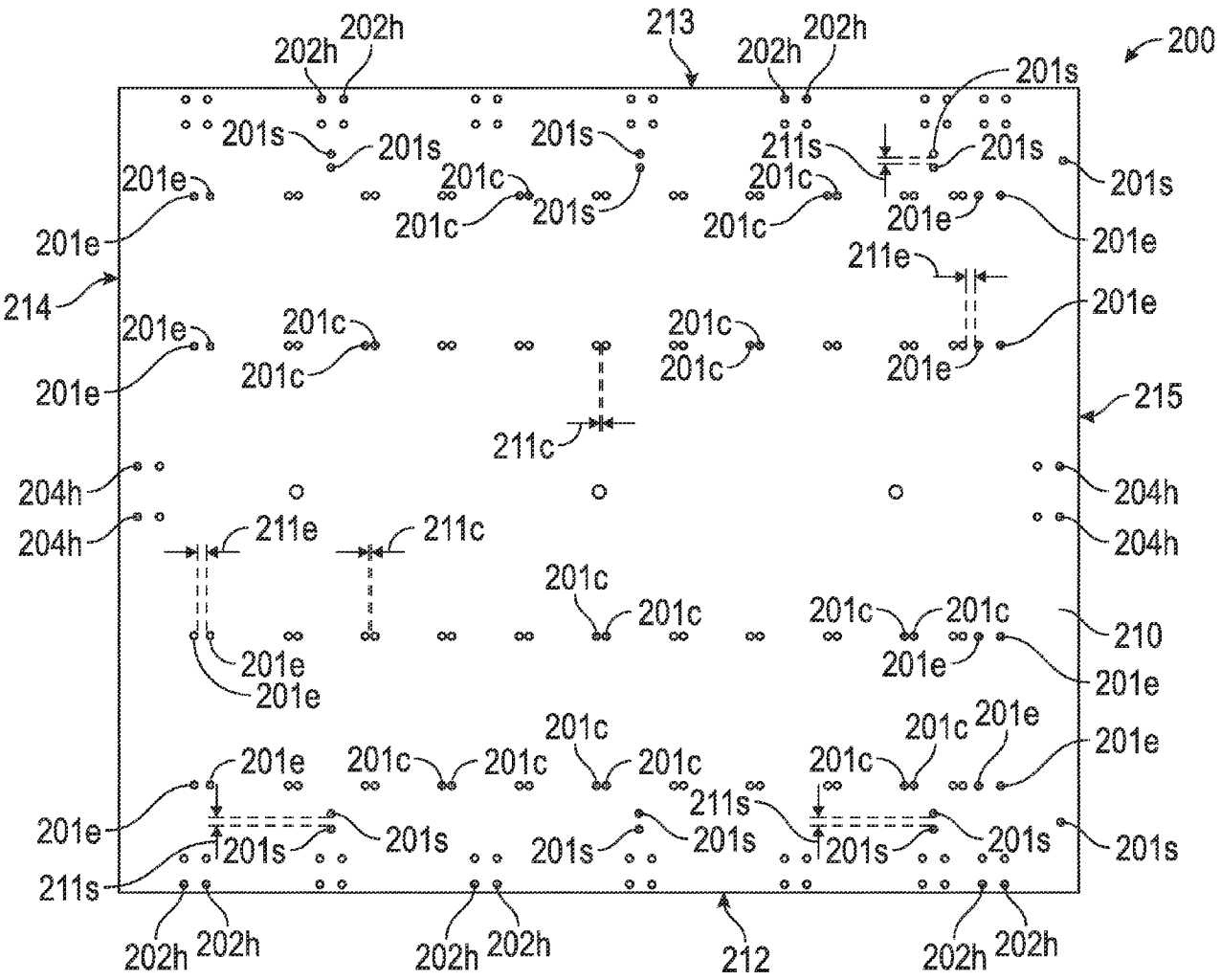

FIGS. 6A and 6B are perspective and plan views, respectively, of the jig assembly base plate 210 of FIGS. 5A and 5B with the plurality of alignment pins 201 mounted thereon. As shown in FIGS. 6A and 6B, the alignment pins 201 are positioned on the base plate 210 to facilitate the assembly and alignment of the various structural components of the support frame 250, which in some illustrative embodiments may be a low-profile support frame, prior to welding the components together, as will be further described with respect to FIGS. 6C-6S below. In certain illustrative embodiments, the position of each of the alignment pins 201 may be established on the base plate 210 with a computer numerically controlled (CNC) machining center, which can be used drill dowel pin holes (or to tap threaded blind holes) in precise locations based on very close dimensional tolerances. In this way, the alignment pins 201 may facilitate the fabrication of consistently sized and consistently shaped support frames 250 in a highly repeatable fashion.

In general, and with the exception of the single side support member end alignment pins 201*s* positioned adjacent to the second end 215 of the base plate 210 (the function of which will be described below), the alignment pins 201 are grouped together in pairs. In particular, each alignment pin 201 of a given pair of alignment pins 201 is positioned on the base plate 210 so that during the component assembly and fabrication sequence, the pair of pins 201 are on opposite sides of a given support member. In this way, each pair of alignment pins 201 locally "captures," or holds in place, a respective support member, thus preventing the member from locally moving or shifting, e.g., expanding and/or contracting, under the thermally induced strains that occur during fabrication. Furthermore, the inside pin spacing between the adjacent alignment pins 201 of each pair of pins 201 is typically established based upon the specific size, e.g., the width or thickness, of a given support member while taking into account the width/thickness tolerance of the member.

For example, as shown in FIGS. 6A and 6B, the side support member alignment pins 201*s* may be grouped together in several pairs that are positioned along each of the opposing sides 212 and 213 of the base plate 210. Furthermore, the inside pin spacing 211*s* between the pairs of alignment pins 201*s* may be established based on the specified size (e.g., thickness/width, including tolerance) of the side support members 251 (see, FIGS. 6C and 6D). For example, in some illustrative embodiments, the side support members 251 may be fabricated from square tubing, such as ⅜" 18 gauge square tubing, that is manufactured in accordance with ASTM A513. In such embodiments, the inside pin spacing 211*s* between adjacent pins 201*s* may be substantially based upon the nominal outside dimension of the specific square tubing that is used for the side support members 251 (e.g., 0.375") plus the dimensional tolerances of square tubing as required by A513 (e.g., ±0.004"). Accordingly, when the side support members 251 are fabricated from ⅜" square tubing, a CNC machining center may be used to precisely position each pair of alignment pins 201*s* such that the inside pin spacing 211*s* between the pins

201*s* is 0.379" (i.e., 0.375"+0.004"). Establishing the inside pin spacing 211*s* this manner provides additional assurances that the side support members 251 are properly positioned in, and held in place by, the jig assembly 200 during fabrication of the support frame 250.

While the exemplary embodiment depicted FIGS. 6A and 6B shows that three pairs of side support member pins 201*s* are used to position and align the side support members 251 adjacent to the respective sides 212 and 213, it should be appreciated that more or fewer pairs of pins 201*s* may be used, depending on the overall alignment and hold-down requirements of the support frame 250 during fabrication.

Similar to side support member alignment pins 201*s*, the end support member alignment pins 201*e* and the cross member alignment pins 201*c* are also grouped together in several pairs so that the respective end support members 252, 253 and cross members 254 are also locally "captured," or held in place, during support frame 250 fabrication. As shown in the illustrative embodiment depicted in FIGS. 6A and 6B, a first group of four pairs of end support member alignment pins 201*e* (for the end support member 252; see, FIGS. 6E and 6F) are positioned adjacent to the first end 214 of the base plate 210, the first group extending laterally across the width direction of the base plate 210. Similarly, a second group of four pairs of end support member alignment pins 201*e* (for the end support member 253; see, FIGS. 6E and 6F) are positioned adjacent to the second end 215 of the base plate 210, also extending laterally across the width direction thereof. Additionally, a plurality of groups of cross member alignment pins 201*c* (each made up of four pairs of pins 201*c* for respective cross members 254; see, FIGS. 6E and 6F) are positioned in the center area of the base plate 210 and between the first and second groups of end support member alignment pins 201*e*.

As with the inside pin spacing 211*s* between the pins 201*s*, the inside pin spacing dimensions 211*c* (between pairs of pins 201*c*) and 211*e* (between pairs of pins 201*e*) may also be based on the specific size (e.g., thickness/width, including tolerance) of the cross members 254 and the end support members 252, 253, respectively. For example, in at least some embodiments, the cross members 254 may be fabricated from sheet metal, such as 12 gauge sheet metal, that is manufactured to ASTM A366 standards. Accordingly to A366, cold-rolled 12 gauge sheet metal has a nominal thickness of 0.105", whereas actual thickness may range from 0.099" to 0.111". In such embodiments, a CNC machining center may be used to precisely position each pair of alignment pins 201*c* such that the inside pin spacing 211*c* between the pins 201*c* is substantially based upon the maximum thickness of the sheet metal that is used for the cross members 254, e.g., 0.111" in the case of 12 gauge cold rolled sheet. The inside pin spacing 201*e* for the end support members 252, 253 may be established in similar fashion, i.e., based on the size (width/thickness, including tolerance) of the specific product form or product forms that are used to fabrication the members 252, 253.

While the exemplary embodiment of the base plate 210 depicted FIGS. 6A and 6B shows that four pairs of alignment pins 201*e* and 201*c* are used to position and align each of the respective end support members 252, 253 and cross members 254, it should be appreciated that in at least some embodiments, more or fewer pairs of pins 201*e* and/or 201*c* may also be used, as may be required for the specific application and the requisite support frame fabrication sequence.

Figure 7A:
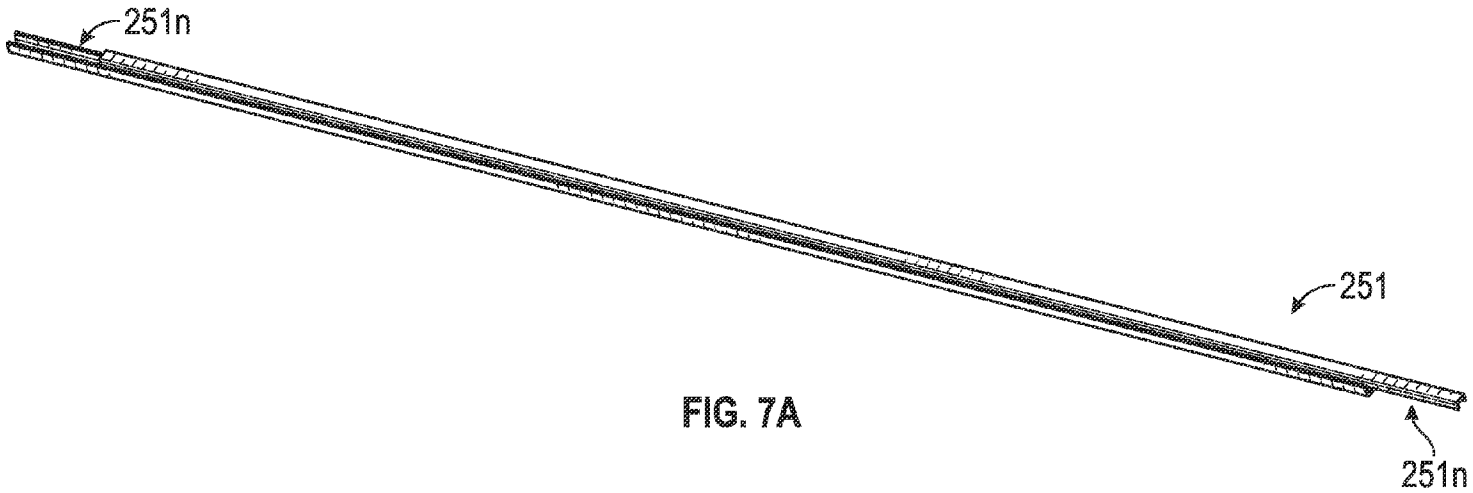
FIGS. 7A-7F are perspective views of the various components of the illustrative support frame shown in FIGS. 5C-5H prior to installing and arranging the support frame components on the base plate of FIGS. 6A and 6B for fabrication.

FIGS. 7A-7F are perspective views of the various components of the illustrative support frame 250 shown in FIGS. 5C-5H prior to installing and arranging the various support frame components on the base plate 210 of FIGS. 6A and 6B for fabrication. FIG. 7A shows an illustrative side support member 251 which may span substantially the entire length of the support frame 250 (see, FIGS. 9A-9D). Furthermore, as noted above, the side support members 251 may be fabricated from square tubing, such as ⅜" 18 gauge square tubing and the like. As shown in FIG. 7A, the side support members 251 may have notches 251*n* that positioned at opposite ends of, and on opposite sides of (i.e., top and bottom sides) of the support member 251. In certain embodiments, the notches 251*n* at each end of the side support members 251 may "nest" with similarly configured corresponding notches at the ends of adjacent screen panels (not shown) when multiple screen panel assemblies are installed end-to-end in a vibratory separator, e.g., a shale shaker, as will be further described below.

Figure 7B:
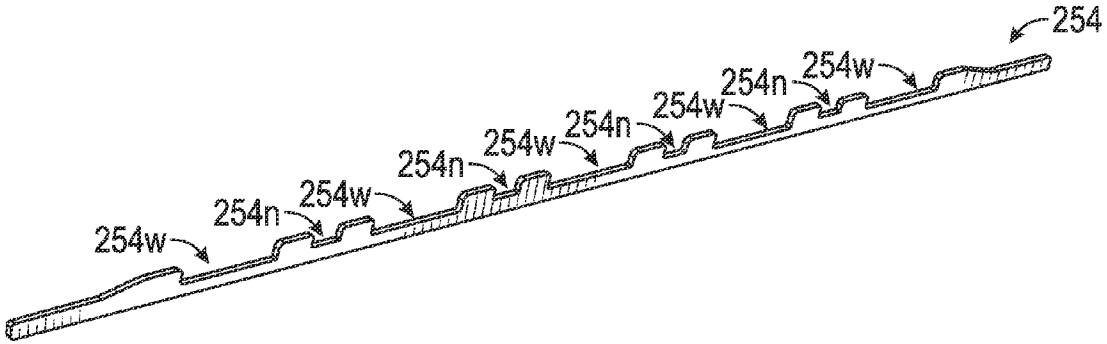

FIG. 7B shows an exemplary cross member 254, which is one of a plurality of cross members 254 that spans substantially the entire width of the support frame 250 (see, FIGS. 9A-9D). In some embodiments, the cross members 254 may be fabricated from sheet metal, e.g., 12 gauge sheet metal as previously described. Additionally, the cross members 254 may have a notched profile that includes a plurality of wide notches 254*w* and a plurality of narrow notches 254*n*. The notched profile of the cross members 254 may be formed by using any suitable sheet metal cutting method known in the art, e.g., laser cutting and the like. In certain embodiments, the wide notches 254*w* may be sized and adapted to receive the guide plates 256 and the narrow notches 254*n* may be sized and adapted to receive the longitudinal support members 255 during support frame assembly and fabrication (see, FIGS. 9A-9D, 7E, and 7F).

Figure 7C:
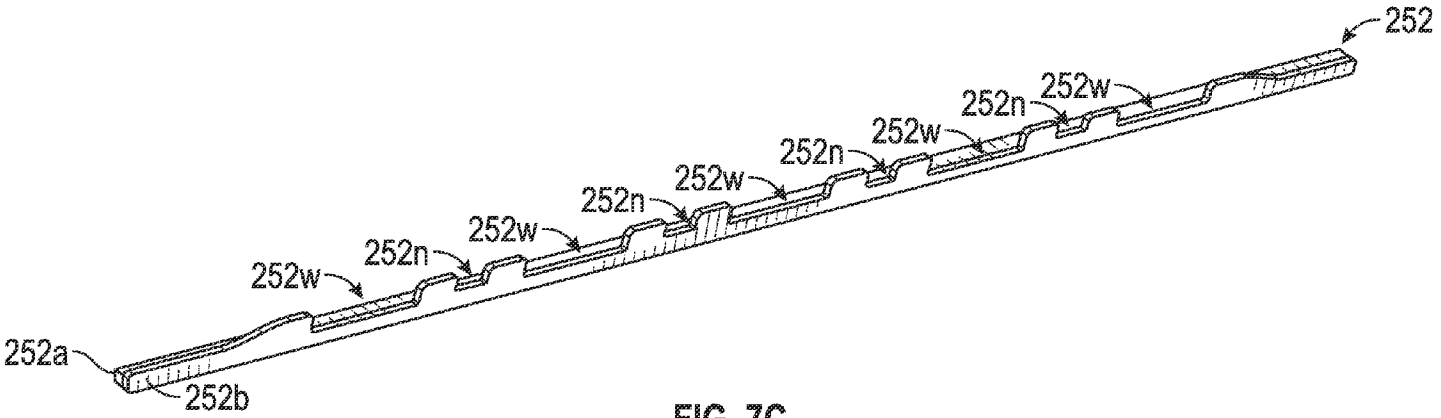

FIG. 7C shows an illustrative first end support member 252 that will be positioned at one end of the support frame 250 (see, FIGS. 9A-9D). The first end support member 252 may include a square bar 252*a* (e.g., a ¼" square bar and the like) that is fixedly attached to a first notched support member 252*b*, as shown in FIG. 7C. Furthermore, in some embodiments, the first notched support member 252*b* may have substantially the same notched configuration as each of the plurality of cross members 254, that is, with wide notches 252*w* corresponding to the notches 254*w* and narrow notches 252*n* corresponding to the notches 254*n* (see, FIG. 7B).

Figure 7D:
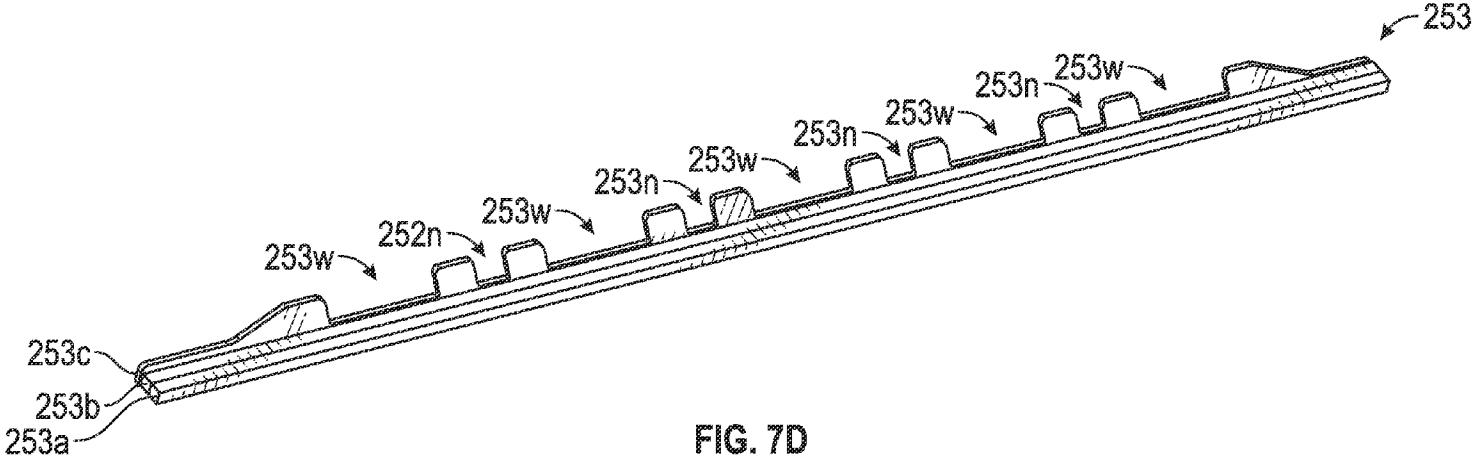

FIG. 7D depicts an exemplary second end support member 253 that will be positioned at the opposite end of the support frame 250 from the first end support member 252 (see, FIGS. 9A-9D). The second end support member 253 may include two square bars 253*a* and 253*b* (such as ¼" square bars and the like) that are fixedly attached to one another and positioned side by side. The end support member 253 may also include a second notched support member 253*c* that is fixedly attached to the two square bars 253*a* and 253*b*, as shown in FIG. 7D. In an alternative embodiment, the two ¼" square bars 253*a*, 253*b* may be replaced by a single flat bar having substantially the same dimensions as the two joined square bars 253*a*, 253*b*—i.e., a ¼" thick×½" wide flat bar. Furthermore, as with the first notched support member 252, the second notched support member 253*c* may be configured substantially the same as each of the plurality of cross members 254, that is, with wide notches 253*w* corresponding to the notches 254*w* and narrow notches 253*n* corresponding to the notches 254*n* (see, FIG. 7B).

Figure 7E:
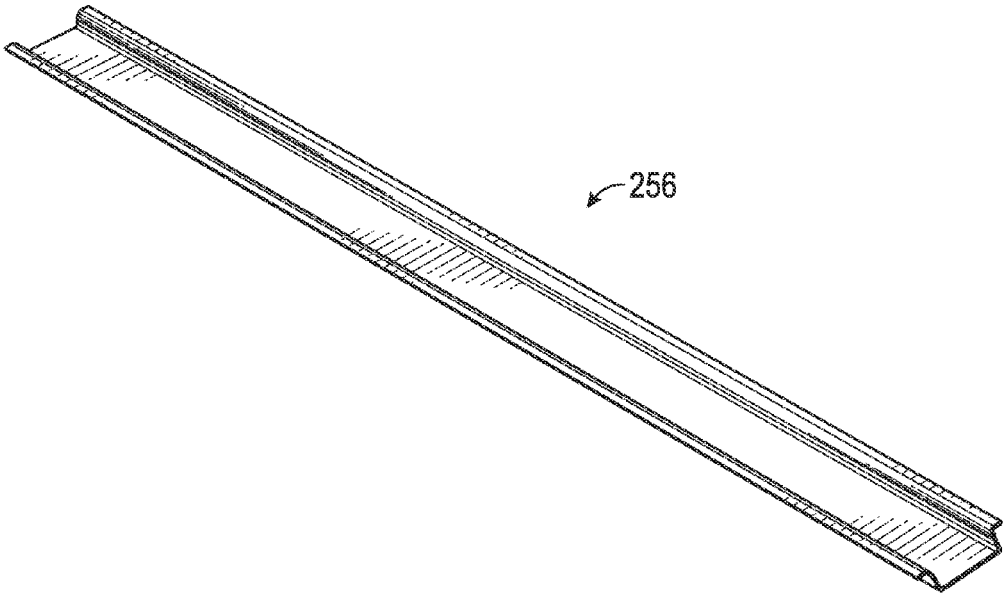
Figure 7F:
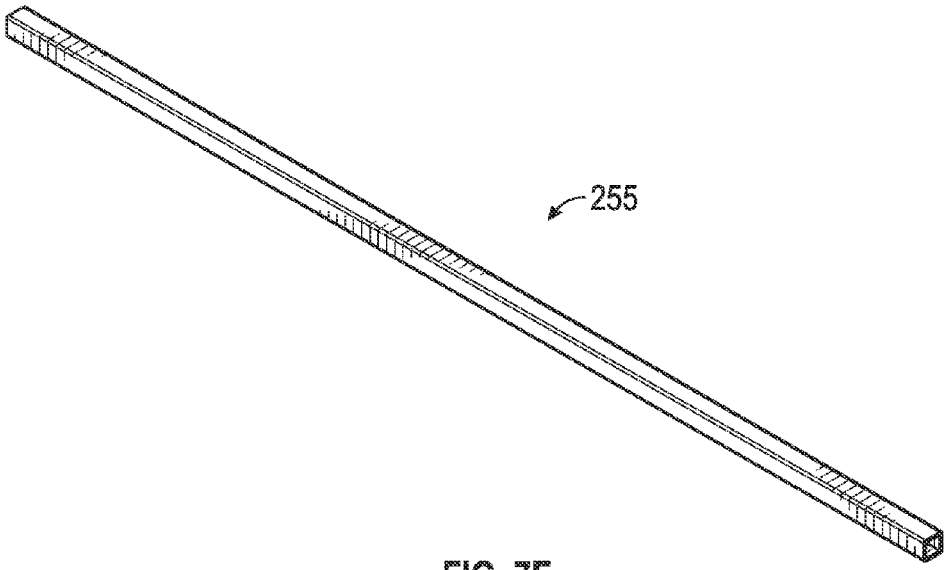

FIG. 7E depicts an illustrative guide plate 256 of the screen panel support frame 250. As show in FIGS. 9A-9D, the guide plates 256 run parallel to the side support members 251 for most of the length of the support frame 250, and each guide plate 256 fits into the substantially aligned wide notches 252*w*, 254*w*, and 253*w* of the first end support member 252, the plurality of cross members 254, and the second end support member 253, respectively. FIG. 7F depicts an exemplary longitudinal support member 255 of the support frame 250, which also run parallel to the guide plates 256 for most of the frame length. Each of the longitudinal members fits into substantially aligned narrow notches 252*n*, 254*n*, and 253*n* of the first end support member 252, the plurality of cross members 254, and the second end support member 253, respectively.

One exemplary sequence of using the jig assembly 200 of FIGS. 5A and 5B to assemble and fabricate the various support frame components 251-256 of FIGS. 7A-7F on the base plate 210 shown in FIGS. 6A and 6B will now be described below in conjunction with FIGS. 8A-8P.

Figure 8A:
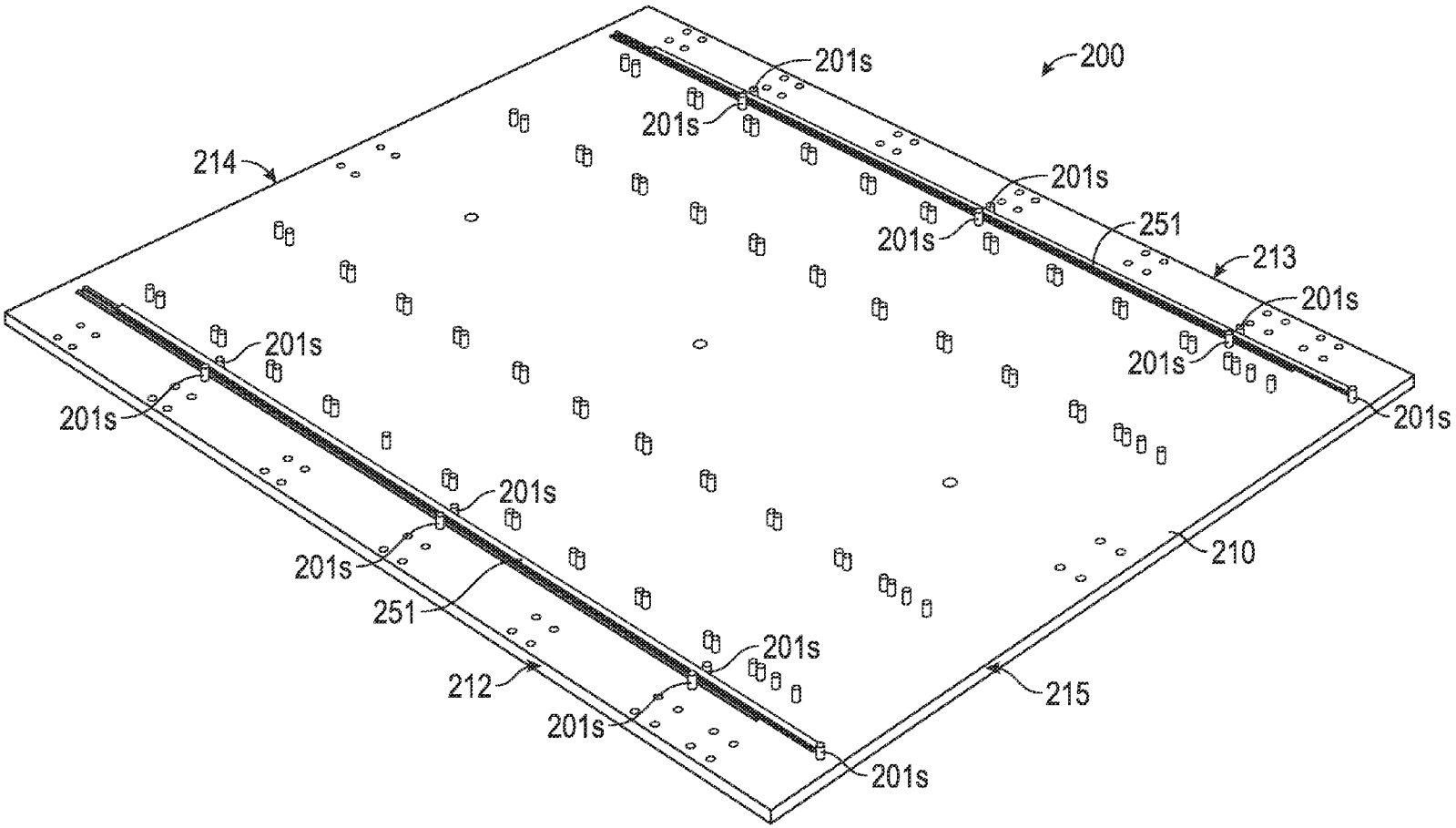
FIGS. 8A-8P are various perspective and plan views showing one exemplary sequence of using the jig assembly depicted in FIGS. 5A and 5B while assembling and fabricating the support frame components of FIGS. 7A-7F on the base plate of FIGS. 6A and 6B.
Figure 8B:
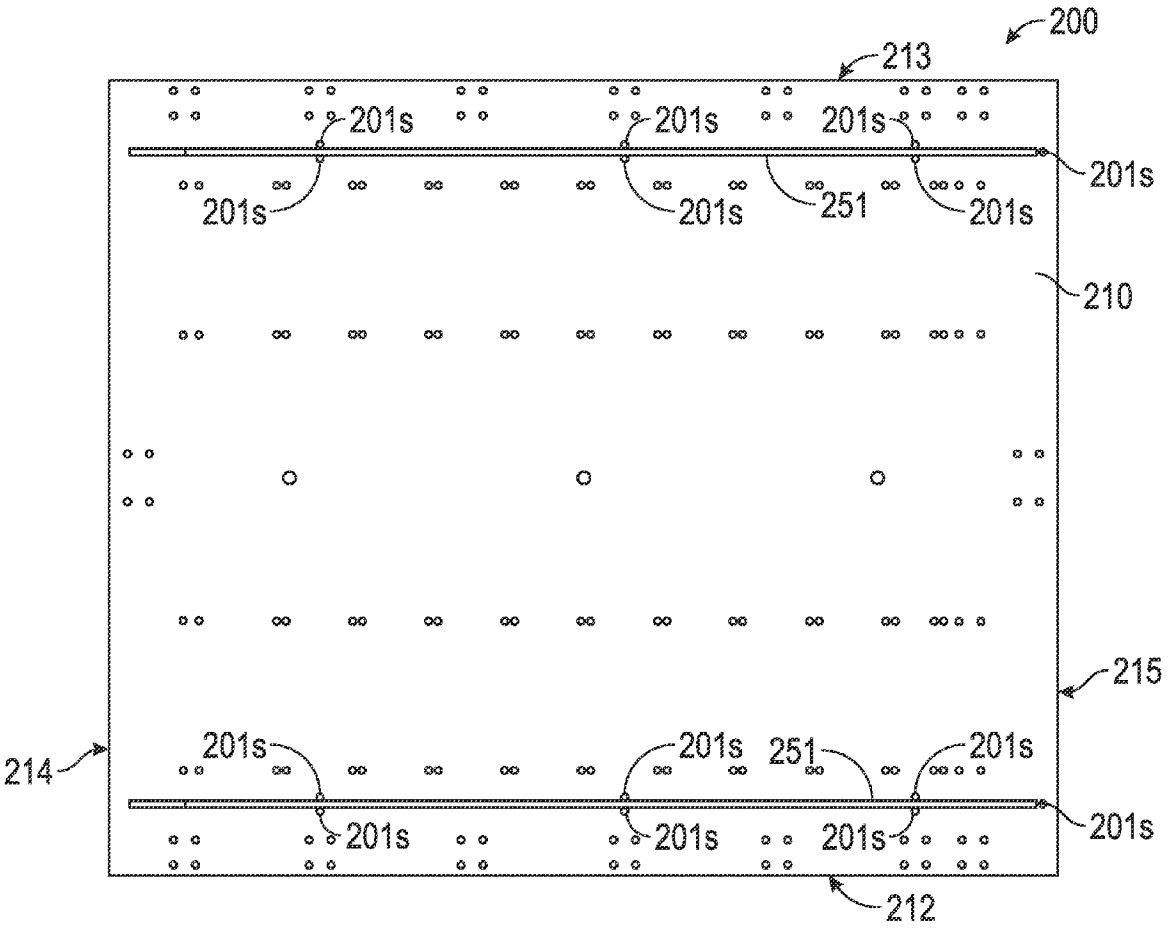

FIGS. 8A and 8B are perspective and plan views, respectively, of the jig assembly 200 base plate 210 after the side support members 251 have been positioned between, and aligned with, the side support member alignment pins 201*s*. As shown in FIGS. 8A and 8B, one side support member 251 has been positioned on the base plate 210 such that it extends between each of the three pairs of side support member alignment pins 201*s* that are mounted adjacent to one side 212 of the base plate 210. Similarly, the other side support member 251 has been positioned on the base plate 210 such that the it extends between the other three pairs of alignment pins 201*s* that are mounted adjacent to the opposite side 213 of the base plate 210. Furthermore, each side support member 251 is positioned up against, i.e., in contact with, the respective single end alignment pins 201*s* that are located closest to the second end 215 of the jig assembly 200 base plate 210. In the illustrative embodiment shown in FIGS. 8A and 8B, the single end alignment pins 201*s* adjacent to the end 215 may be precisely positioned in such a manner as to establish the relative positional relationship of all other support frame components, including the end support members 252, 253, the cross members 254, the guide plates 256, and the longitudinal support members 255, as will be further described below.

Figure 8C:
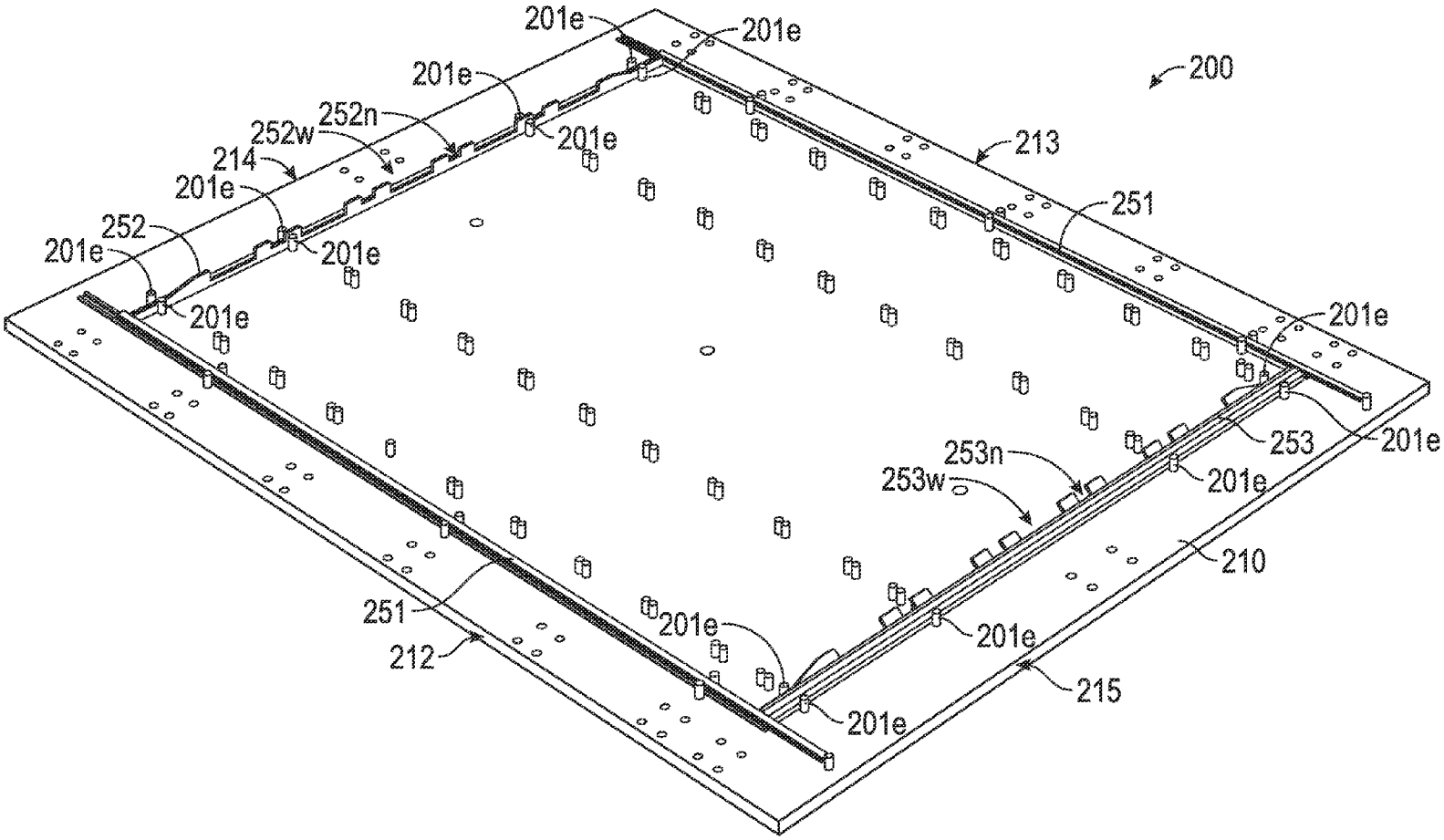
Figure 8D:
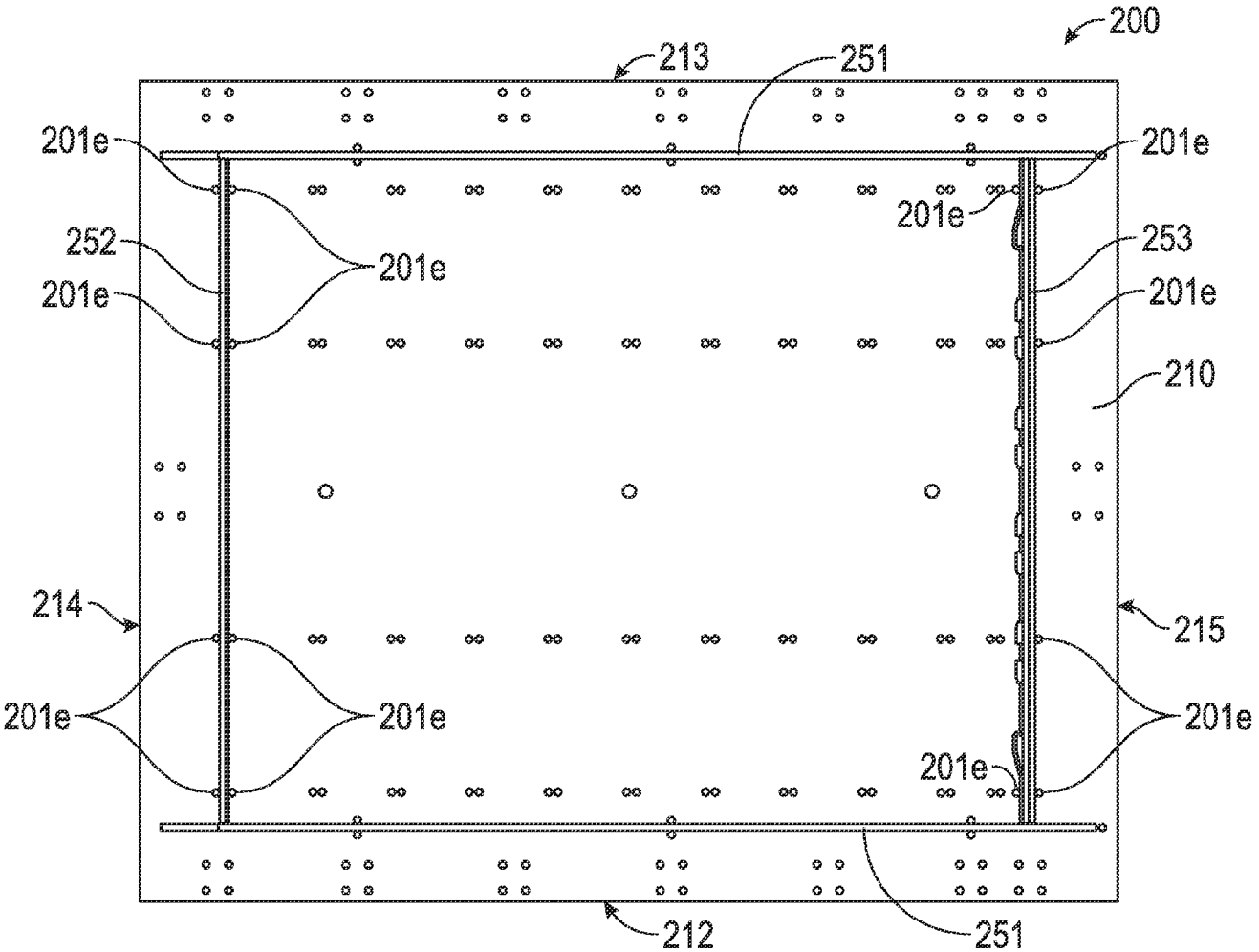

FIGS. 8C and 8D are perspective and plan views, respectively, during a further assembly step of the illustrative support frame 250 (see, FIGS. 5C-5H). As shown in FIGS. 8C and 8D, the end support member 252 has been positioned on the base plate 210 such that it runs between the four pairs of end support member alignment pins 201*e* that are located adjacent to the first end 214 of the base plate 210, i.e., laterally across the width of the support frame 250 (see, FIGS. 5C-5H). Additionally, the end support member 253 has also been positioned on base plate 210 such that it runs laterally across the width of the support frame and between the four pairs of alignment pins 201*e* that are located adjacent to the second end 215 of the base plate 210, i.e., at the opposite end of the jig assembly 200 from the first end 214 and the end support member 252. In the support member configuration depicted in FIGS. 8C and 8D, each opposing end of the end support members 252 and 253 are positioned immediately adjacent to and/or in contact with a side support member 251.

Figure 8E:
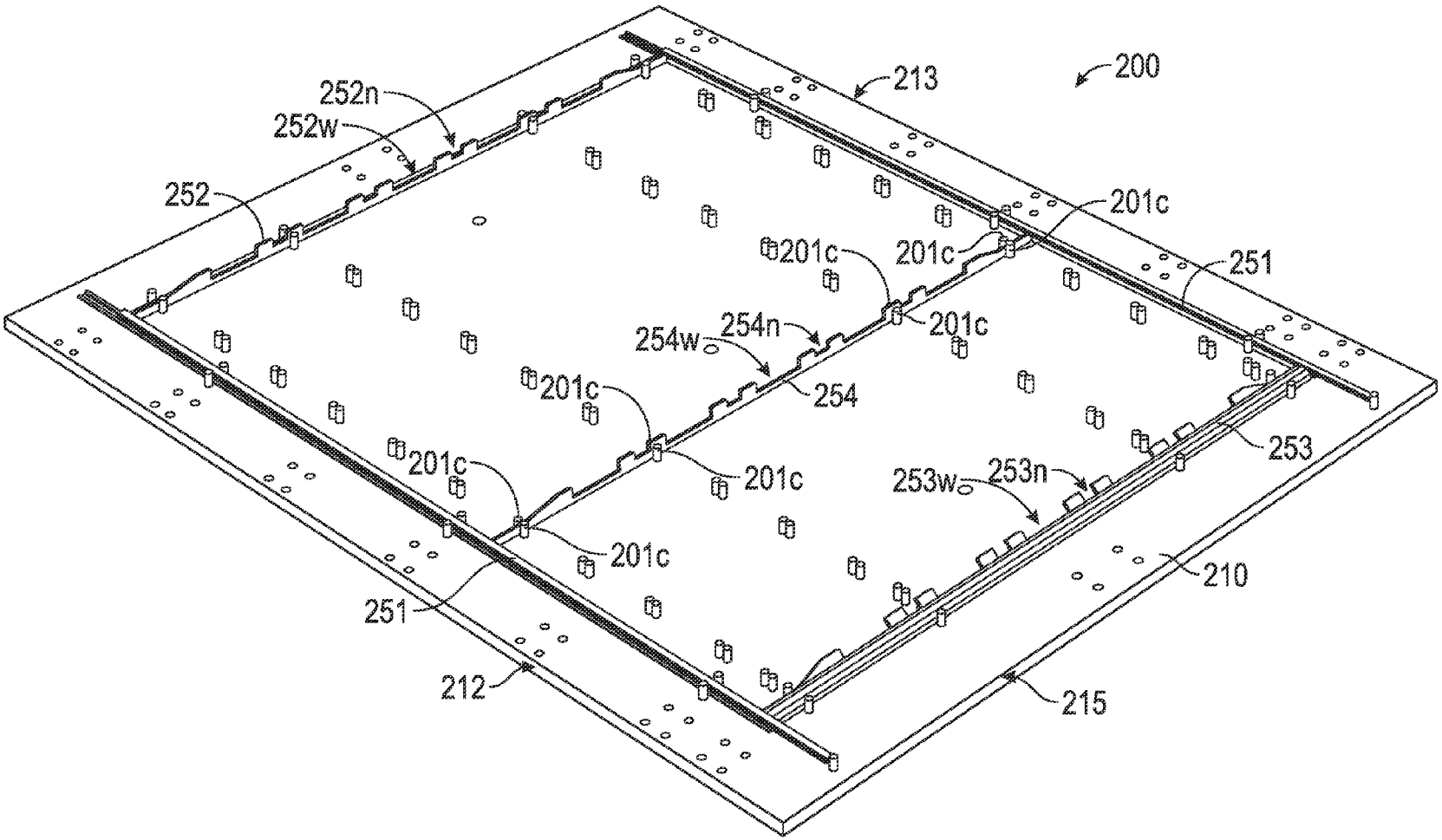
Figure 8F:
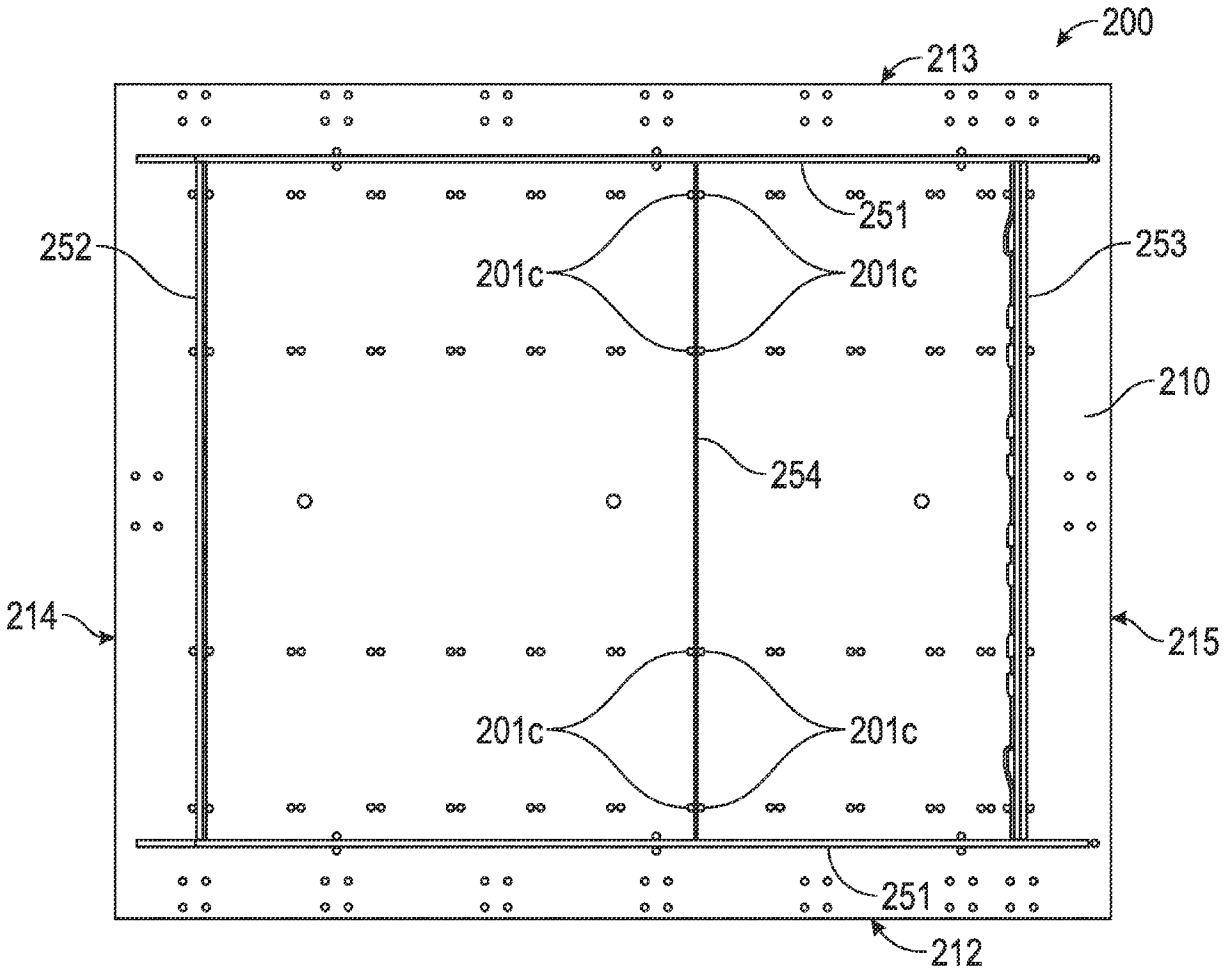
Figure 8G:
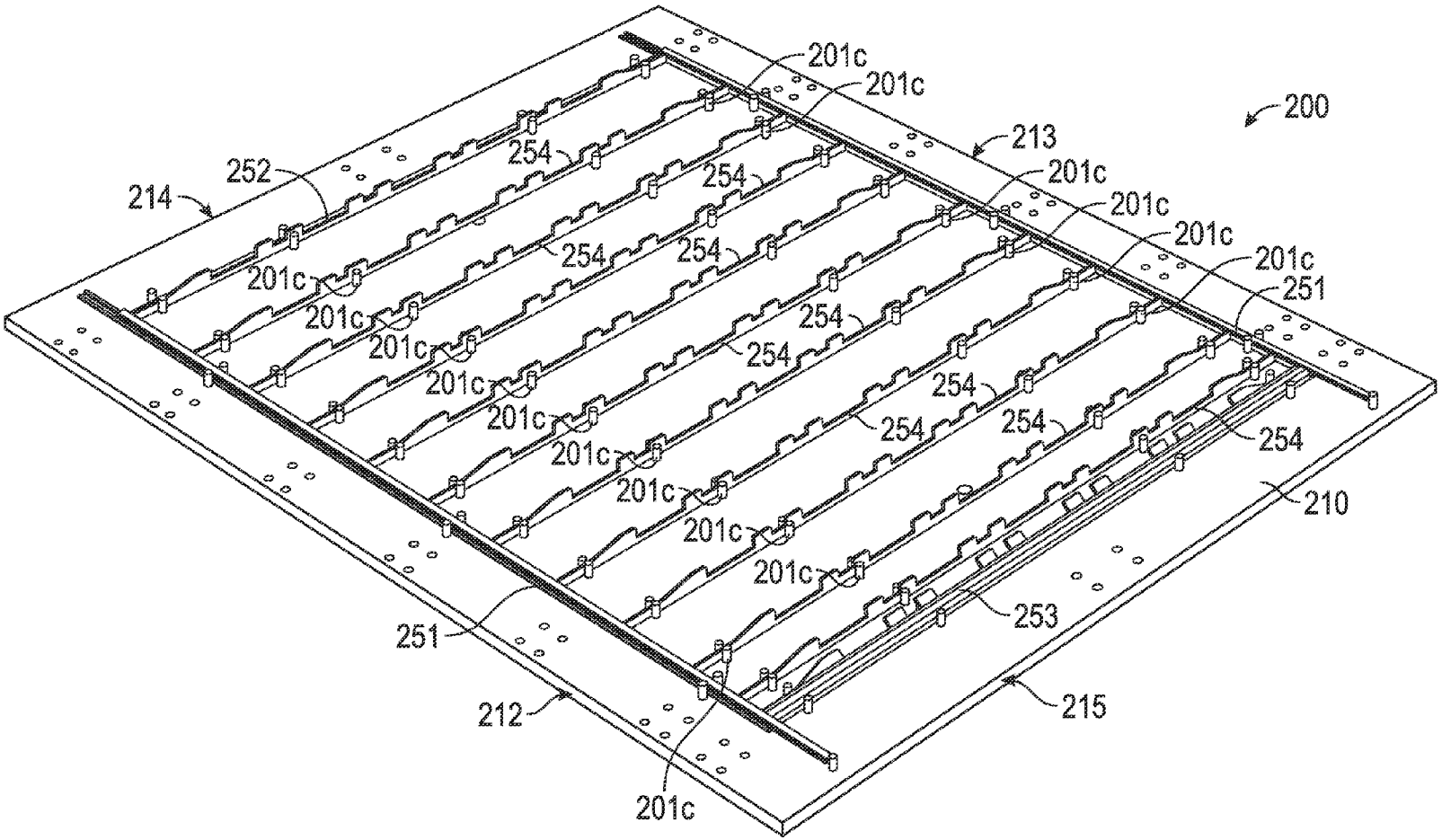
Figure 8H:
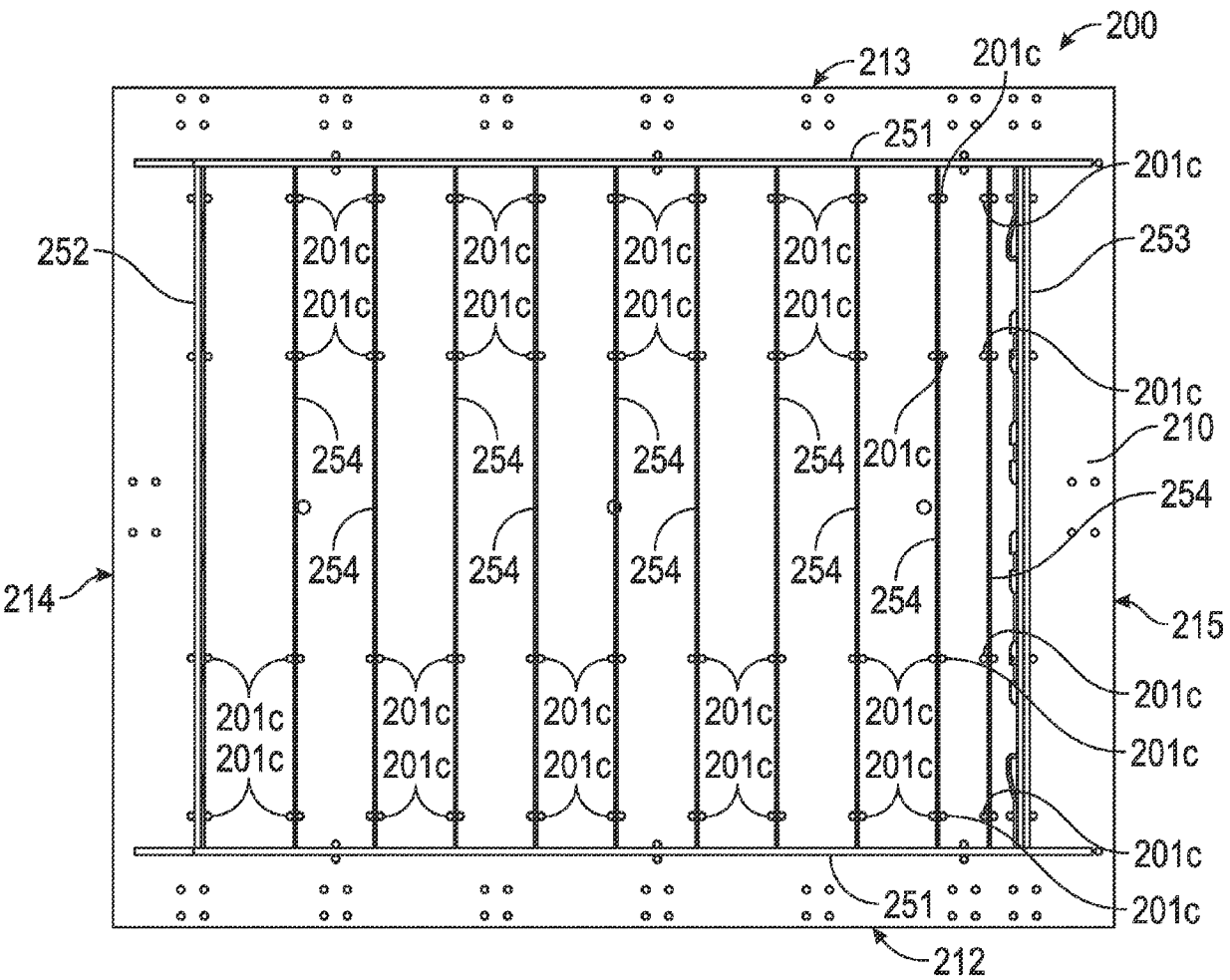
Figure 8I:
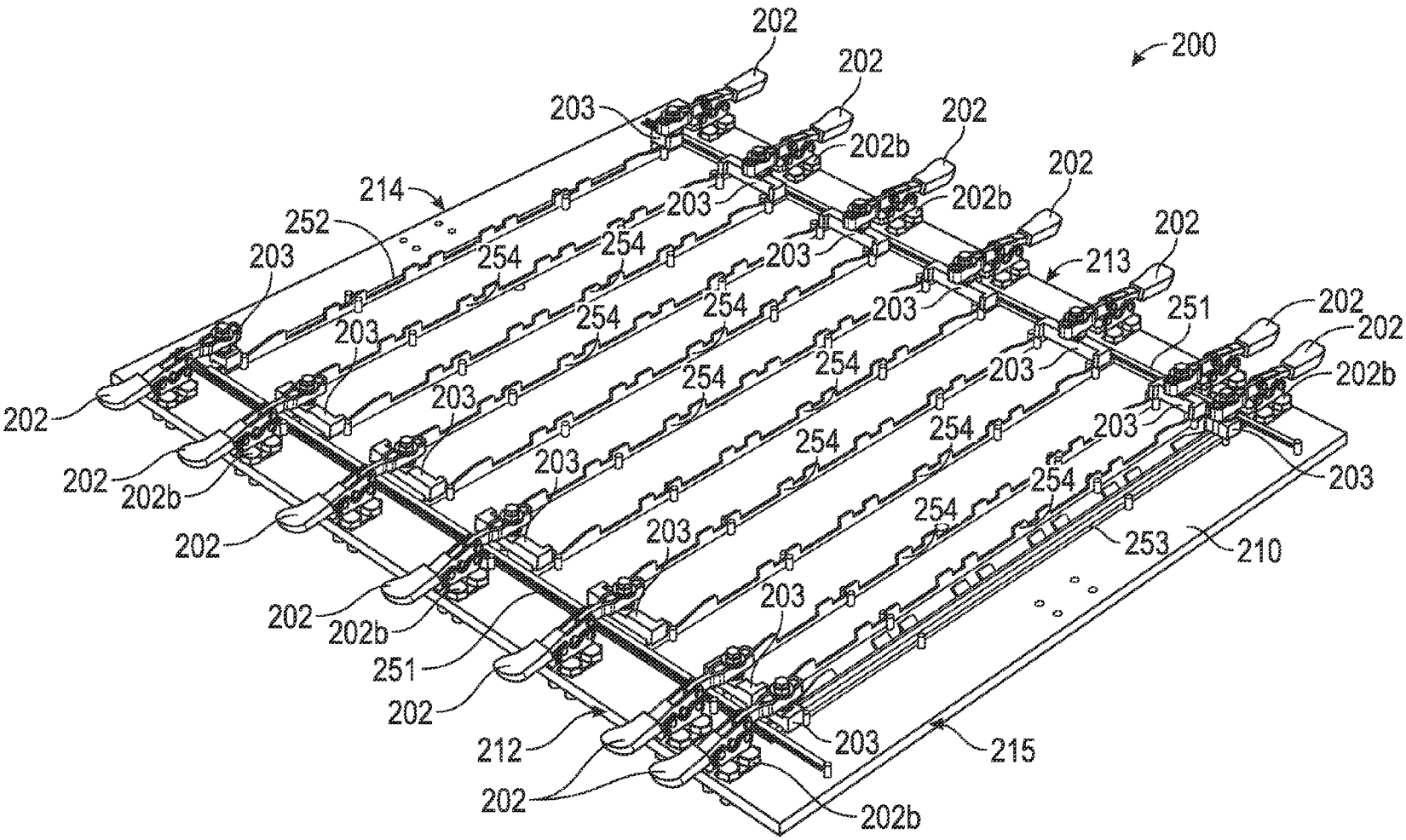

FIGS. 8E and 8F are perspective and plan views, respectively, of the jig assembly 200 base plate 210 in a subsequent step of the assembling the various components of the support frame 250. More specifically, FIGS. 8E and 8F depict the jig assembly 200 after a first one of the plurality of cross members 254 has been positioned on the base plate 210 such that it runs between four pairs of cross member alignment pins 201*c*. Furthermore, as with the end support members 252 and 253, the opposing ends of the cross member is positioned immediately adjacent to and/or in contact with the side support members 251. Thereafter, the remaining cross members 254 may be installed in substantially similar fashion, i.e., so that each cross member 254 runs laterally across the width of the support frame while being positioned between four pairs of alignment pins 201*c*.

Figure 8J:
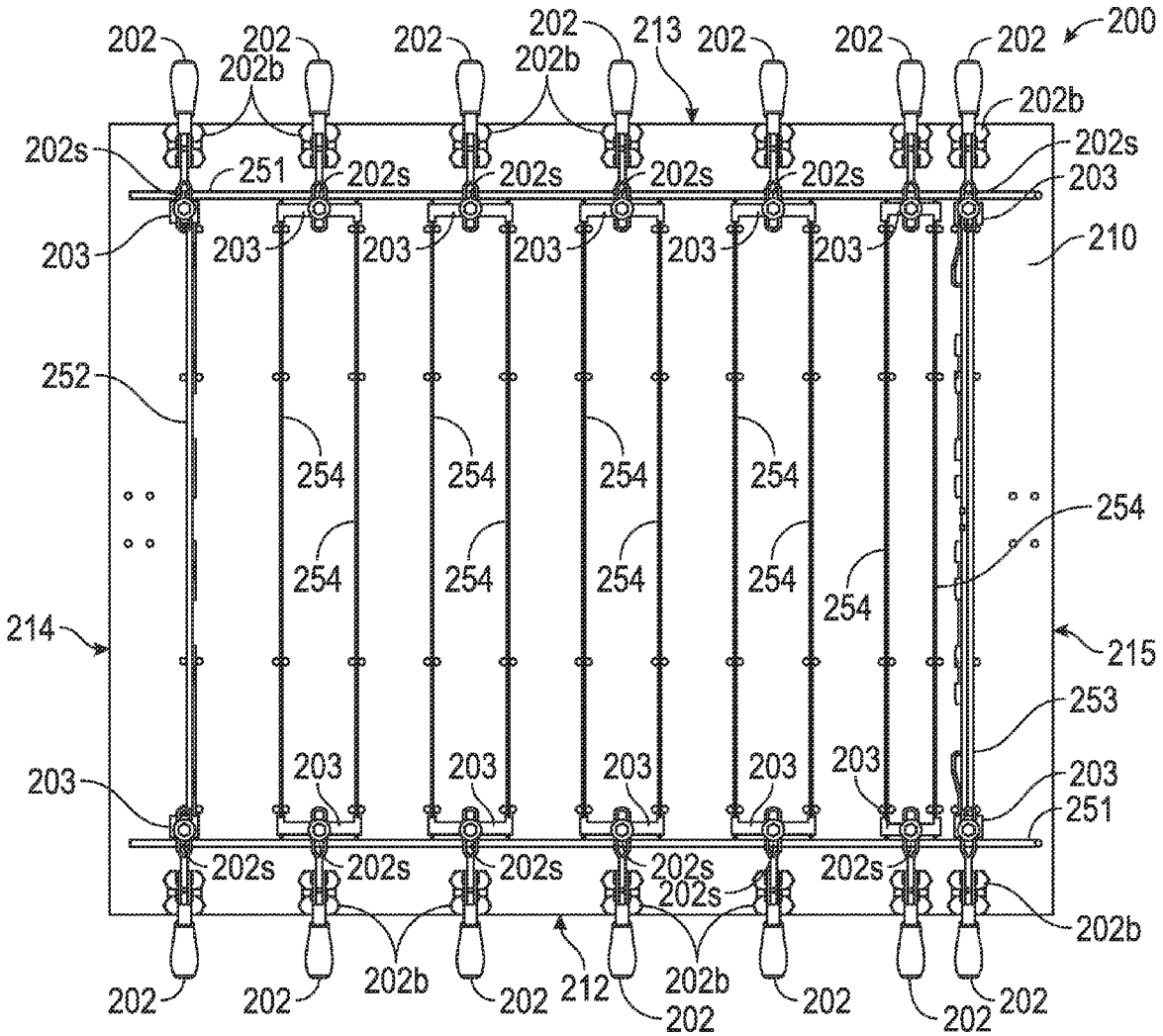

Next, the side clamp assemblies 202 may be fixedly and removably secured to the base plate 210 using the fasteners 202*b*, as shown in FIGS. 81 and 8J. The side support members 251 are then held firmly in contact with a respective single end alignment pin 201*s* so as to ensure the proper relative positioning and alignment of all support members 251-254. Thereafter, the side clamp assemblies 202 may be operated so that the clamping bar 203 of each respective assembly 202 clamps and holds the various support members 251-254 in place—that is, the side support members 251, the end support members 252, 253, and the cross members 254. It should be appreciated that the side clamp assemblies 202 may be in place throughout each of the preceding steps illustrated in FIGS. 8A-8H above, that is, during the installation of each of the various support members 251-254, wherein however the each of the side clamp assemblies 202 are open and pulled away from the support members 251-254 until all support members have been positioned on the jig assembly 200 base plate 210. Each of the side clamp assemblies 202 may then be operated to clamp the support members 251-254 in place, as described above.

In an alternative assembly embodiment, the side clamp assemblies 202 located along one side or the other of the jig assembly 200 base plate 210 may be used to clamp in place one of the side support members 251 (e.g., the support member 251 adjacent to side 212 of the base plate 210) and the adjacent ends of the two end support members 252, 253 prior to positioning the cross members 254 on the base plate 210. This may be accomplished by slidably moving the clamping bars 203 of the respective side clamp assemblies 202 along the slots 202*s* so that the clamping bars 203 are only positioned above the side support member 251 and do not interfere with the positions where the cross members 254 abut the side support member 251. Thereafter, once all of the cross members 254 have been positioned between the various pairs of alignment pins 201*c* in the center region of the jig assembly 200, the other side support member 251 (e.g., the support member 251 adjacent to side 213) and the other ends of the two end support members 252, 253 may be clamped in place using the side clamp assemblies 202 that are positioned along that side of the base plate 210. Again, this may be accomplished by slidably adjusting the position of the clamping bars 203 in the slots 202*s* in the manner described above. In this way, the plurality of cross members 254 are not directly clamped in place by the side clamp assemblies 202, but are instead permitted to "float" between the side support members 251 until the guide plates 256 and/or the longitudinal support members 255 are positioned in the various wide and/or narrow notches of the cross members 254 and clamped in place using the end clamp assemblies 204, as will be further described below.

Figure 8K:
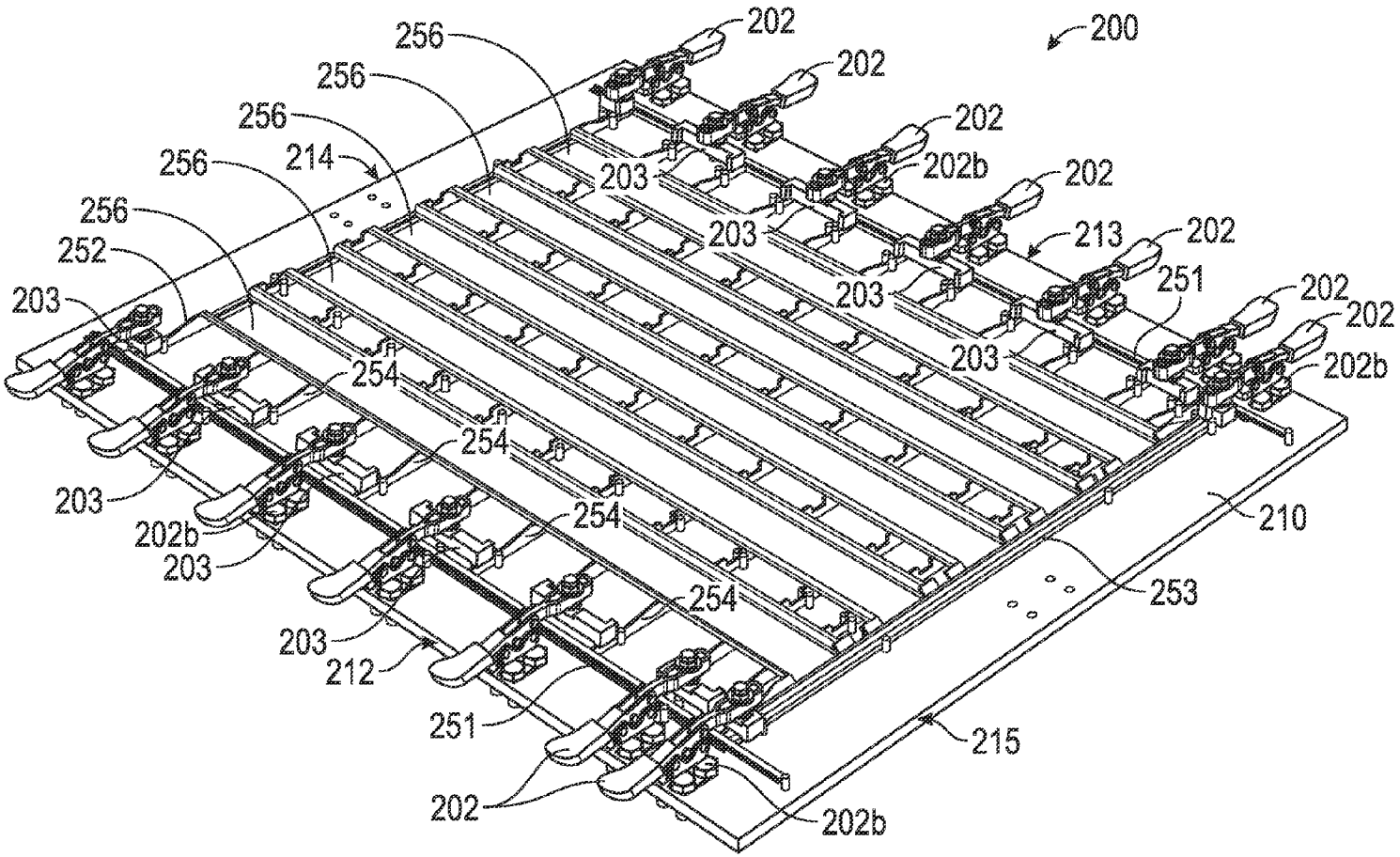
Figure 8L:
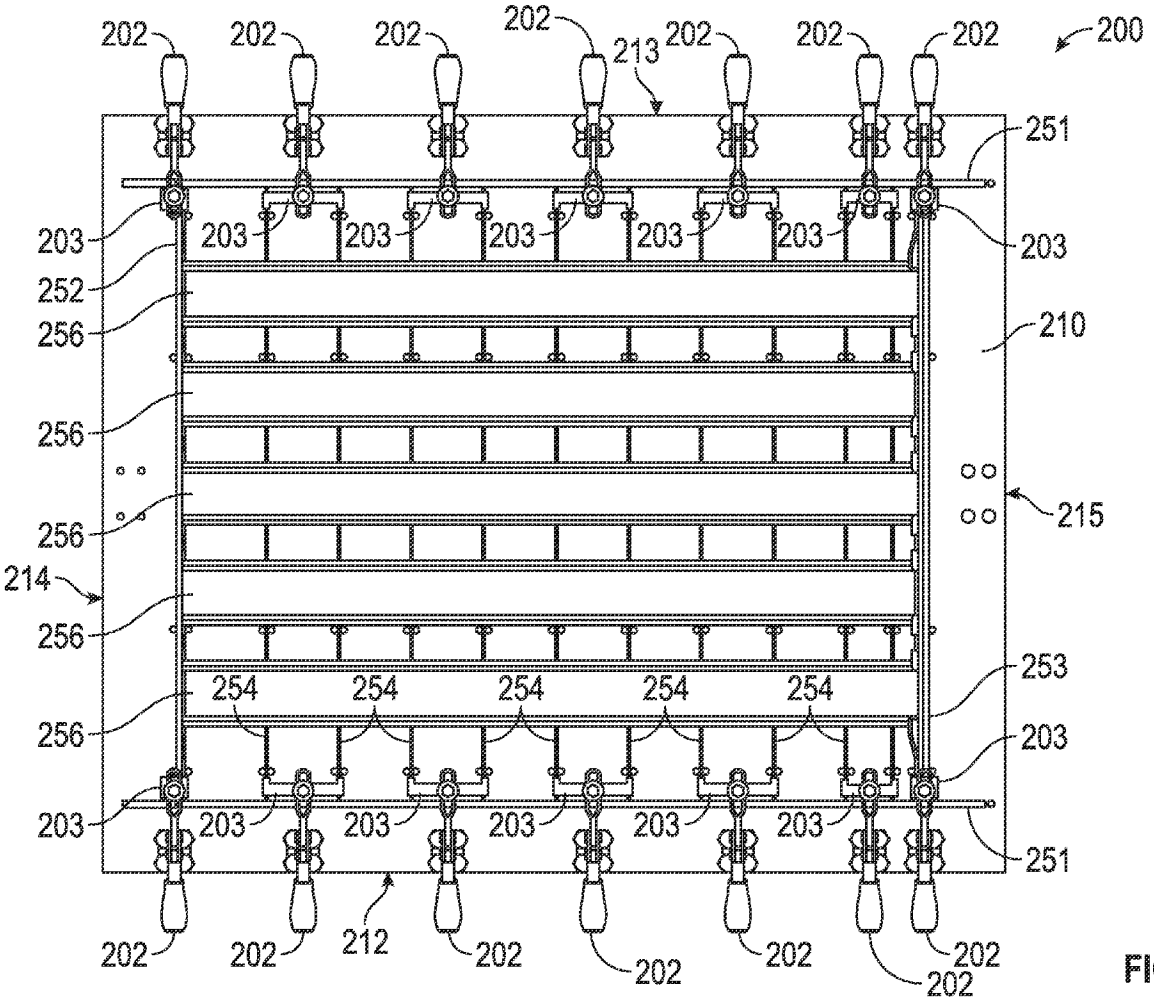
Figure 8M:
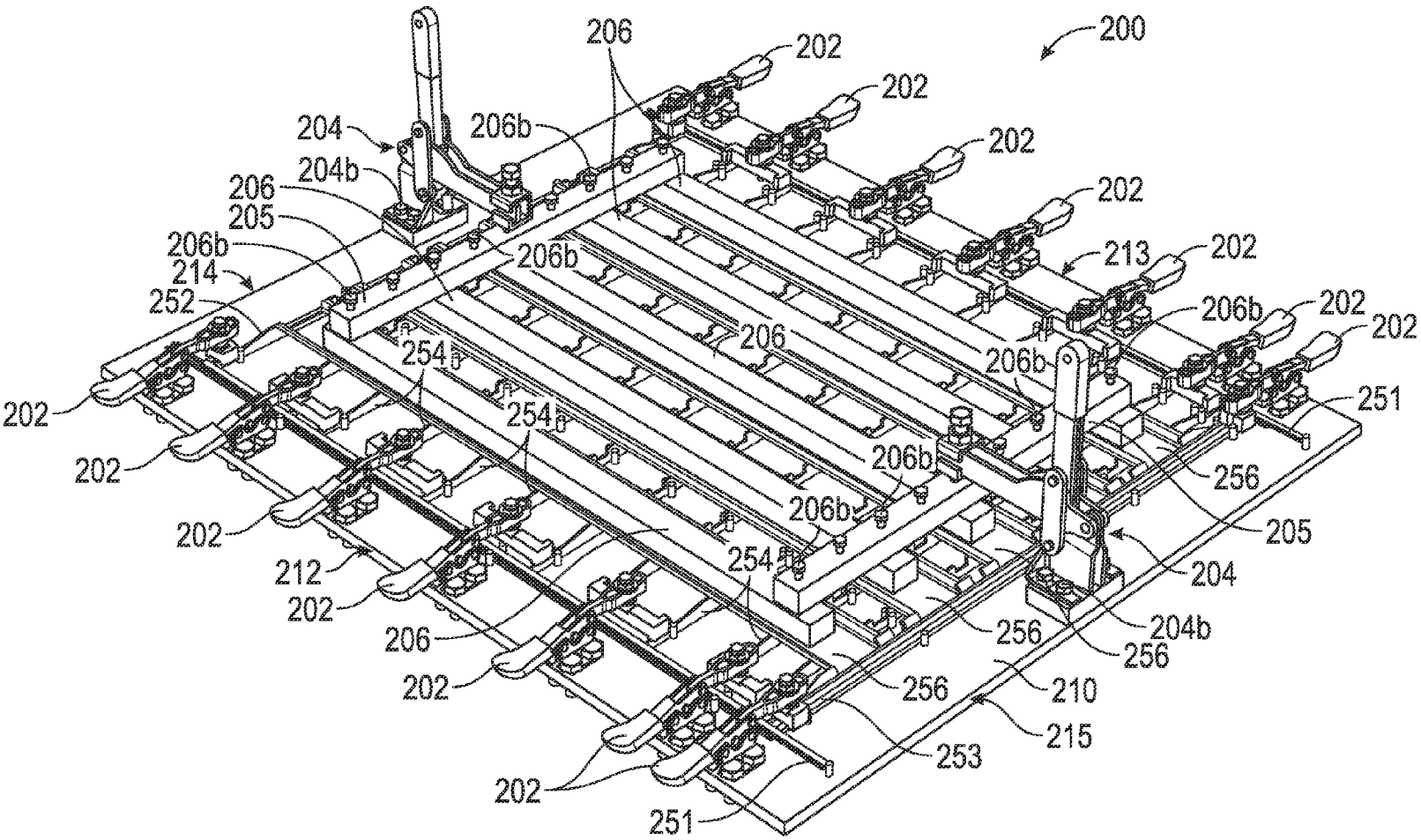
Figure 8N:
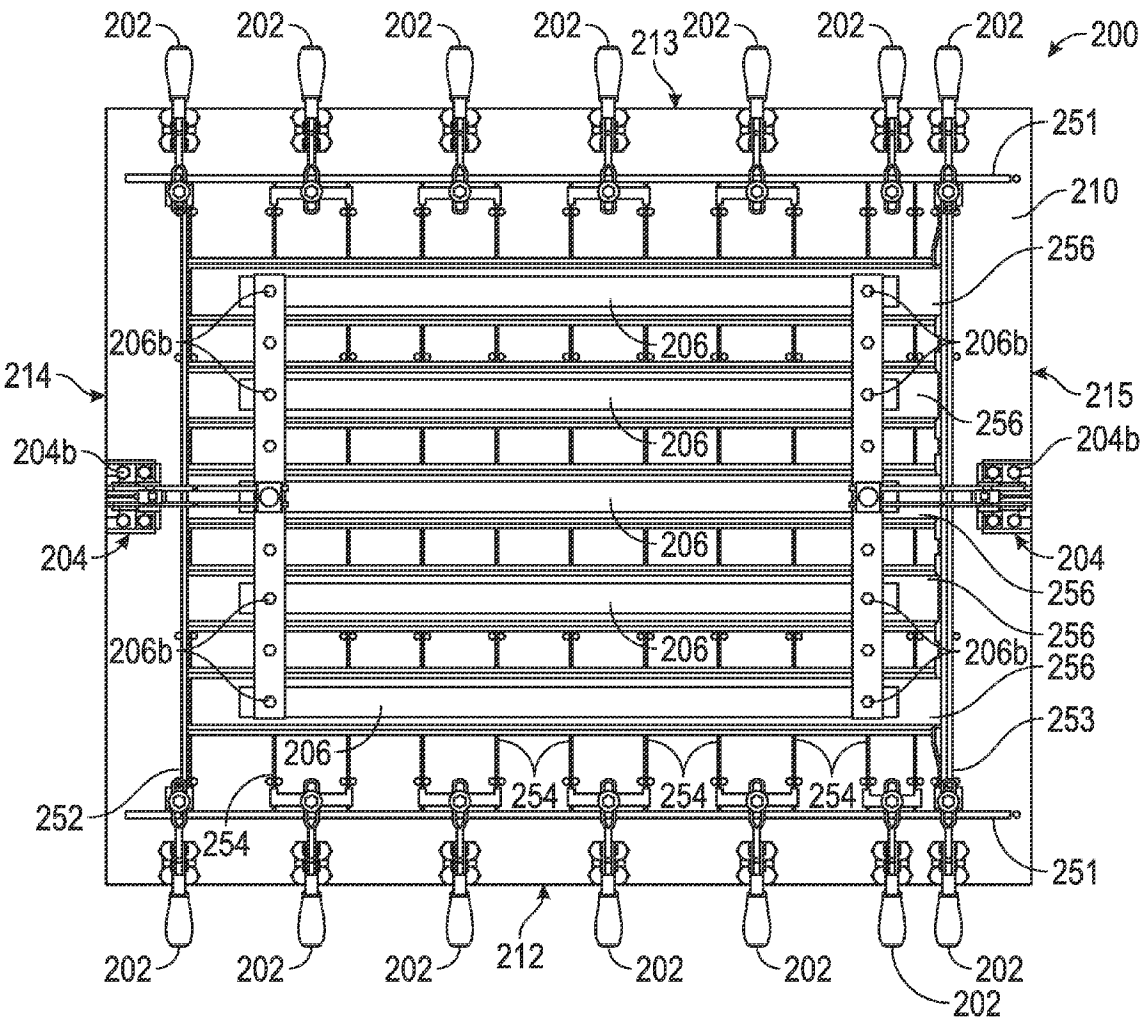

FIGS. 8K and 8L are perspective and plan views, respectively, of the jig assembly 200 after the guide plates 256 have been positioned in the jig assembly 200 above the cross members 254 and the end support members 252, 253. In certain illustrative embodiments, each guide plate 256 is positioned in a substantially aligned group of wide notches that are formed in each of the various lateral support members 252-254, i.e., in wide notches 252*w* (of end support member 252), 254*w* (of cross members 254), and 253*w* (of end support member 253). See, e.g., FIGS. 7B-7D and FIGS. 8C-8F. As shown in FIGS. 8K and 8L, each of the guide plates 256 runs along the length direction of the support frame 250. Thereafter, the end clamp assemblies 204 may be fixedly and removably secured to the base plate 210 using the fasteners 204*b*, as is shown in FIGS. 8M and 8N. Next, a hold-down bar 206 may be positioned on each respective guide plate 256, the clamping bars 205 may be attached to the respective end clamp assemblies 204, and the clamp assemblies 204 may be operated so as to firmly clamp and hold the guide plates 256 in the wide notches 252*w*-254*w* of the respective lateral support members 252-254. Additionally, the hold-down bar adjustment bolts 206*b* may be used to adjust the clamping/hold-down force on each of the hold-down bars 206, and consequently on each of guide plates 256.

As with the side clamp assemblies 202 described above, it should be appreciated that the end clamp assemblies may be in place throughout each of the preceding steps illustrated in FIGS. 8A-8J above, that is, during the installation of each of the various support members 251-254 and the guide plates 256, wherein however the each of the end clamp assemblies 204 are open and pulled away from the support members 251-254 and guide plates 256 until these components have been positioned in the jig assembly 200. Each of the end clamp assemblies 204 may then be operated to clamp the guide plates 256 in place, as described above.

In at least some exemplary embodiments, the guide plates 256 may be fabricated so as to have a slight interference fit in the wide notches 252*w*-254*w*. Accordingly, in such embodiments it may be necessary to apply an initial guide plate "seating" force to the hold-down bars 206, such as by hammering and the like, so as to ensure that the guide plates 256 are fully "pressed" or "seated" in the notches 252*w*-254*w* before the end clamp assemblies 204 and/or the hold-down bar adjustment bolts 206*b* are operated so as to firmly clamp the guide plates in place.

In certain illustrative embodiments, once the guide plates 256 have been pressed into the wide notches 252*w*-254*w* and clamped in place using the end clamp assemblies 204, clamping bars 205, and hold-down bars 206, a first phase of controlled welding operations may be performed to weld together the presently assembled support frame components 251-254 and 256. In particular, during the first phase of controlled welding operations, the guide plates 256 may be welded to each of the end support members 252, 253 and the cross members 256, and each of the end support members 252, 253 and cross members 254 may be welded to the side support members 251. As noted previously, each of the welds performed during the first phase of controlled welding operations may be performed exclusively from one side of the support frame 250, i.e., from the bottom side, which is facing upward on the jig assembly 200 during this phase of frame fabrication. Additionally, the specific heat input during the first phase of controlled welding operations, as well the specific sequence in which the various welds are made, may be adjusted as necessary to induce the requisite amount of reverse pre-curvature in the finished support frame 250. In some embodiments, such adjustments may be based on fabrication mock-ups, i.e., experimentation, and may depend on various geometric factors, such as the overall size and stiffness of the support frame, type of welding processes used (e.g., MIG and/or TIG), and the like.

In one exemplary embodiment, the welding sequence may begin by first welding each of the guide plates 256 to the first notched support member 252*b* of the first end support member 252 and welding the first end support member 252 to both of the side support members 251. Next, the welding sequence may continue by welding out the middle of the frame, i.e., by welding each of the guide plates 256 to each of the cross member 254*s*, and welding each of the cross members 254 to both side support members 251. Finally, the welding sequence may finish by welding each of the guide plates 256 to the second notched support member 253*c* of the second end support member 253, and welding the second end support member 253 to both of the side support members 251. It should be appreciated that the above-noted welding sequence is exemplary only, as other sequences that are adapted to provide the requisite degree of reverse support frame pre-curvature during frame fabrication may also be used.

Figure 8O:
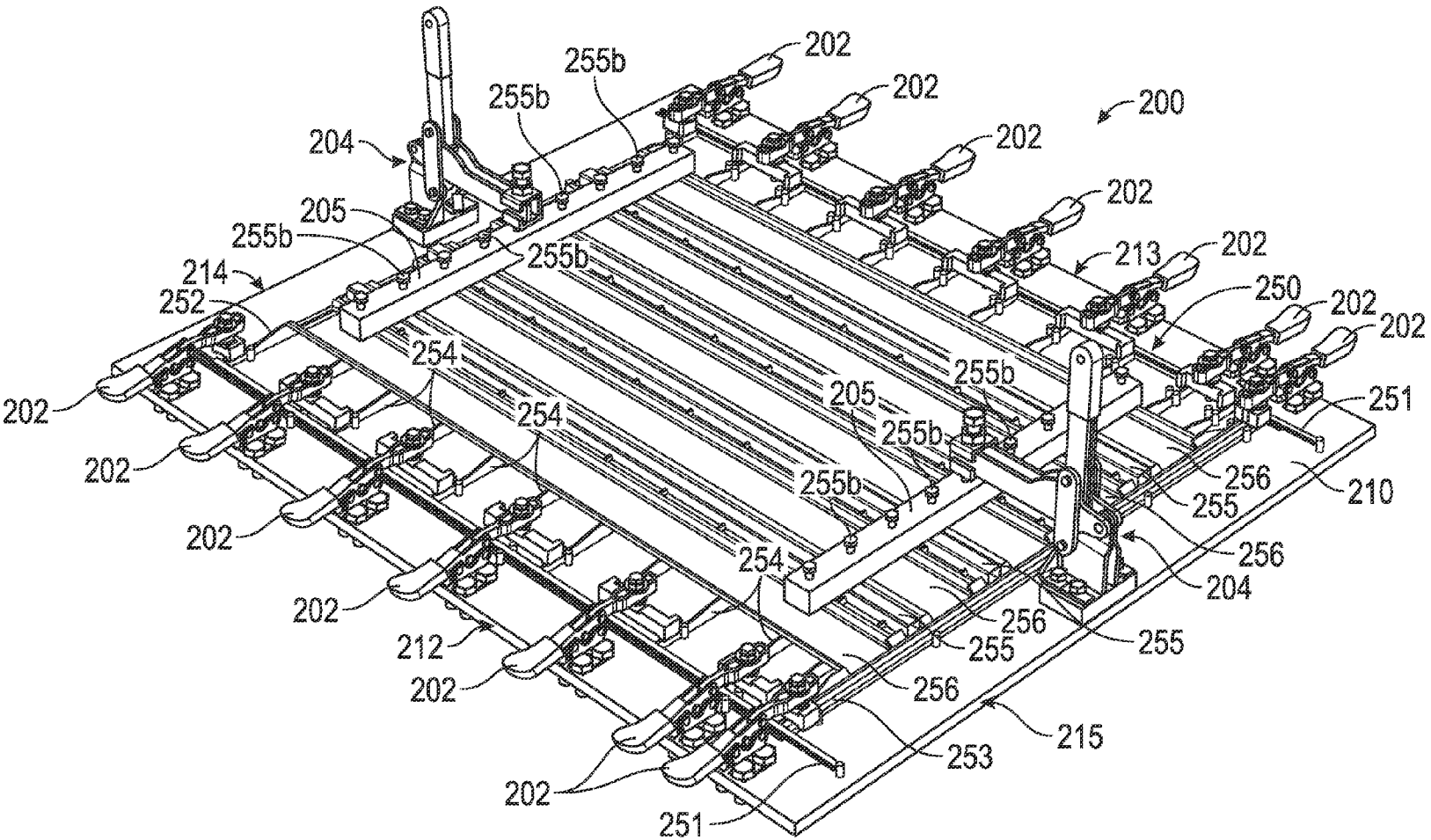
Figure 8P:
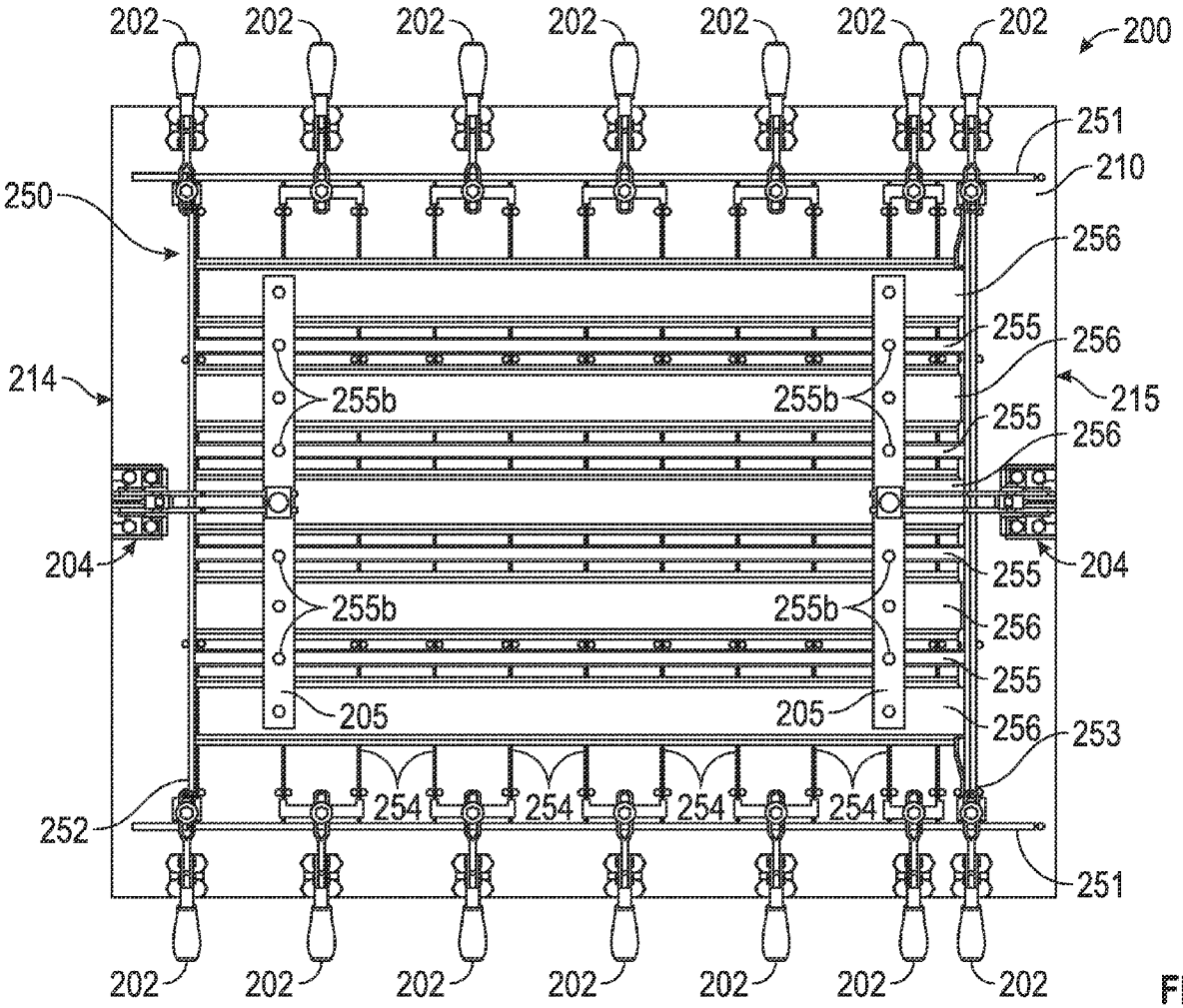

FIGS. 8O and 8P are perspective and plan views, respectively, of the jig assembly 200 after completion of the above-described first phase of controlled welding operations. As shown in FIGS. 8O and 8P, the hold-down bars 206 have been removed from the jig assembly 200, and the longitudinal support members 255 have been installed in the jig assembly 200 and on the frame support 250. In the exemplary embodiment depicted in FIGS. 8O and 8P, each longitudinal support member 255 is positioned in a substantially aligned group of narrow notches that are formed in the various lateral support members 252-254, i.e., in narrow notches 252*n* (of end support member 252), 254*n* (of cross members 254), and 253*n* (of end support member 253). See, e.g., FIGS. 7B-7D and FIGS. 8C-8F. Furthermore, each of the longitudinal support members 255 runs along the length direction of the support frame 250. Thereafter, the end clamp assemblies 204 (with the clamping bars 205 attached) may be attached to the respective end clamp assemblies 204, and the clamp assemblies 204 may once again be operated so as to firmly clamp and hold the longitudinal support members 255 in the narrow notches 252*w*-254*w* of the respective lateral support members 252-254. Additionally, the longitudinal support hold-down adjustment bolts 255*b* may be used to adjust the clamping/hold-down force on each of the longitudinal support members 255, as previously described.

Once the longitudinal support members 255 have been installed and clamped in place, a second phase of controlled welding operations may be performed from a single side of the support frame (i.e., the upwardly facing bottom side of the frame 250) to weld each of the longitudinal support members 255 to each of the end support members 252, 253 and the cross members 256. As noted above, the various welding parameters used during the second phase of controlled welding operations (e.g., heat input, welding sequence, welding processes, etc.) may be adjusted as necessary so as to control the amount of reverse pre-curvature that is induced in the support frame 250. Thereafter, the support frame 250 may be removed from the jig assembly 200 and further processed in a screen panel assembly unitization process, as will be further described with respect to FIGS. 11A-11C below.

It should be appreciated that other alternative assembly sequences may also be used for fabricating the support frame 250. For example, in one illustrative alternative assembly method, rather than installing the longitudinal support members 255 after the remaining components 251-254 and 256 of the support frame 250 have already been welded together during a first phase of controlled welding operations, all of the components 251-256 may be installed and assembled on the jig assembly 200 base plate 210 before any welding operations are performed. More specifically, as is shown in FIGS. 5C-5F, both the guide plates 256 and the longitudinal support members 255 may be installed in the respective wide notches 252*w*-254*w* and narrow notches 252*n*-254*n* of the support members 252-254 and simultaneously clamped in place using the end clamp assemblies 204, clamping bars 205, hold-down bars 206, and hold-down adjustment bolts 206*b*, 255*b*. Thereafter, controlled welding operations may commence based on an appropriately adapted welding sequence and welding parameters, as required to induce the necessary reverse support frame pre-curvature described above.

In other illustrative alternative assembly sequences, the end support members 252, 253 may be welded to the respective side support members 251 prior to installing any of the cross members 254. In still other exemplary alternative assembly sequences, the guide plates 256 may be welded to each of the support members 252-254 before either of the end support members 252, 253 or the cross members 254 are welded to each of the side support members 251. In yet another alternative assembly sequence, the end support members 252, 253 and the cross members 254 may be welded to each of the side support members 251 before the guide plates 256 and longitudinal support members 255 are welded to the support members 252-254. Other alternative assembly sequences may also be employed so long as the sequences utilized provide the requisite degree of reverse support frame pre-curvature, as described above.

Figure 9A:
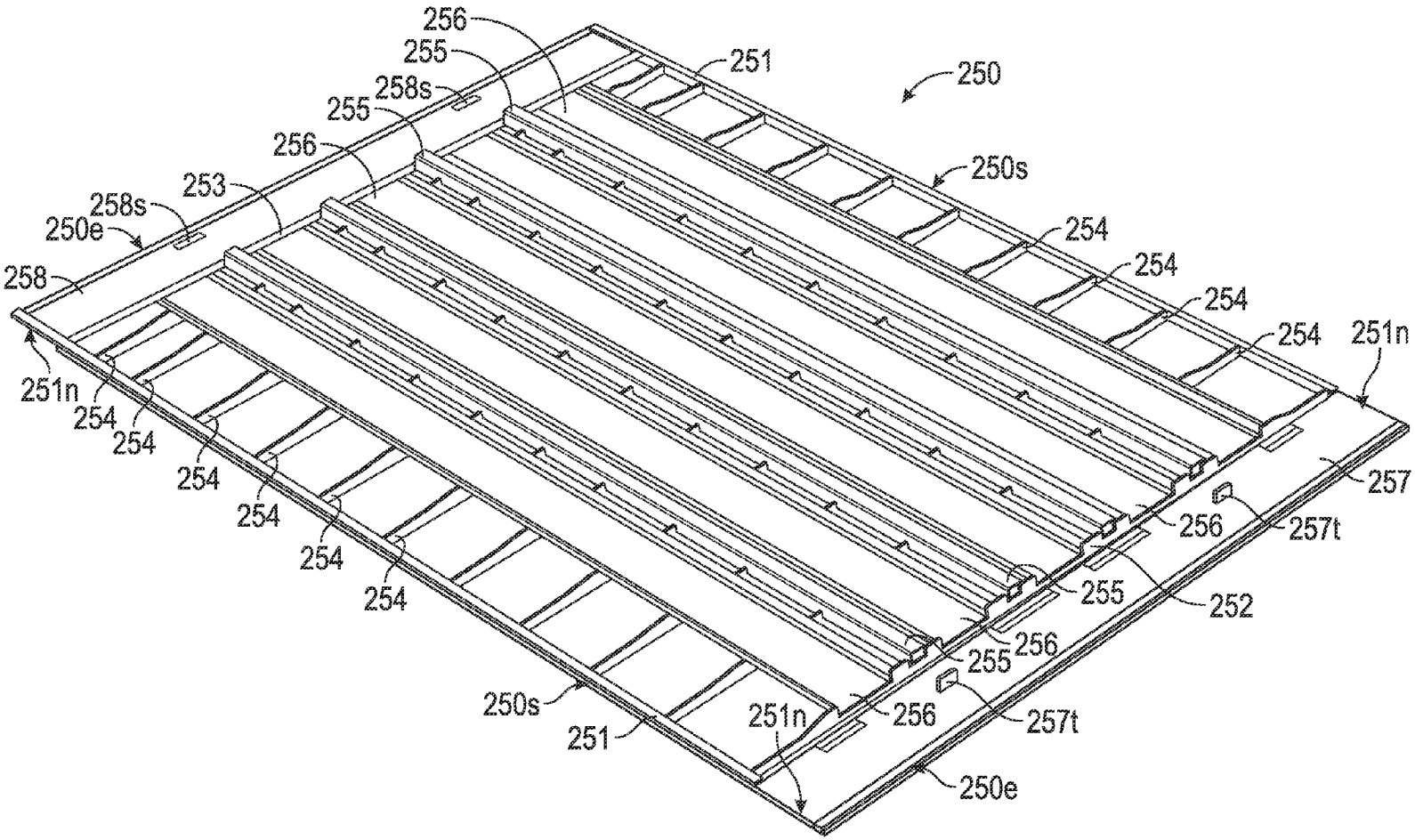
FIGS. 9A and 9B are perspective and plan views, respectively, of an illustrative support frame after completion of the assembly and fabrication sequence shown in FIGS. 8A-8P when viewing the support frame from the bottom side thereof.
Figure 9B:
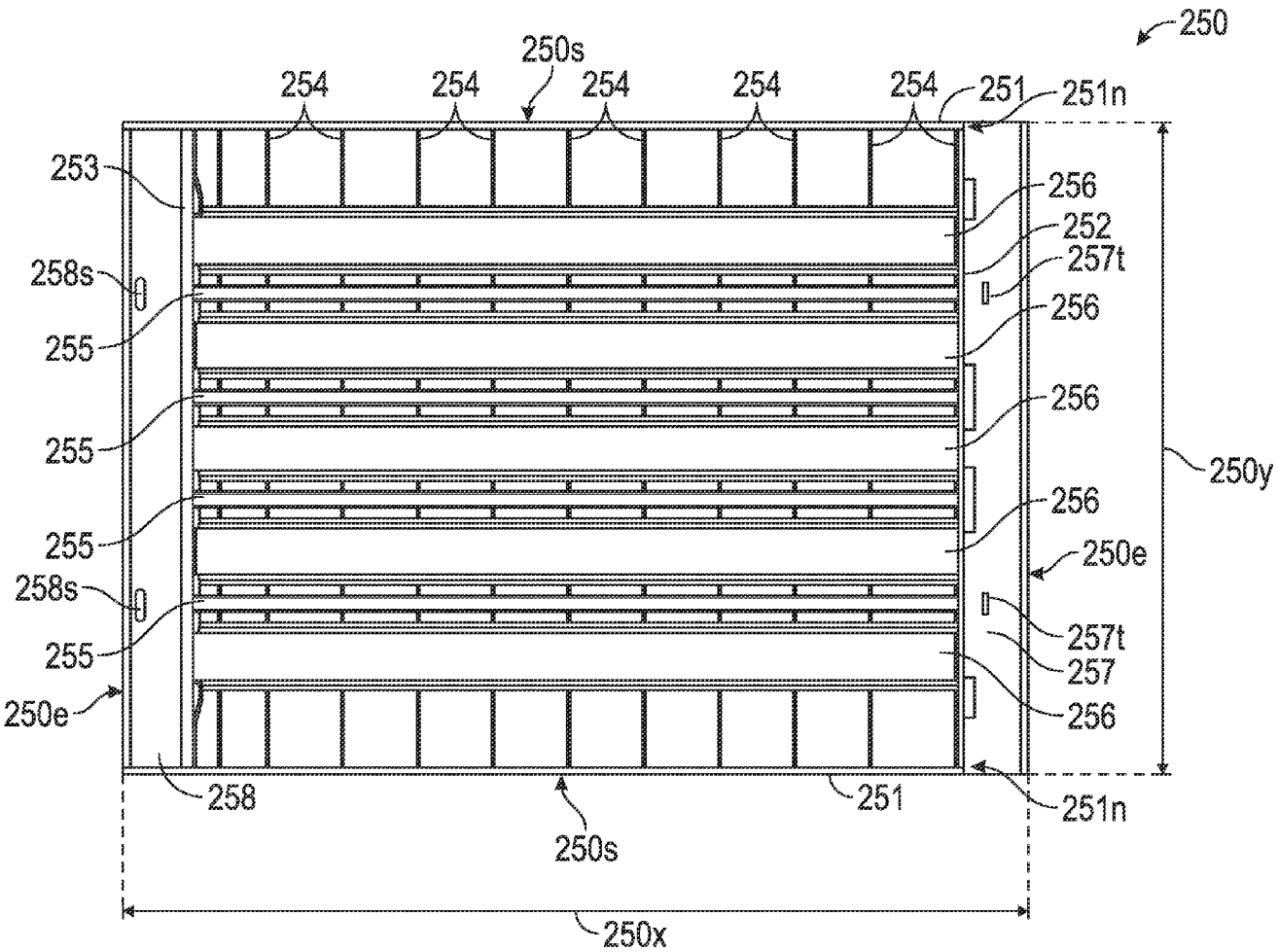
Figure 9C:
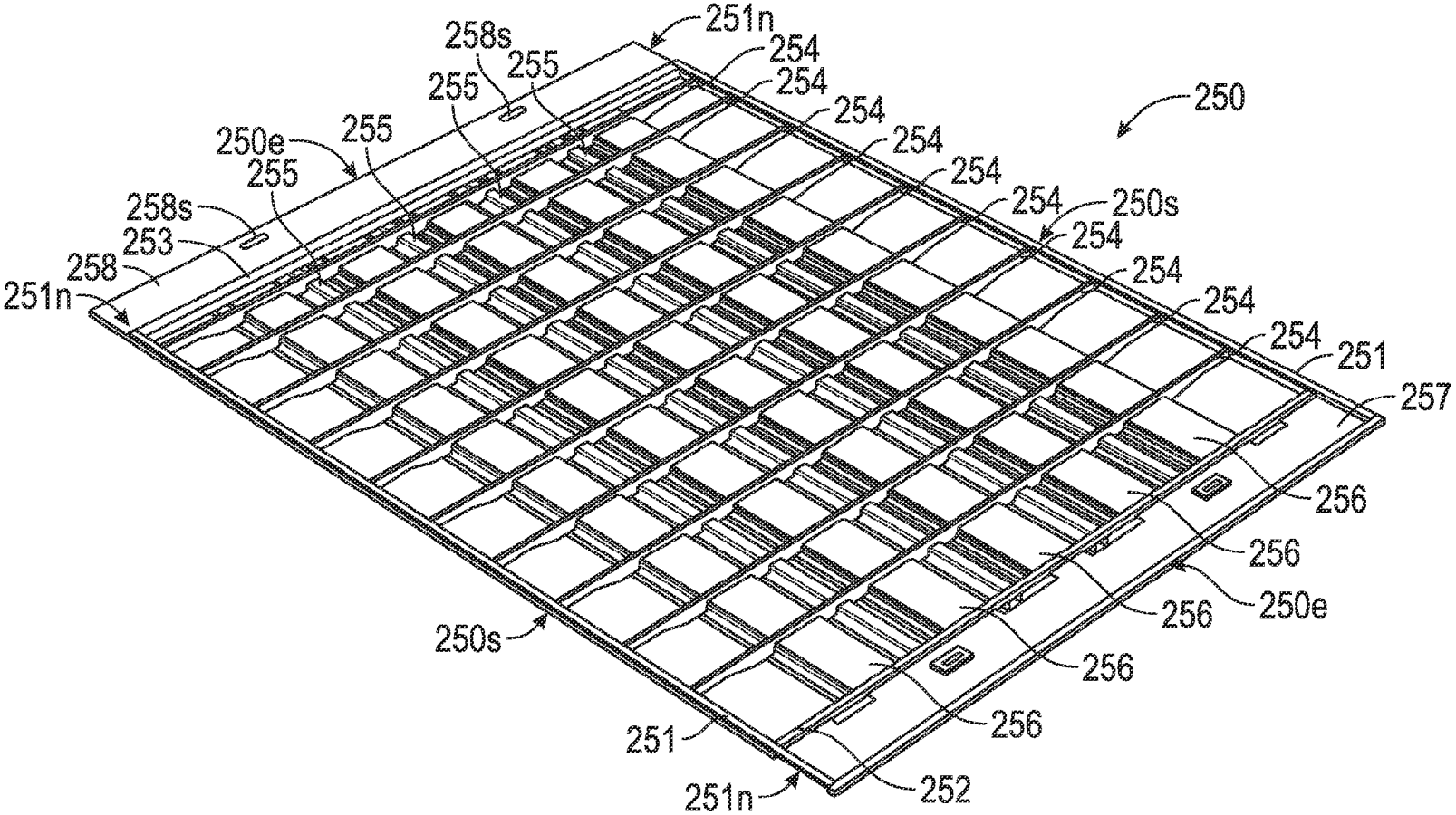
FIGS. 9C and 9D are perspective and plan views, respectively, of the completed support frame of FIGS. 9A and 9B when viewing the support frame from the top side thereof.
Figure 9D:
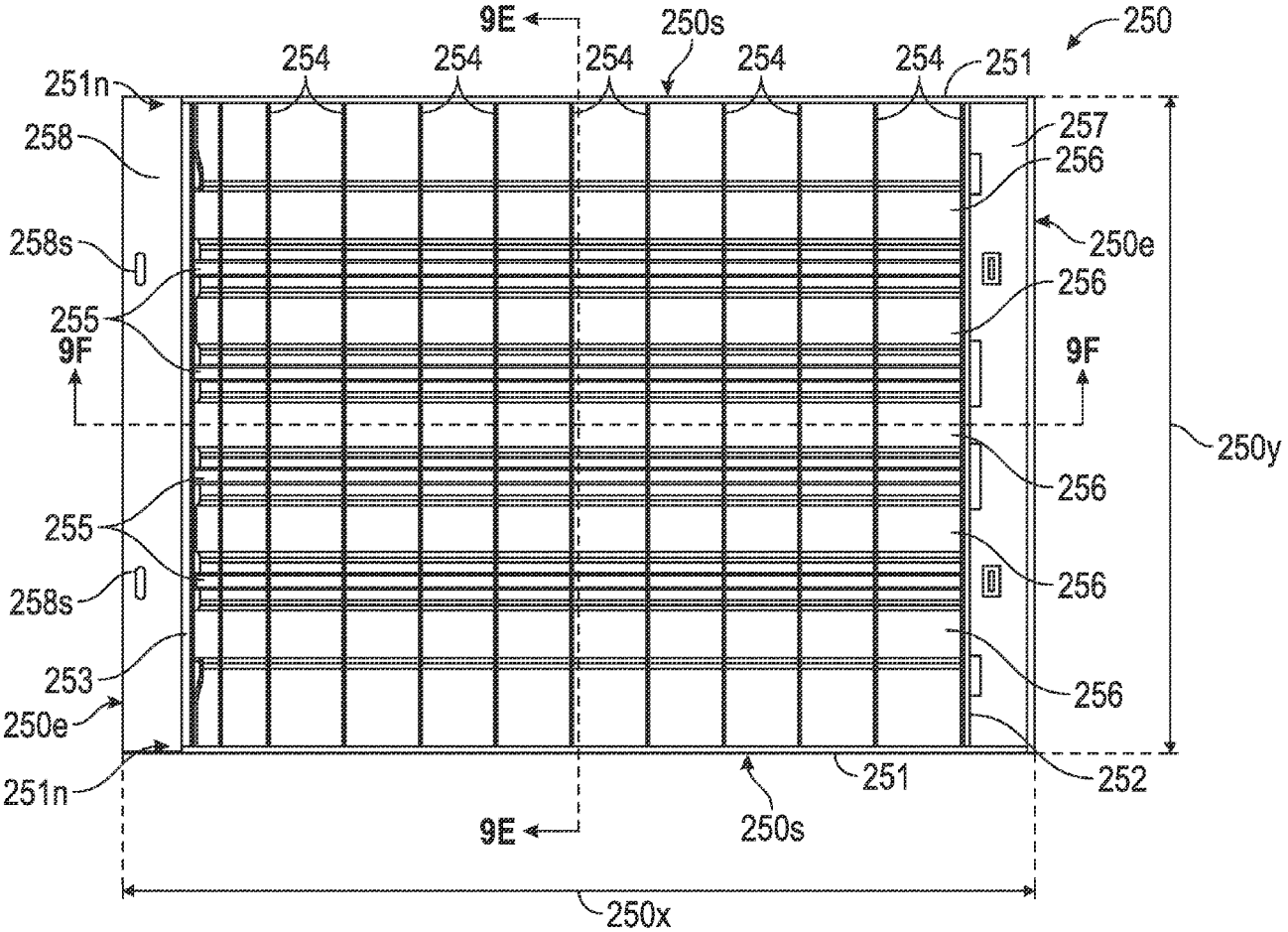

FIGS. 9A and 9B are perspective and plan views, respectively, of the illustrative support frame 250 after completion of the assembly and fabrication sequence shown in FIGS. 8A-8P when viewing the support frame 250 from the bottom side (i.e., the welded side) thereof, whereas FIGS. 9C and 9D are perspective and plan view, respectively, of the support frame 250 when viewed from the top side thereof. As shown in the illustrative embodiment depicted in FIGS. 9A-9D, the support frame 250 has been completed in preparation for a screen panel unitization process (described below) by attaching, e.g., by welding, the connecting end plates 257 and 258 to the support frame 250. For example, in some embodiments, the connecting end plate 257 may be attached to the side support members 251 at the notched ends 251*n* that are adjacent to the first end support member 252, and the connecting end plate 258 may be attached to the side support members 251 at the notched ends 251*n* that are adjacent to the second end support member 253. Furthermore, as shown in FIGS. 9A-9D, the connecting end plate 257 may include a plurality of tabs 257*t* extending in a downward direction relative to the operating orientation of the support frame 250, and the connecting end plate 258 may include a plurality of corresponding slots 258*s*.

In certain exemplary configurations, such as when a plurality of similarly configured screen panel assemblies (such as the screen panel assembly 271 shown in FIGS. 12A-12D) are installed end-to-end in a vibratory separator (e.g., a shale shaker), the slots 258*s* in the connecting end plate 258 are sized and adapted to receive a corresponding tab on a connecting end plate of an adjacently positioned screen panel assembly (such as the tabs 257*t* on the connecting end plate 257 of a screen panel assembly 271). The tabs 257*t*, when positioned in a corresponding slot 258*s*, may therefore hold adjacent screen panel assemblies 271 in place as the notched ends 251*n* of the side support members 251 of one screen panel assembly 271 "nest" with the corresponding notched ends 251 of the adjacent screen panel assembly 271.

Figure 9E:
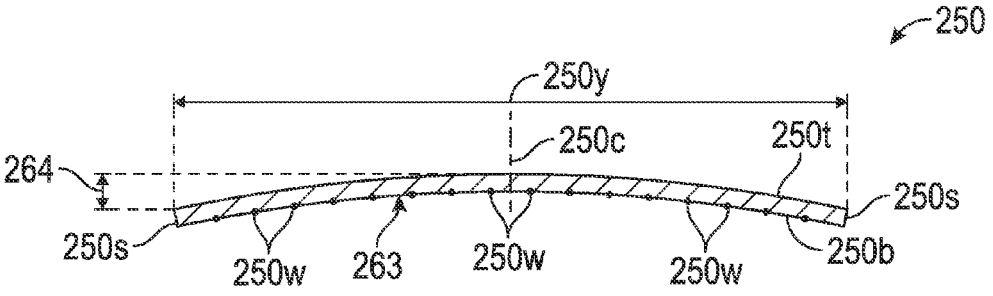
FIGS. 9E and 9F are schematic cross-sectional views of the completed support frame of FIGS. 9A-9D when viewed along the section lines "9E-9E" and "9F-9F" of FIG. 9D, respectively, prior to performing a screen panel unitization process.
Figure 9F:
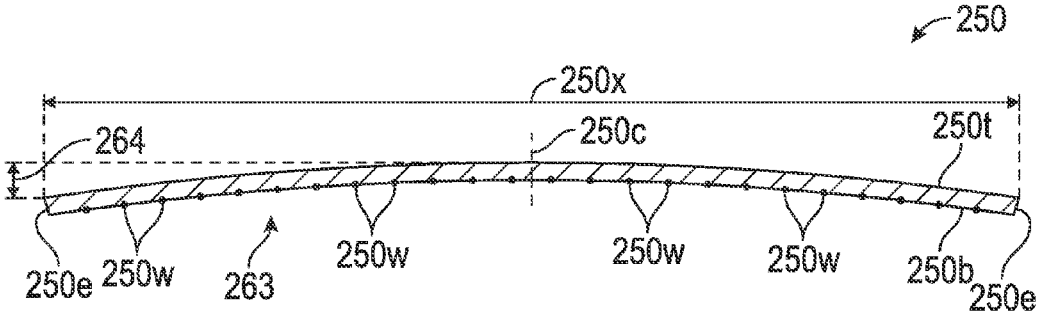

FIGS. 9E and 9F are simplified schematic cross-sectional views of the completed support frame 250 shown in FIGS. 9A-9D when viewed along the section lines "9E-9E" and "9F-9F" of FIG. 9D, respectively, prior to performing a screen panel unitization process (see, FIGS. 11A-11C, described below). As shown in FIGS. 9E and 9F, after completing the fabrication of the support frame 250 in the jig assembly 200 (see, FIGS. 8A-8P) using the controlled assembly and welding operations described above, the support frame 250 has a bowed, or "pre-curved," (i.e., non-planar) shape 263. Furthermore, the pre-curved or non-planar support frame 250 may be curved along both axes, that is, along both the length 250*x* and the width 250*y* of the frame 250. More specifically, the ends 250*e* of the support frame 250 may curve downward,—i.e., away from the top side 250*t* and toward the bottom side 250*b* of the frame 250—over the entire length 250*x* of the frame 250 by a post-fabrication curvature distance 264 relative to the center 250*c* of the frame 250. In some embodiments, the sides 250*s* may also curve downward over the entire width 250*y* of the frame 250 by substantially the same amount of post-fabrication curvature 264 relative to the center 250*c*.

As noted previously, the pre-curved non-planar shape 263 of the support frame 250 is accomplished by assembling and fabricating the support frame 250 in the jig assembly 200 (see, FIGS. 8A-8P). Furthermore, the general downward curvature of the ends 250*e* and sides 250*s*,—that is, a curvature toward the bottom side 250*b*—is created by welding the frame 250 from only the bottom side 250*b*, such that substantially most, if not all, of the welds 250*w* (shown schematically in FIGS. 9E and 9F) are made on the bottom side 250*b* of the frame 250. Depending on the specific geometric parameters of the completed support frame 250 (e.g., length 250*x*, width 250*y*, frame stiffness, etc.) as well as the specific welding parameters used during frame fabrication (e.g., heat input, welding sequence, welding processes, etc.), the post-fabrication curvature distance 264, i.e., the magnitude of the support frame 250 pre-curvature, may be in the range of about 1/16" to 3/8", whereas in some specific applications the amount of post-fabrication pre-curvature 264 may be in the range of approximately 1/8" to 3/16". Accordingly, a counterbalance, or offset, may be provided to the bowing that occurs during a subsequent screen panel assembly unitization process.

Figure 10A:
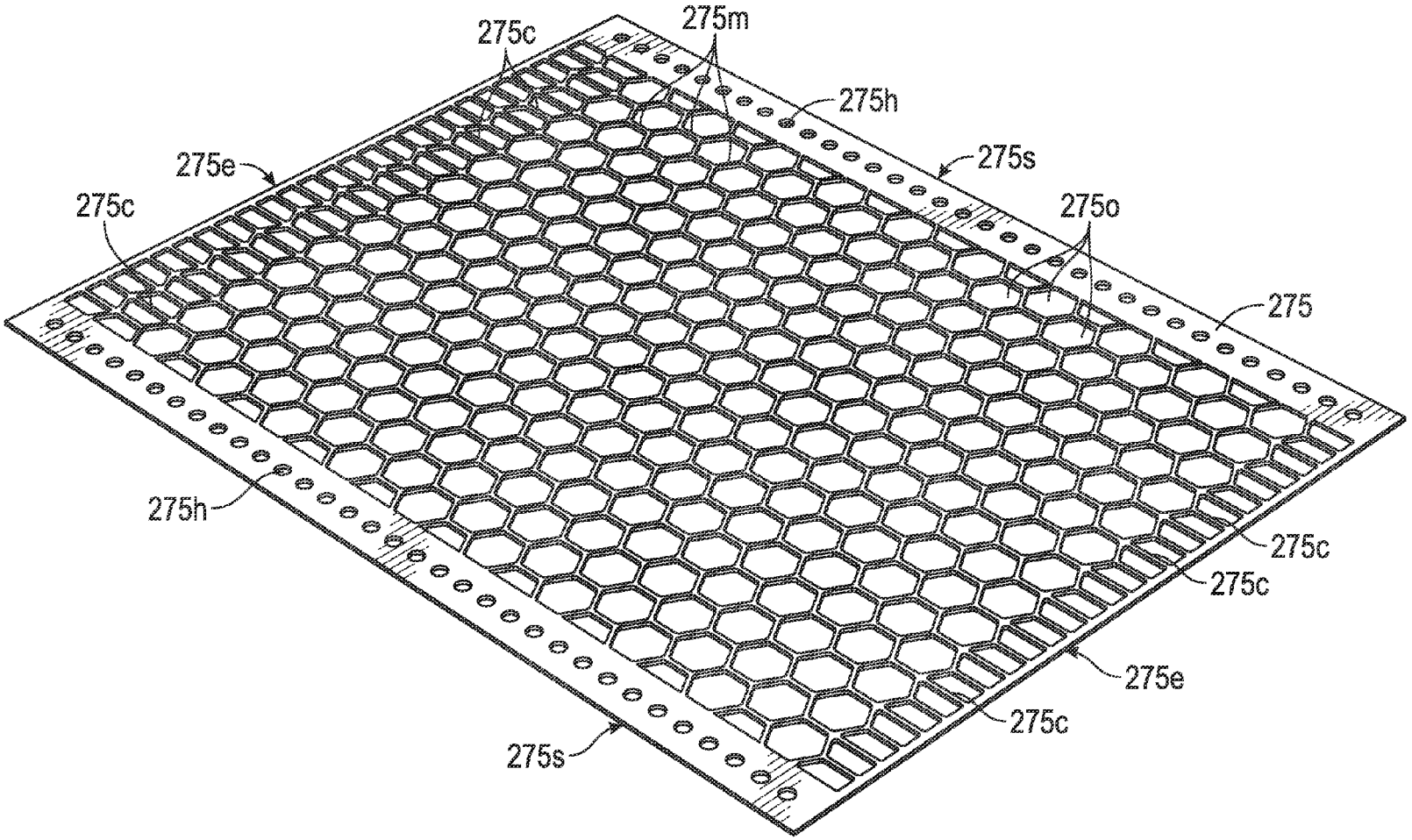
FIGS. 10A and 10B are perspective and plan views, respectively, of an exemplary perforated plate that may be unitized with the completed support frame shown in FIGS. 9A-9F.
Figure 10B:
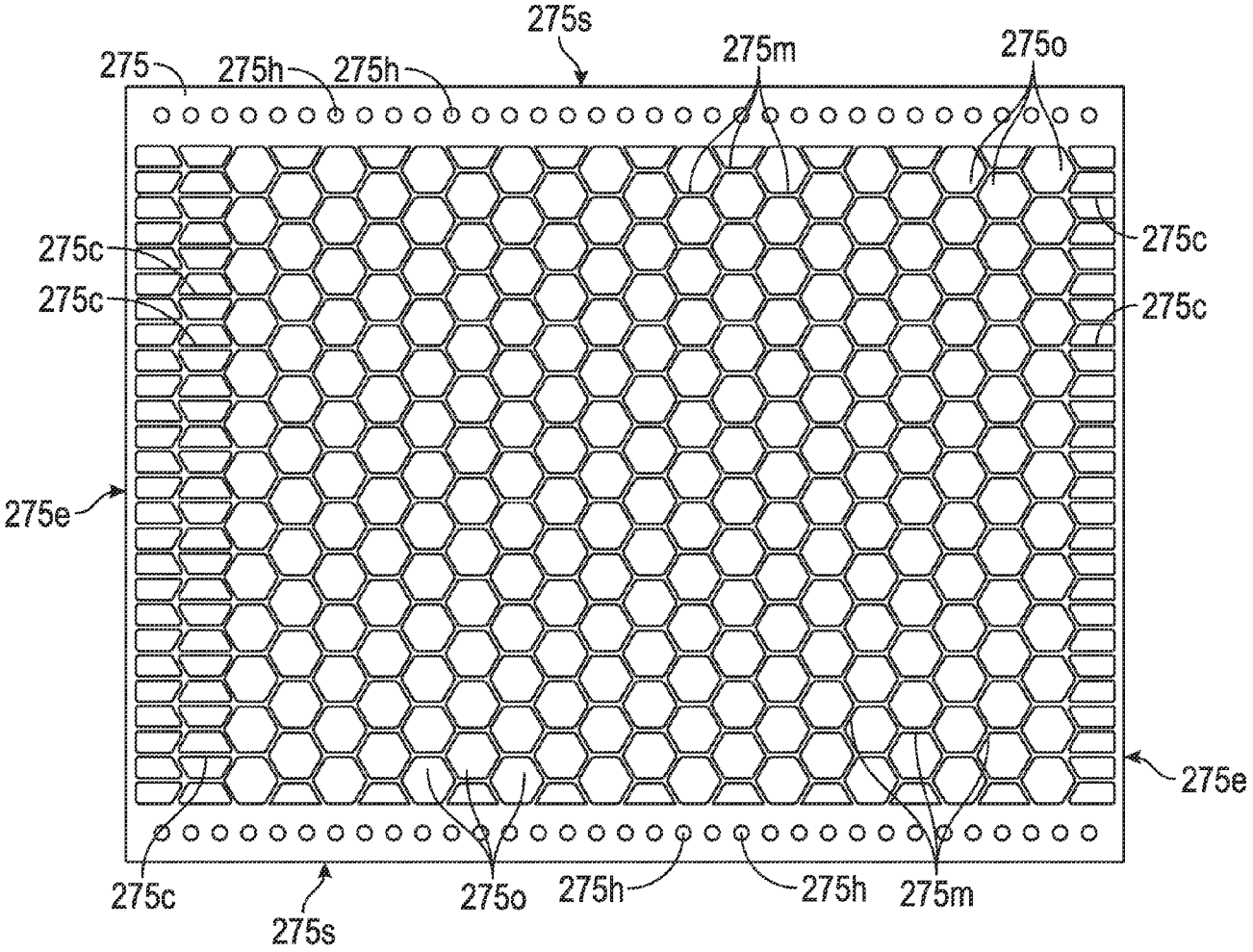

FIGS. 10A and 10B are perspective and plan views, respectively, of an exemplary perforated plate 275 that may be unitized with the completed support frame 250 shown in FIGS. 9A-9F. In some embodiments, the perforated plate 275 may include a plurality of interconnected support members 275*m* that define a plurality of flow openings 275*o* wherein drilling fluid may flow through perforated plate 275, and consequently through a screen panel assembly 271 (see, FIGS. 12A-12D) during a vibratory separation operation. In the illustrative embodiment shown in FIGS. 10A and 10B, the interconnected support members 275*m* are arranged such that the openings 275*o* have a substantially hexagonal shape, although it should be understood that support members 275*m* may be arranged so as to define in other opening shapes, such as square, rectangular, triangular, and the like.

The perforated plate 275 may also include additional cross member supports 275*c* that span substantially across the major dimension of the openings 275*o* so as to provide additional support for screening material (not shown in FIGS. 10 and 10B; see FIGS. 11A-11C) in areas where drilling fluid loading may be the highest. For example, as shown in FIGS. 10 and 10B, the cross member supports 257*c* may be located in the openings 275*o* that are positioned closest to each opposing end 275*e* of the perforated plate 275, i.e., in the areas where drilling fluid may initially be introduced to a screen panel assembly, such as the screen panel assembly 271 of FIGS. 12A-12D. The perforated plate 275 may also include a plurality of holes 275*h* arranged along each side 275*s* of the panel 275, which may act as openings which allow epoxy material to "migrate" or "flow" through the various components of the screen panel assembly 271 during a panel unitization process, as will be further described in conjunction with FIGS. 11A-11C below. In at least some embodiments, the perforated plate 275 may be fabricated by punching the various openings 275*o* and holes 275*h* in a metal sheet, wherein the metal sheet may have a thickness that ranges from 18 gauge to 10 gauge material (e.g., approximately 0.048" to 0.135"), although other gauge thicknesses may also be used.

Figure 11A:
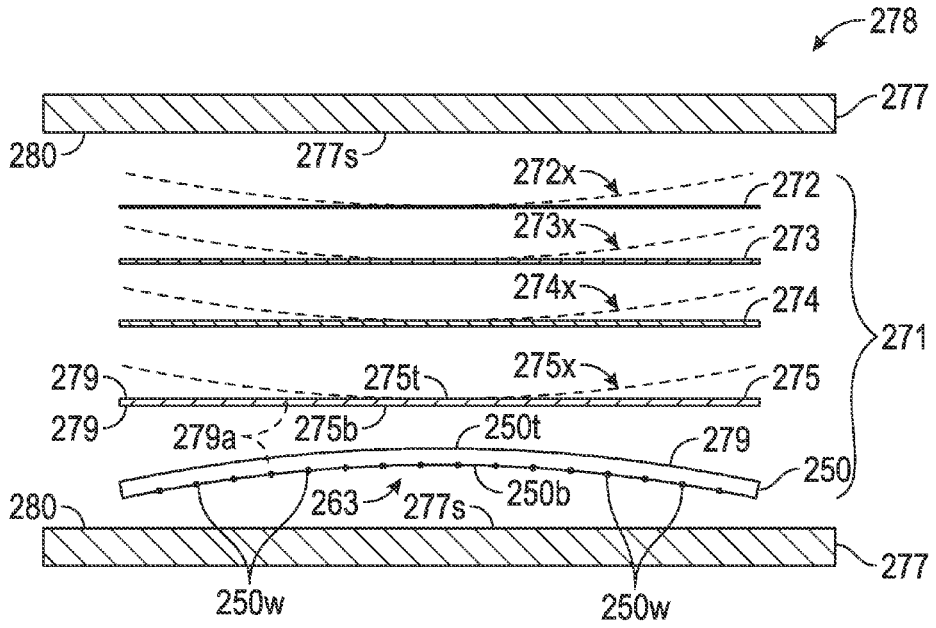
FIGS. 11A-11C schematically depict various steps of an illustrative process that may be used to unitize an exemplary screen panel assembly that includes the illustrative support frame of FIGS. 9A-9F, the illustrative perforated plate of FIGS. 10A and 10B, and a plurality of screening material layers.
Figure 11B:
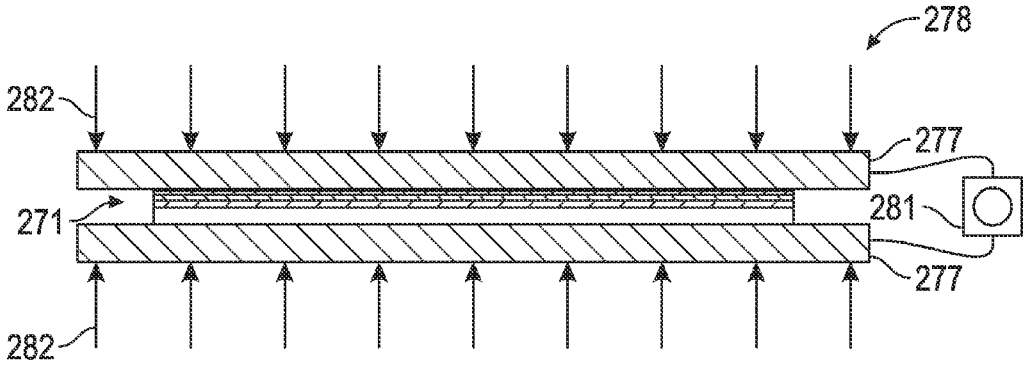
Figure 11C:
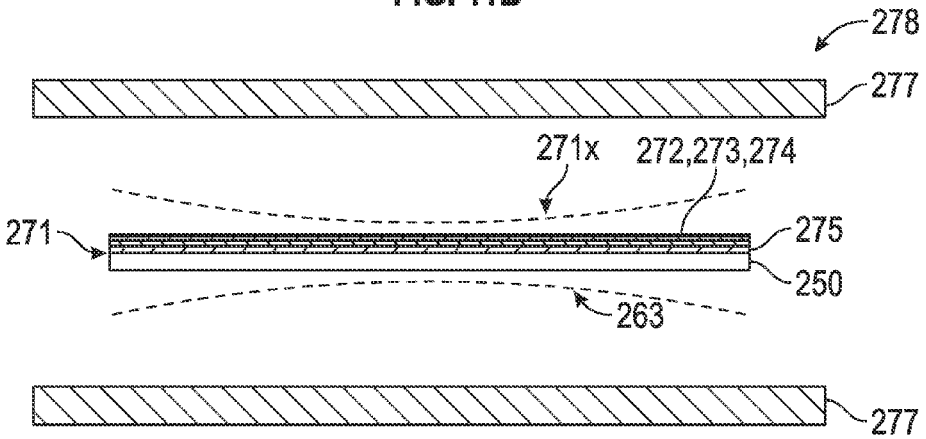

FIGS. 11A-11C schematically and simplistically depict various steps of an illustrative process that may be used to unitize an exemplary screen panel assembly 271 that includes the illustrative support frame 250 of FIGS. 9A-9F, the illustrative perforated plate 275 of FIGS. 10A and 10B, and a plurality of screening material layers 272, 273, and 274.

FIG. 11A is a schematic side view of an early step in the unitization process that is used to fabricate the finished screen panel assembly 271 shown in FIGS. 12A-12F. As shown in FIG. 11A, the support frame 250, the perforated plate 2755, and the layers of screening material 272, 273, 274 are initially positioned between press plates 277 of a pressing apparatus 278. In order to securely attach each of the components 250 and 272-275 together so as to form the unitized screen panel assembly 271, at least the top and bottom surfaces 275*t* and 275*b* of the perforated plate 275 and the top surface 250*t* of the support frame 250 are coated with an epoxy material 279. In some cases, the entirety of the perforated plate 275 and the entirety of the support frame 250 may be coated with epoxy 279, as indicated in FIG. 11A by dashed lines 279*a*. Furthermore, a sheet material 280, such as PTFE and the like, may be positioned on the contact surface 277*s* of each of each press plate 277 so as to prevent the upper layer of screening material 272 and the bottom surfaces 250*b* of the support frame 250 from adhering to the press plates 277 during the screen panel unitization process.

As shown in FIG. 11A, the support frame 250 has a post-fabrication pre-curved non-planar shape 263 that bows or curves downward by a distance 264 (see, FIGS. 9E and 9F) due to the assembling and fabricating the frame 250 in the jig assembly using the methodology described above. For comparative purposes, FIG. 11A also shows hypothetical upwardly curved shapes 272*x*-275*x* (indicated in FIG. 11A by dashed lines) that each of the screening material layers 272-274 and the perforated plate 275 may normally try to assume after being subjected to a typical screen panel assembly unitization process, such as is indicated by the upwardly curved shape 123 of the prior art low-profile screen panel assembly 111*x* shown in FIG. 4C.

FIG. 11B schematically illustrates a subsequent step in the disclosed unitization process, wherein a heating apparatus 281 is operatively coupled to one or both of the press plates 277 so as to raise the temperature of the pressing apparatus 278 to an appropriate epoxy curing temperature, such as approximately 400° F., so as to thermally cure the epoxy material 279 and bind together the stack of screen panel assembly components 272-275 and 250 during the panel unitization process. Once the pressing apparatus has been properly preheated to the requisite epoxy curing temperature, a pressing load 282, which may be in the range of approximately 1000-2000 pounds, is imposed on the press plates 277 so as to keep the stack of screen panel assembly components 272-275 and 250 pressed firmly together and in a substantially flat configuration for the duration of the panel unitization process. The pressing load 282 is then maintained for a sufficient length of time, such as approximately 10-20 minutes, so as to ensure the epoxy material 279 is properly cured.

FIG. 11C schematically depicts the pressing apparatus 278 after completion of the above-described pressing and curing operations, i.e., after the epoxy 279 has been fully cured. As shown in FIG. 11C, the pressing load 282 and heat from the heating apparatus 281 have been discontinued, the press plates 277 have been moved back, and a completed screen panel assembly 271 has been unitized. Typically, while only the bottom layer of screening material 274 is in direct contact with the epoxy material 279 on the top surface 275*t* of the perforated plate 275 during the initial phase of the pressing and curing operation, the epoxy 279 will tend to "migrate" or "flow" through the openings between the wires of each layer of screening material 274, 273, 272 throughout the curing operation. Similarly, the epoxy material 279 on the top surface 250*t* of the screen support 250 may also "migrate" or "flow" through the various openings 275*o* and holes 275*h* in the perforated plate 275 to the screening material stack 272-274. In this way, each layer of screening material 274, 273, and 272 is bonded/attached to an adjacent component by the "migrating" epoxy material 279, thus unitizing the stack of screen panel assembly components 272-275 and 250 into the screen panel assembly 271.

In certain illustrative embodiments, the amount 264 of post-fabrication pre-curvature (see, FIGS. 9E and 9F) that was initially induced in the support frame 250 during the frame assembly and fabrication process (see, FIGS. 8A-8P) may be reduced, or even completely eliminated, during the screen panel assembly unitization process described above. For example, as with the prior art screen panel assembly 111*x*, the epoxy 279 that is used to bond/attach the various screen panel assembly components 272-275 and 250 together will typically shrink during the epoxy heat curing operation. Also as with the prior art screen panel assembly 111*x*, this epoxy shrinkage may thus cause the screen panel assembly 271 to bow or curve upward, that is, in the opposite direction of the initial post-fabrication pre-curved shape 263. In other words, during the panel unitization process, the screen panel assembly 271 will curve toward the side of the support frame 250 on which the layers of screening material 272-274 and the perforated plate 275 have been bonded by the epoxy material 279, or toward the top surface 250*t* of the frame 250.

Therefore, after performing the panel unitization process, the finished screen panel assembly 271 (i.e., including the support frame 250) may have a post-unitization shape that is at least less curved than that of the post-fabrication pre-curved shape 263 (indicated by a dashed line in FIG. 11C) of the support frame 250. As such, the screen panel assembly 271, including the support frame 250, may have an amount of post-unitization curvature that is less than the original amount 264 of post-fabrication curvature (see, FIGS. 9E and 9F). Furthermore, the screen panel assembly 271 may also be substantially less curved than a hypothetical upwardly curved shape 271*x* (also indicated by a dashed line in FIG. 11C) that substantially corresponds to the upwardly curved shape 123 of the prior art screen panel assembly 111*x*. Therefore, due to this reduced amount of screen panel curvature, minimal mechanical straightening may be required to bring the finished screen panel assembly 271 into compliance with the desired flatness and straightness tolerances. Furthermore, in at least some embodiments, the completed screen panel assembly 271 may be substantially straight and flat after the panel unitization process, as is schematically illustrated in FIG. 11C. It should be appreciated, however, that the final degree of panel straightness and flatness may depend on several factors, including the overall size (i.e., length 250$x$ and width 250$y$) of the support frame 250, the overall stiffness of the support frame 250, the amount 264 of pre-curvature that is induced in the support frame 250, and the like.

Figure 12A:
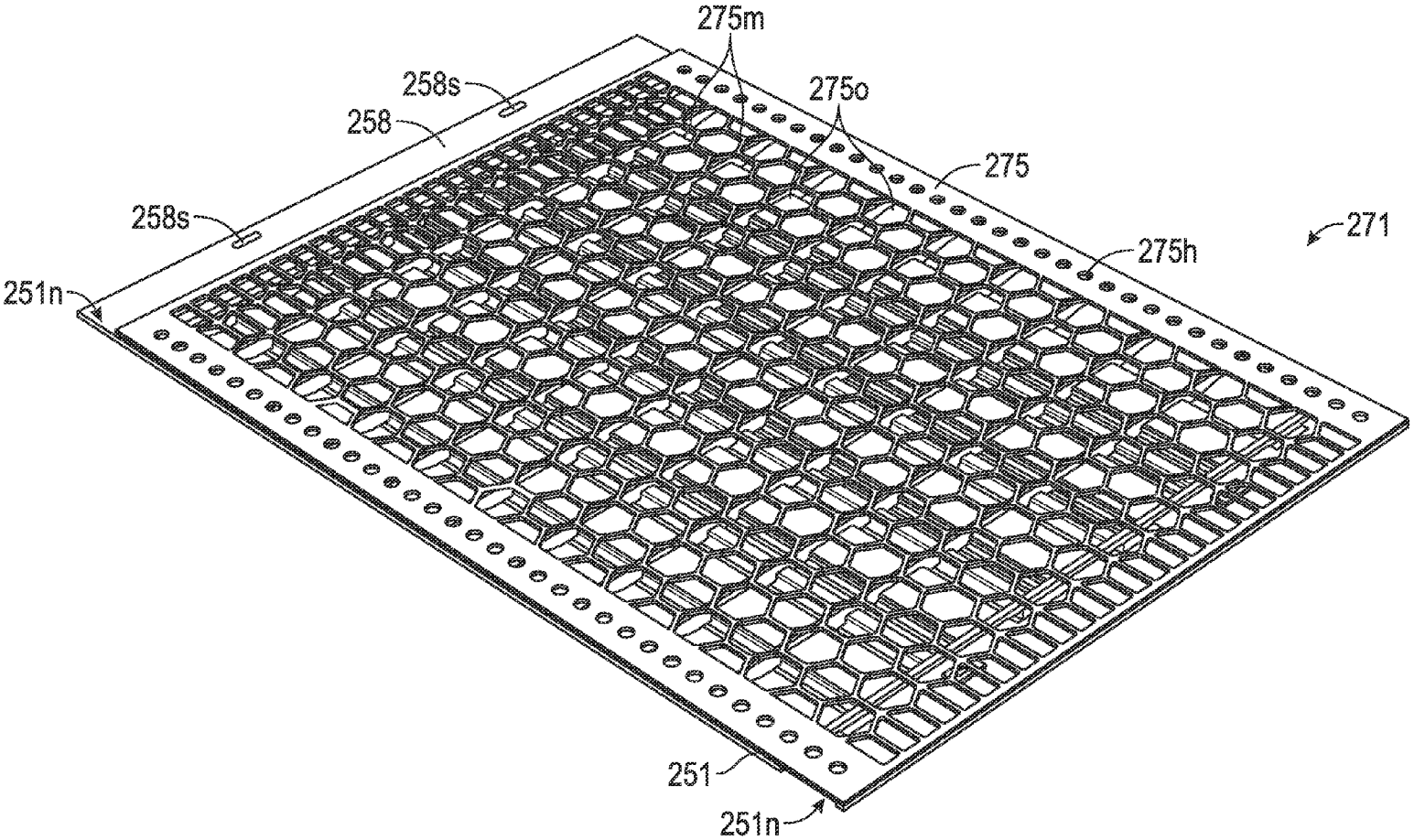
FIGS. 12A and 12B are perspective and plan views, respectively, of an illustrative screen panel assembly after completion of the unitization process shown in FIGS. 11A-11C when viewing the screen panel from the top side thereof, wherein the layers of screening material have been removed for clarity.
Figure 12B:
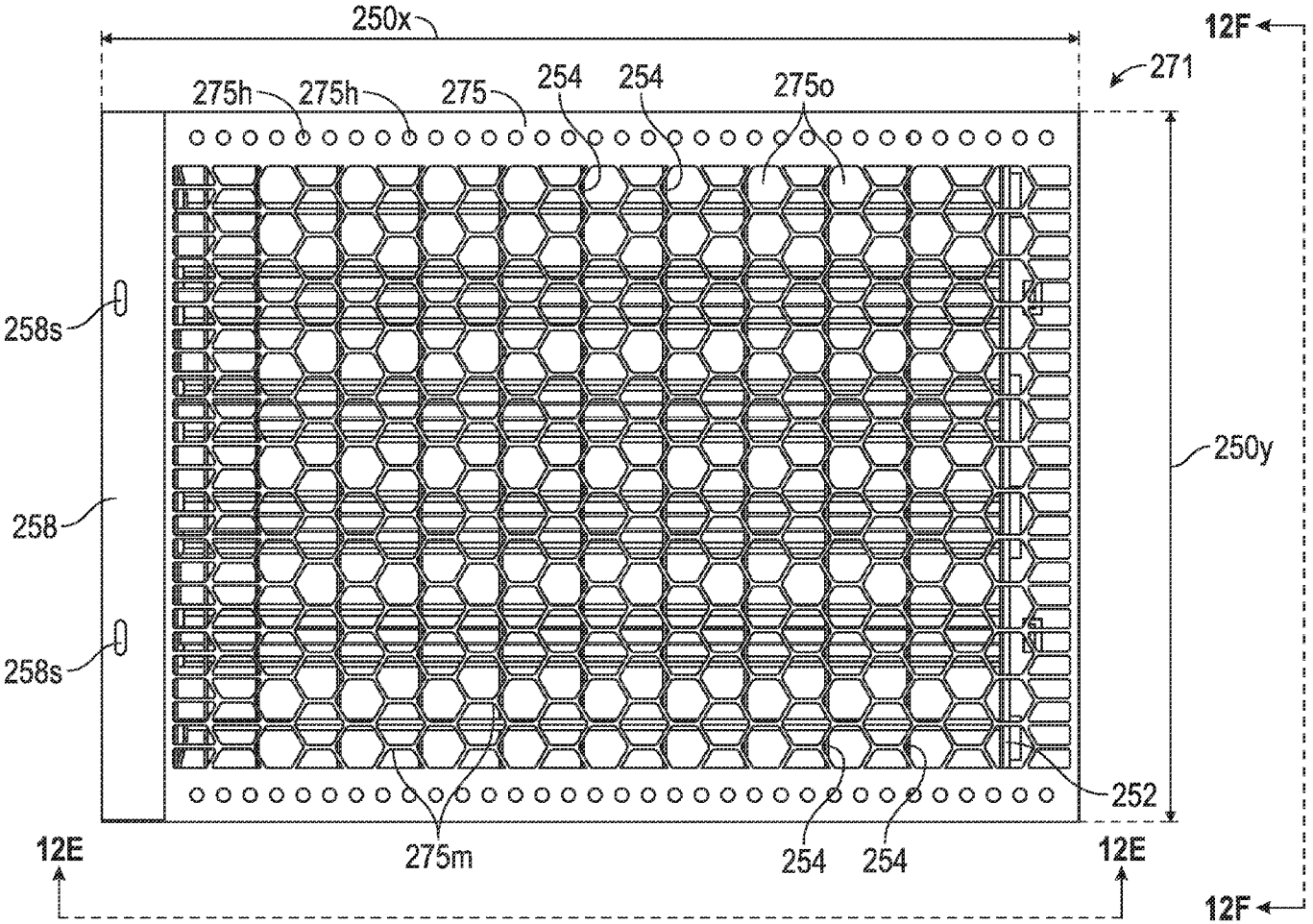
Figure 12C:
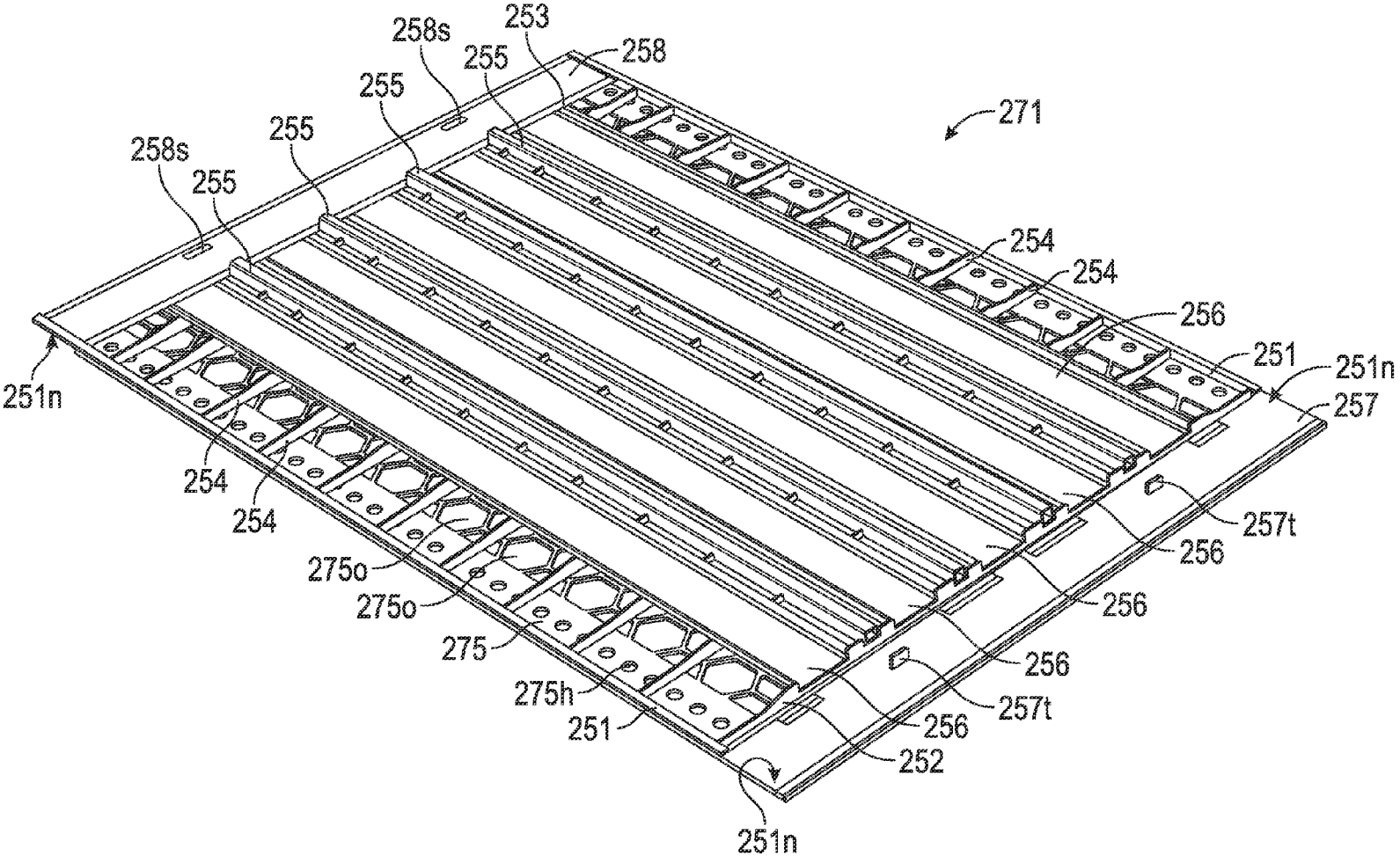
FIGS. 12C and 12D are perspective and plan views, respectively, of the illustrative screen panel assembly of FIGS. 12A and 12B when viewing the screen panel from the bottom side thereof.
Figure 12D:
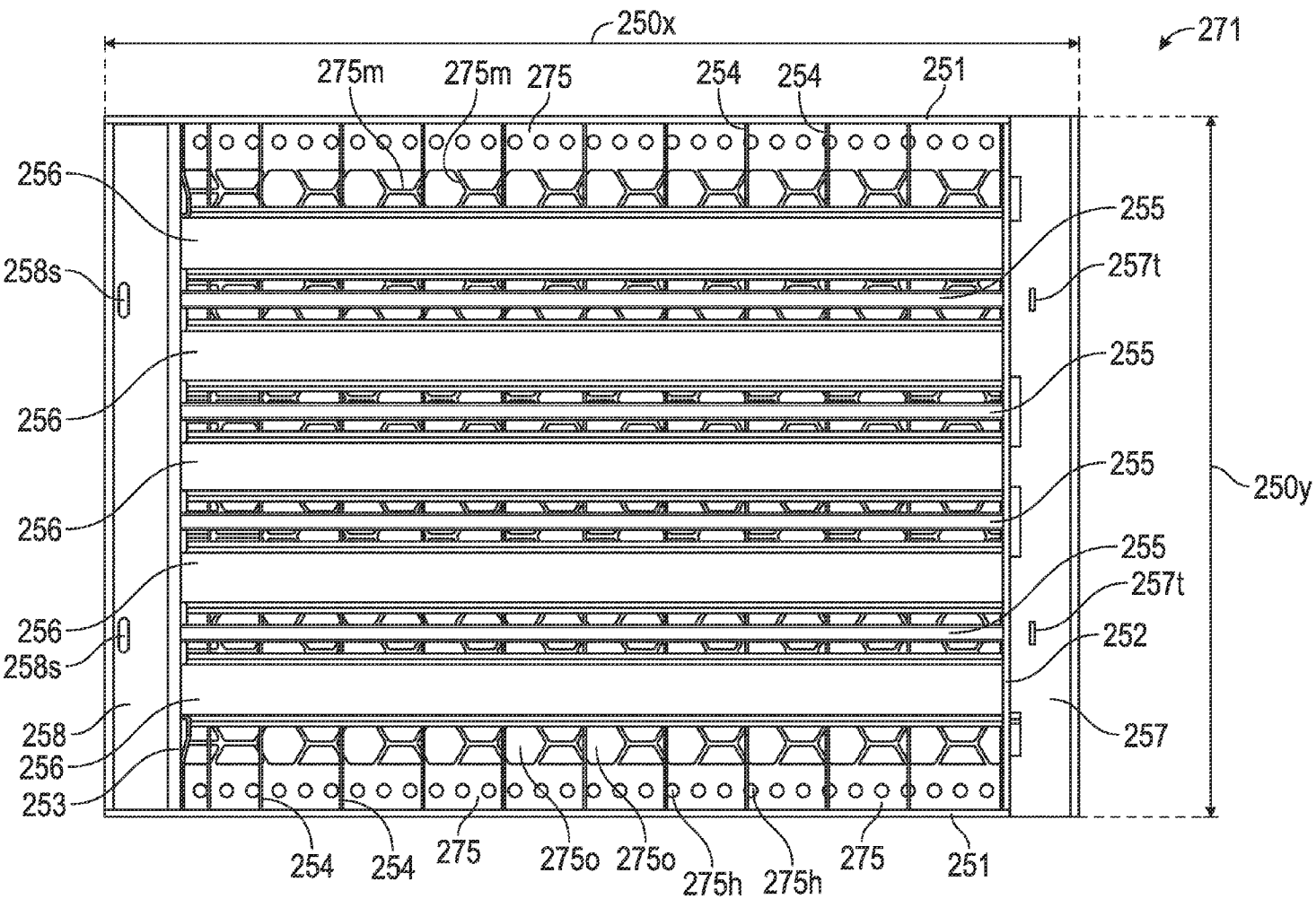
Figure 12E:
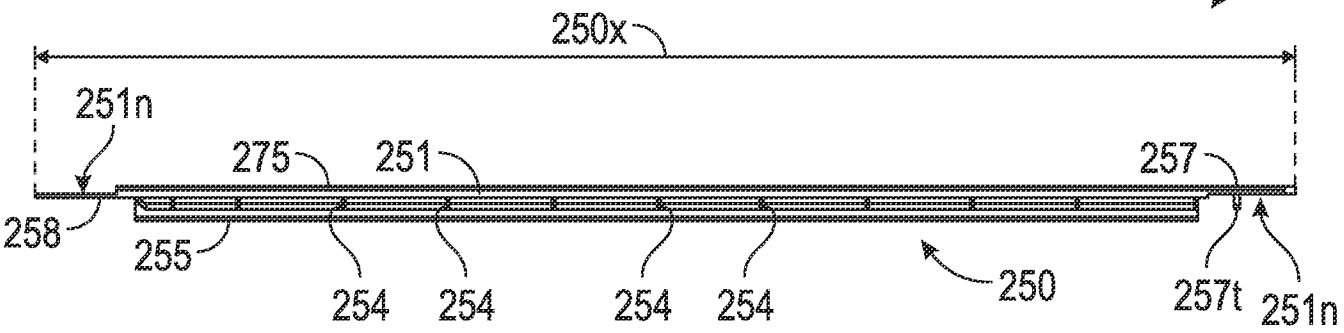
FIGS. 12E and 12F are side and end views, respectively, of the illustrative screen panel assembly along the view lines "12E-12E" and "12F-12F" of FIG. 12B, respectively.
Figure 12F:
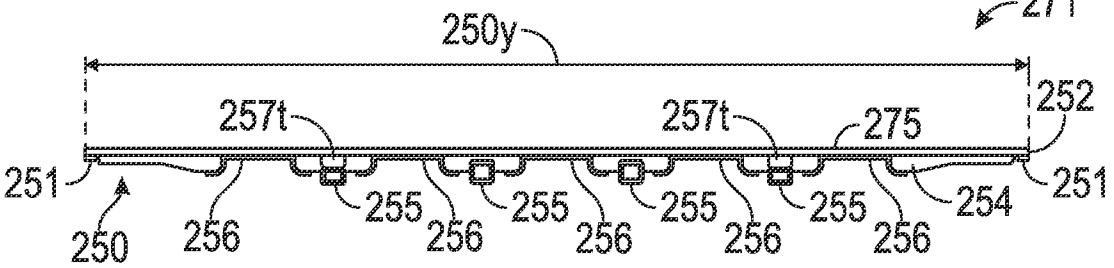

FIGS. 12A-12F are various views of an illustrative screen panel assembly 271 after completion of the above-described screen panel assembly unitization process illustrated in FIGS. 11A-11C, wherein the various layers of screening material 272-274 have been removed from each of the figures for clarity. In particular, FIGS. 12A and 12B are perspective and plan views, respectively, of the screen panel assembly 271 when viewed from above and FIGS. 12C and 12D are perspective and plan views, respectively, of the screen panel assembly 271 when viewed from below. Additionally, FIG. 12E is a side view of the screen panel assembly 271 along the view line "12E-12E" of FIG. 12B, and FIG. 12F is an end view of the screen panel assembly 271 along the view line "12F-12F" of FIG. 12B.

As a result, the subject matter of the present disclosure provides details of various aspects of the systems and methods that may be used to fabricate screen panel assemblies for vibratory separators, such as shale shakers and the like, and in particular, to fabricate screen panel assemblies within specified straightness and flatness tolerances substantially without having to perform mechanical straightening operations after the screen panel unitization process has been completed. In certain embodiments, a support frame for the screen panel assembly may be fabricated with an initial degree of panel pre-curvature by assembling and arranging the various components of the support frame in a jig assembly and fabricating the frame in the jig assembly using controlled welding operations.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method, comprising:

fabricating a screen panel support frame having a curved non-planar shape, said curved non-planar shape having a first post-fabrication amount of curvature; and after fabricating said screen panel support frame, performing a screen panel unitization process to unitize said screen panel support frame having said first post-fabrication amount of curvature with at least a plurality of layers of screening material, said screen panel unitization process inducing bowing in said screen panel support frame, wherein said screen panel unitization process is arranged so that, after completing said screen panel unitization process, said bowing induced in said screen panel support frame reduces a net amount of curvature in said screen panel support frame from said first post-fabrication amount of curvature to a second post-unitization amount of curvature that is less than said first post-fabrication amount.

2. The method of claim 1, wherein fabricating said screen panel support frame having said curved non-planar shape comprises:

positioning a plurality of support members of said screen panel support frame in a jig assembly, wherein during said positioning, said support members of said screen panel support frame are arranged face down on a base plate of said jig assembly;

clamping said face down support members to said base plate; and performing a welding operation to weld together said screen panel support frame while said face down support members are clamped to said base plate, said welding operation inducing said first post-fabrication amount of curvature in said screen panel support frame.

3. The method of claim 2, wherein performing said screen panel unitization process comprises positioning a perforated plate between said screen panel support frame and said plurality of layers of screening material and unitizing said perforated plate with said screen panel support frame and said plurality of layers of screening material.

4. The method of claim 3, wherein performing said screen panel unitization process comprises applying an epoxy material to at least top and bottom surfaces of said perforated plate and at least a top surface of said screen panel support frame.

5. The method of claim 4, wherein performing said screen panel unitization process comprises performing a pressing operation to press together said plurality of layers of screening material, said perforated plate, and said screen panel support frame and performing a heat curing operation to cure said epoxy material while performing said pressing operation.

6. The method of claim 2, wherein positioning said plurality of support members in said jig assembly comprises positioning at least a plurality of side support members, a plurality of end support members, and a plurality of cross members in said jig assembly.

7. The method of claim 6, wherein clamping said face down support members to said base plate comprises clamping at least said side support members and said end support members to said base plate with a plurality of side clamp assemblies that are positioned along opposite sides of said base plate and adjacent to said side support members.

8. The method of claim 6, wherein clamping said face down support members to said base plate comprises clamping at least said cross members to said base plate with a plurality of end clamp assemblies that are positioned at opposite ends of said base plate and adjacent to said end support members.

9. The method of claim 2, wherein clamping said face down support members to said base plate and performing said welding operation comprises:

clamping a first portion of said face down support members to said base plate;

welding said first portion of said plurality of face down support members together during a first phase of said welding operation;

after welding said first portion of said plurality of face down support members together, clamping a second portion of said face down support members to said base plate; and welding said second portion of said plurality of face down support members to said first portion of said plurality of face down support members during a second phase of said welding operation.

10. The method of claim 2, wherein performing said welding operation comprises controlling at least one of a welding process input used, a heat input used, and a sequence in which welds are performed to weld together said face down support members.

11. A method of fabricating a screen panel assembly, the method comprising:

positioning a plurality of support members in a jig assembly, said positioning comprising aligning each of said plurality of support members between a plurality of respective pairs of alignment pins, each of said alignment pins being mounted to a base plate of said jig assembly;

clamping said plurality of support members to said base plate; and performing a welding operation to weld together said support members while said support members are clamped to said base plate, said welded together support members comprising a support frame, said welding operation inducing a first post-fabrication amount of curvature in said support frame, wherein each weld performed during said welding operation is performed from a same side of said support frame.

12. The method of claim 11, further comprising removing said support frame having said first post-fabrication amount of curvature from said jig assembly and unitizing said screen panel assembly by attaching a perforated plate and a plurality of screening material layers to said support frame having said first post-fabrication amount of curvature.

13. The method of claim 12, wherein unitizing said screen panel assembly comprises:

positioning said perforated plate between said plurality of screening material layers and said support frame having said first post-fabrication amount of curvature, wherein at least top and bottom surfaces of said perforated plate are coated with an epoxy material;

performing an epoxy curing operation by pressing said support frame having said first post-fabrication amount of curvature, said epoxy coated perforated plate, and said plurality of screening material layers together in a pre-heated pressing apparatus, said epoxy curing operation inducing bowing in said support frame, wherein said epoxy curing operation is arranged so that, after completing said epoxy curing operation, curvature in said support frame is reduced from said first post-fabrication amount of curvature to a second post-unitization amount of curvature that is less than said first post-fabrication amount.

14. The method of claim 11, wherein positioning said plurality of support members in said jig assembly comprises arranging each of said plurality of support members face down on said base plate so that a bottom side of each of said plurality of support members faces upward and away from said base plate during said welding operation.

15. The method of claim 14, wherein performing each weld of said welding operation from said same side of said support frame comprised performing each weld from said bottom side of said support frame.

16. The method of claim 11, wherein positioning said plurality of support members in said jig assembly and clamping said plurality of support members to said base plate comprises:

positioning first and second side support members in said jig assembly;

positioning first and second end support members in said jig assembly, said first and second end support members extending laterally between said first and second side support members;

clamping said first side support member and said first and second end support members to said base plate with a first plurality of side clamp assemblies that are positioned adjacent to said first side support member;

after clamping said first side support member and said first and second end support members to said base plate, positioning a plurality of cross members on said base plate, each of said plurality of cross members extending laterally between said first and second side support members;

after positioning said plurality of cross members between said first and second side support members, clamping said second side support member to said base plate with a second plurality of side clamp assemblies that are positioned adjacent to said second side support member; and after clamping said second side support member to said base plate, clamping said plurality of cross members to said base plate with a plurality of end clamp assemblies, wherein at least one each of said plurality of end clamp assemblies is positioned at opposite ends of said base plate and adjacent to a respective one of said first and second end support members.

17. The method of claim 11, wherein performing said welding operation comprises controlling at least one of a welding process used, heat input used, and a sequence in which each weld is performed during said welding operation.

18. A system, comprising:

a plurality of support members for a support frame of a screen panel assembly;

a jig assembly comprising a base plate, a plurality of support member alignment pins mounted on said base plate, and a plurality of clamp assemblies attached to said base plate, wherein said plurality of support member alignment pins are positioned on said base plate so as to align each of said plurality of support members, and wherein said plurality of clamp assemblies are adapted to clamp each of said aligned support members to said base plate during a welding operation that is adapted to induce a first post-fabrication amount of curvature in said support frame during welding thereof; and a pressing apparatus comprising first and second press plates and a heat source operatively coupled to at least one of said first and second press plates, wherein said pressing apparatus is adapted to press together and heat at least a plurality of screening material layers, a perforated plate, and said support frame having said first post-fabrication amount of curvature during a screen panel unitization process, said screen panel unitization process being adapted to induce bowing in said support frame that, after completion of said screen panel unitization process, reduces a net amount of curvature in said support frame from said first post-fabrication amount of curvature to a second post-unitization amount of curvature that is less than said first post-fabrication amount.

19. The system of claim 18, wherein said plurality of support member alignment pins comprise pairs of alignment pins, each of said plurality of support members being adapted to be arranged between a plurality of said pairs of alignment pins.

20. The system of claim 18, wherein each of said plurality of support members is adapted to be clamped face down to said base plate during said welding operation.

* * * * *